US012692695B2

(12) United States Patent
Shi

(10) Patent No.: US 12,692,695 B2
(45) Date of Patent: Jul. 28, 2026

(54) MODULAR BUILDING PLATFORM AND ASSEMBLY METHOD THEREOF

(71) Applicant: Weitao Shi, Great Neck, NY (US)

(72) Inventor: Weitao Shi, Great Neck, NY (US)

(73) Assignee: Weitao Shi, Great Neck, NY (US)

( * ) Notice: Subject to any disclaimer, the term of this patent is extended or adjusted under 35 U.S.C. 154(b) by 0 days.

(21) Appl. No.: 19/112,272

(22) PCT Filed: Nov. 27, 2024

(86) PCT No.: PCT/US2024/057783

§ 371 (c)(1),
(2) Date: Mar. 17, 2025

(87) PCT Pub. No.: WO2025/117766

PCT Pub. Date: Jun. 5, 2025

(65) Prior Publication Data

US 2026/0009220 A1 Jan. 8, 2026

Related U.S. Application Data

(60) Provisional application No. 63/650,413, filed on May 22, 2024, provisional application No. 63/633,049,
(Continued)

(51) Int. Cl.
*E04B 1/344* (2006.01)
*E04B 1/35* (2006.01)
(Continued)

(52) U.S. Cl.
CPC ..... *E04B 1/3445* (2013.01); *E04B 1/35* (2013.01); *E04B 2/76* (2013.01); *E04B 5/14* (2013.01); *E04B 2001/3588* (2013.01)

(58) Field of Classification Search
CPC ..... E04B 2001/327; E04B 2001/3276; E04B 2001/3282; E04B 2001/3588;
(Continued)

(56) References Cited

U.S. PATENT DOCUMENTS 3,095,616 A * 7/1963 Bigelow, Jr. ..... E04B 1/34317 52/64
3,832,956 A * 9/1974 Briel, Jr. ..... E04B 1/3483 108/55.1
(Continued)

FOREIGN PATENT DOCUMENTS

CA 2286265 A1 4/2000
CA 2556246 A1 * 2/2008 ..... E04B 1/3445
(Continued)

*Primary Examiner* — Kyle J. Walraed-Sullivan
(74) *Attorney, Agent, or Firm* — Law Offices of Albert Wai-Kit Chan, PLLC

(57) ABSTRACT

The present invention provides a prefabricated building structure, a building assembled with the prefabricated building structure, and its method for assembly. In one embodiment, said prefabricated building structure comprises: a) an upper floor slab, including at least one column, with each of the said at least one column comprises a movable connection end and a free end; b) a lower floor slab, including at least one column slot, with each of the said at least one column slot positioned to correspond to the movable connection end; c) a spacing slab, including a set of guide rails; wherein the spacing slab is positioned between the lower floor slab and the upper floor slab; said at least one column is initially in a horizontal position and adopts an upright position when the free end is guided by the guide rails into a corresponding column slot after the upper floor slab is raised.

24 Claims, 67 Drawing Sheets

Related U.S. Application Data filed on Apr. 11, 2024, provisional application No. 63/605,263, filed on Dec. 1, 2023.

(51) Int. Cl.
*E04B 2/76* (2006.01)
*E04B 5/14* (2006.01)

(58) Field of Classification Search
CPC ..... E04B 1/34317; E04B 1/31321; E04B 1/34326; E04B 1/34331; E04B 1/34384; E04B 1/344; E04B 1/3441; E04B 1/3442; E04B 1/3444; E04B 1/3445; E04B 1/35; E04B 1/3511; E04B 1/3516; E04B 1/3522; E04B 1/3533; E04B 1/3538
See application file for complete search history.

(56) References Cited

U.S. PATENT DOCUMENTS 4,548,012 A * 10/1985 Dyer ..... E04B 1/3441 52/646
4,630,627 A * 12/1986 Windows ..... E04H 15/48 135/912
5,107,639 A * 4/1992 Morin ..... E04B 1/345 220/6
6,253,498 B1 * 7/2001 Fanucci ..... E04B 1/3445 52/143
11,802,402 B1 * 10/2023 Langer ..... E04B 1/34384
2006/0248809 A1 * 11/2006 Rulquin ..... E04B 1/3445 52/79.5
2008/0083189 A1 * 4/2008 Dulac ..... E04B 1/3445 52/79.5
2010/0025397 A1 * 2/2010 Krohn ..... B65D 88/522 220/6
2012/0096775 A1 * 4/2012 Allison ..... E04H 3/24 52/79.5
2013/0067846 A1 * 3/2013 Kvols ..... E04B 1/34315 52/586.1
2014/0157714 A1 * 6/2014 Richardson ..... E04B 1/3441 52/646
2020/0332512 A1 * 10/2020 Smith ..... E04B 1/3445
2021/0246648 A1 * 8/2021 Mullaney ..... E04H 1/04
2021/0404170 A1 * 12/2021 Hariri ..... E04B 1/34363
2023/0095414 A1 * 3/2023 Lippert ..... E04B 1/3445 52/79.5
2024/0263438 A1 * 8/2024 Langer ..... E04B 1/34384

FOREIGN PATENT DOCUMENTS

CN 217151408 U 8/2022
DE 4342366 A1 7/1994
EP 3059357 A1 * 8/2016 ..... E04H 1/1272
GB 2439074 A * 12/2007 ..... E04B 1/343
WO WO-2012094766 A1 * 7/2012 ..... E04B 1/3441

* cited by examiner

MODULAR BUILDING PLATFORM AND ASSEMBLY METHOD THEREOF

FIELD OF THE INVENTION

The present invention relates to a modular building platform and its assembly method designed to improve construction efficiency and reduce labor costs.

BACKGROUND OF THE INVENTION

Limitations of Existing Construction Methods

Existing construction methods have been in use for over a century. Regardless of whether the structure is made of wood or concrete, on-site construction is required. This approach is not only labor-intensive, time-consuming, and hazardous, but also results in material waste, the generation of garbage, and environmental pollution. Additionally, it incurs high construction insurance and labor costs, leading to overall high expenditures. Furthermore, current methods often exhibit discrepancies between design drawings and actual construction outcomes, increasing project uncertainty.

Advantages of the Modular Building Platform

In contrast, the modular building platform of the present invention adopts a new production and assembly concept. All components are manufactured in factories according to our standards and requirements. Since each component is a standardized modular product, full mechanized production, akin to automobile manufacturing, can be achieved. These standardized modular components can be quickly assembled on-site and support the factory in producing customized components, under our authorization, to meet diverse consumer needs. These components are then integrated on-site using our novel assembly method. As a modular platform, existing factories can leverage our authorization and utilize their production capacity to manufacture components with varying finishes that cater to consumer preferences, all while adhering to standardization to accommodate diverse needs. For instance, some consumers may require fully glass façades for exterior walls, while others prefer brick finishes. For interior walls, some may require painted finishes, while others desire marble finishes. Our system enables different manufacturers to use our platform authorization to produce products tailored to varied demands. The goal of this invention is to reduce product costs, shorten installation times, decrease labor requirements, provide a safer construction environment, and significantly reduces discrepancies between design drawings and actual construction outcomes, ultimately achieving the effect of "what-you-see-is-what-you-get", offering efficient, economical, and safe building solutions. Our system not only lowers overall costs but also provides options for ordinary consumers to own dream homes that were exclusive to luxurious residences.

SUMMARY OF THE INVENTION

The present invention provides a prefabricated building structure. In one embodiment, said prefabricated building structure comprises: a) an upper floor slab, comprising at least one column, with each of said at least one column comprising a movable connection end and a free end; b) a lower floor slab, comprising at least one column slot, with each of said at least one column slot positioned to correspond to said movable connection end; c) a spacing slab, comprising a set of guide rails; wherein said spacing slab is positioned between said lower floor slab and said upper floor slab; said at least one column is initially in a horizontal position; when said upper floor slab is raised, said free end of said at least one column is guided by said set of guide rails into a corresponding column slot among said at least one column slot, causing said at least one column to adopt an upright position.

The present invention also provides a building. In one embodiment, said building comprises: a) at least two of said prefabricated building structures in the present invention; b) partition components; wherein said upper floor slabs and said lower floor slabs of said at least two prefabricated building structures are connected at connections to form a single floor; said partition components divide said single floor into different spaces. In one embodiment, said connections comprise one or more connecting floor slabs which corresponds to number of said upper floor slabs and said lower floor slabs.

The present invention further provides a method for assembling said building in the present invention. In one embodiment, said method comprises: a raising step to lift said upper floor slabs to create a space for inserting said partition components; and a lowering step where a downward pressing interlock structure of said upper floor slabs presses down on a receiving structure of said partition components to lock said partition components in place and prevent displacement.

BRIEF DESCRIPTION OF THE FIGURES

FIG. 1A shows the upper floor slab (1-1), including at least one column (1-11). Each of said at least one column comprises a movable connection end (1-111) and a free end (1-112), as illustrated in FIGS. 1B and 1C, respectively. FIG. 1D shows the lower floor slab (1-2), including at least one column slot (1-21). Each of said at least one column slot (1-21) is positioned at the corresponding location of the movable connection end (1-111). FIG. 1E shows the spacing slab (1-3), including a set of guide rails (1-31). Said spacing slab (1-3) is positioned between the lower floor slab (1-2) and the upper floor slab (1-1).

DETAILED DESCRIPTION OF THE INVENTION

Figure 1A:
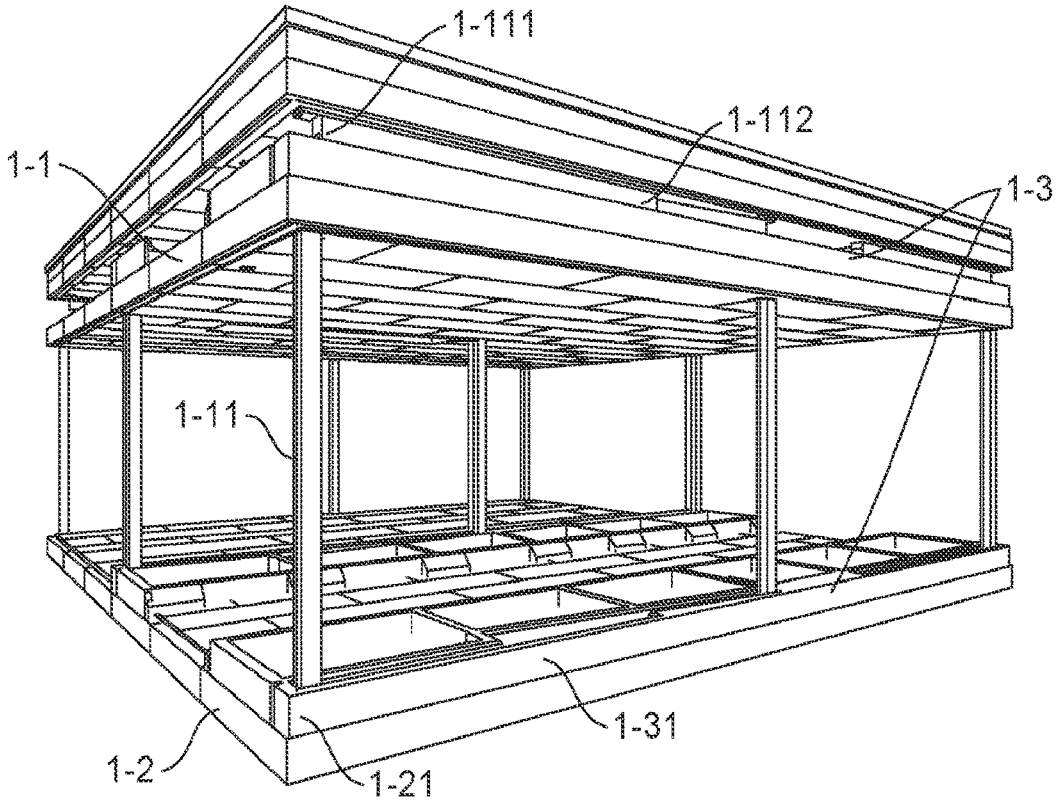
FIGS. 1A to 1E are schematic diagrams of said prefabricated building structure in an embodiment of this invention.
Figure 1B:
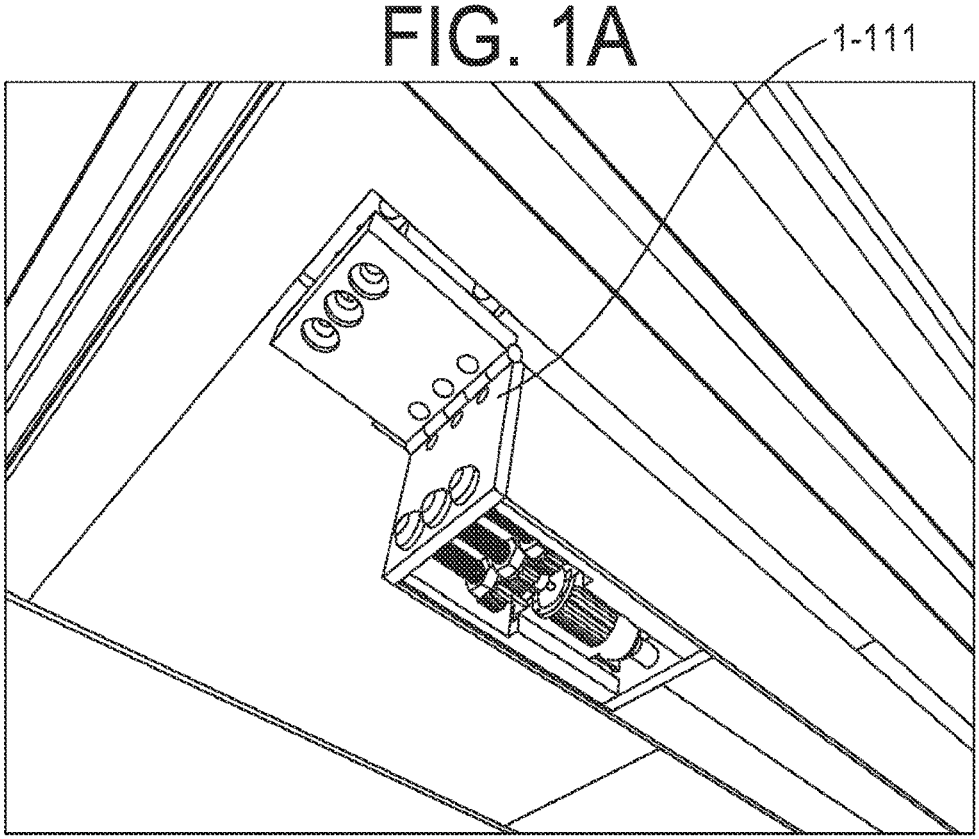
Figure 1C:
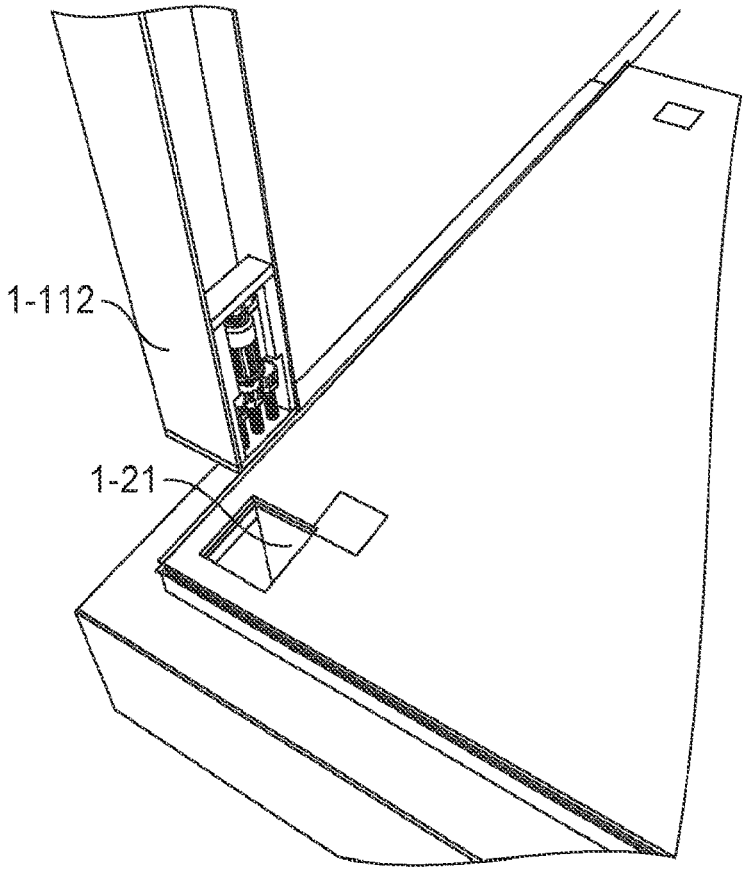
Figure 1D:
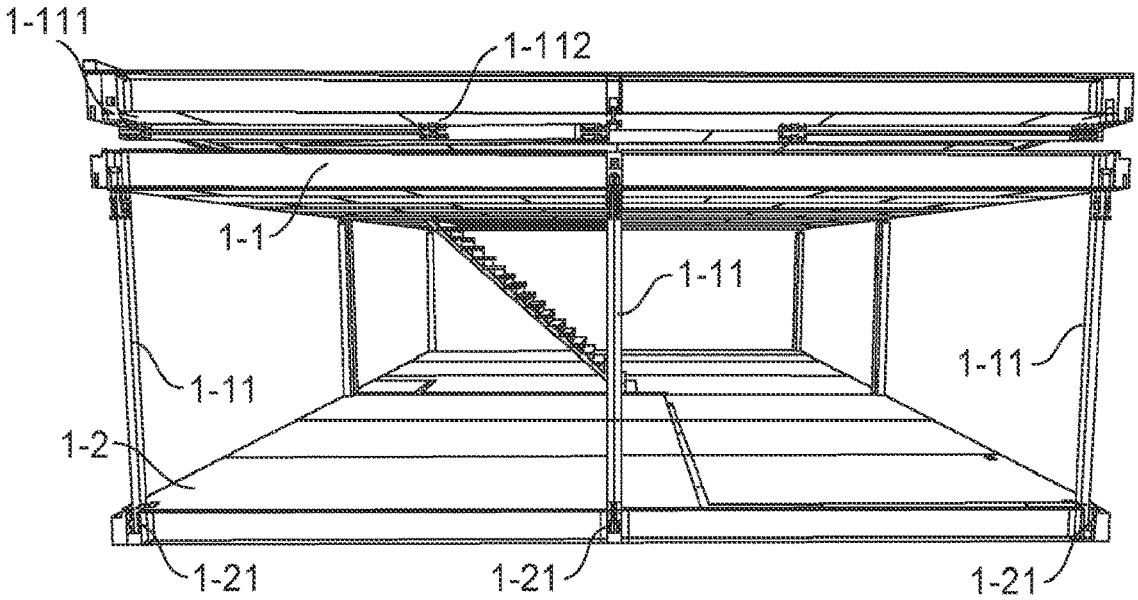
Figure 1E:
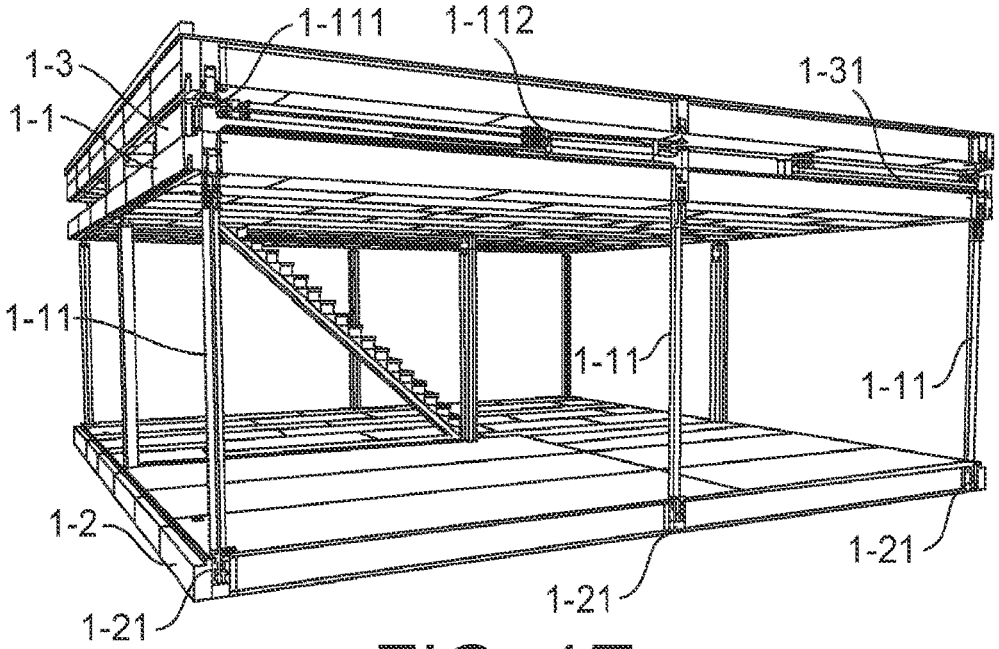
Figure 2A:
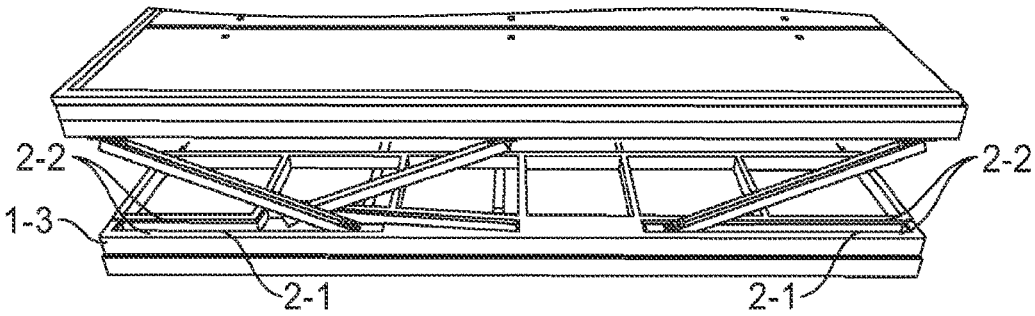
FIGS. 2A to 2F illustrate the different states of said at least one column, as well as other components specifically designed for use in an embodiment of this invention.
Figure 2B:
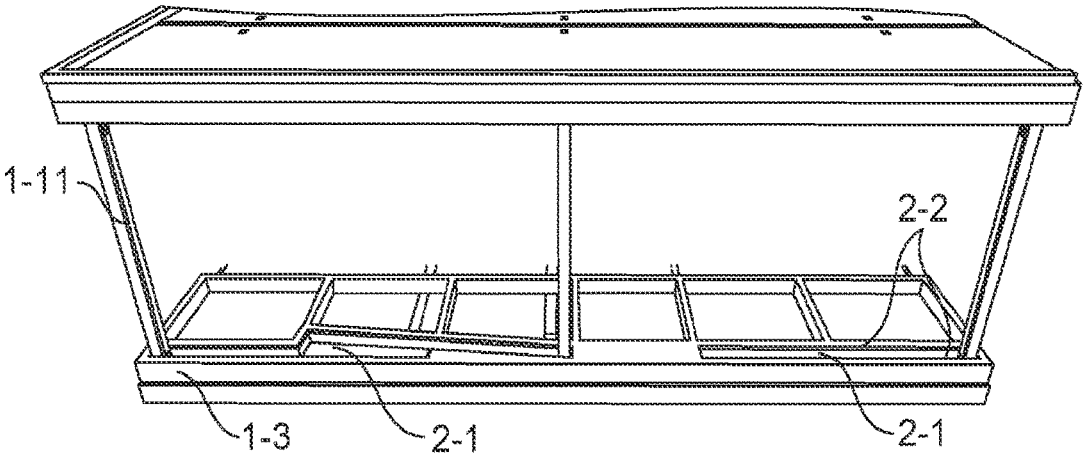
Figure 2C:
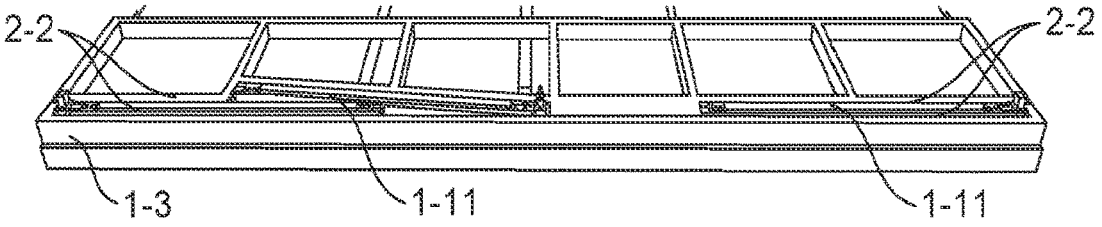
Figure 2D:
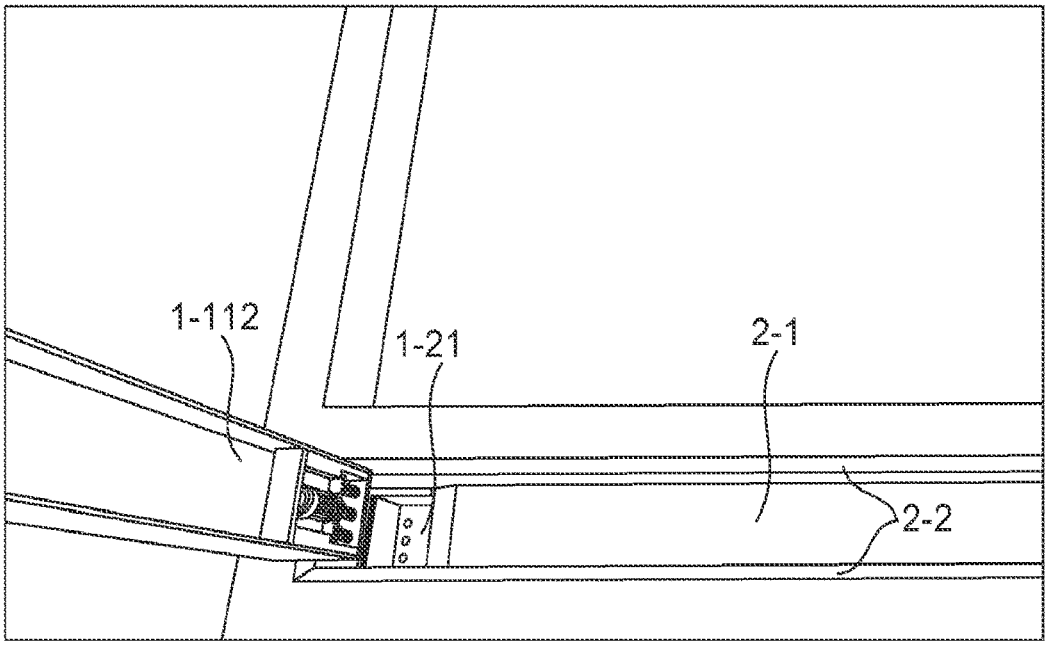
Figure 2E:
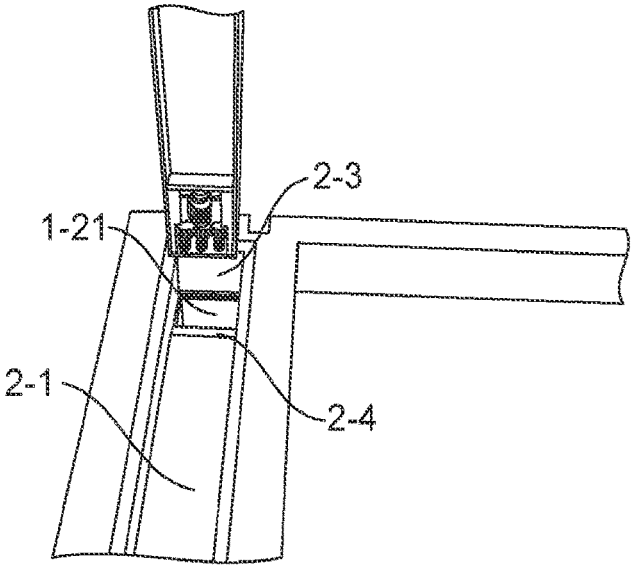
Figure 2F:
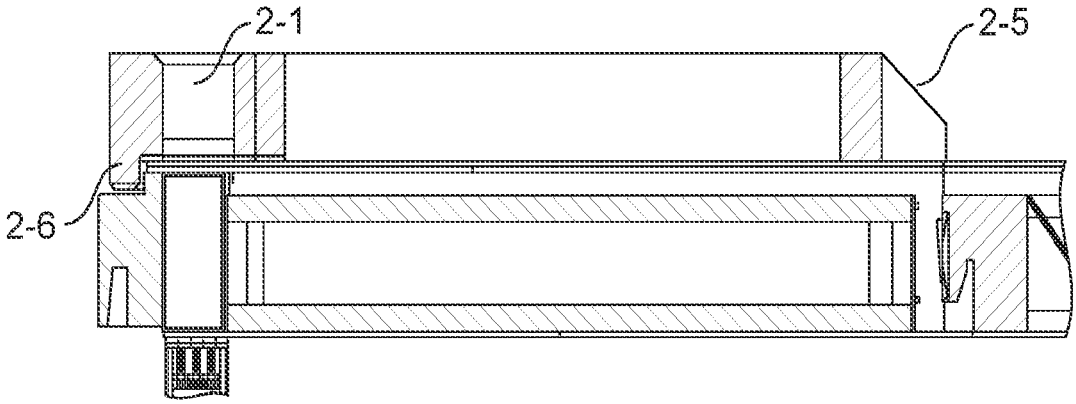
Figure 3A:
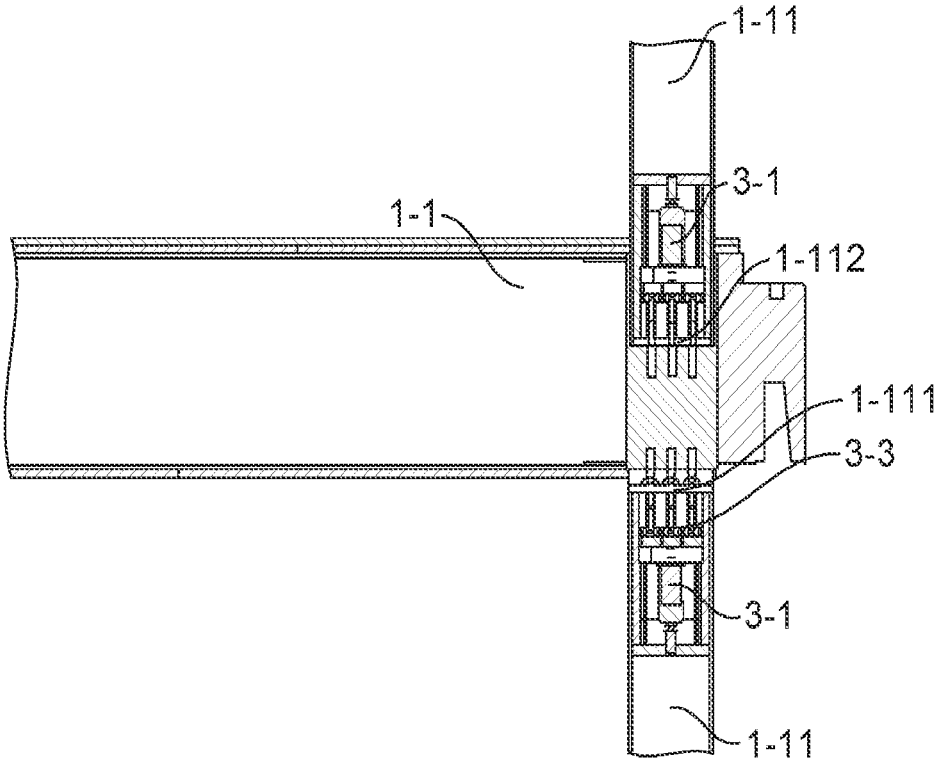
FIGS. 3A to 3C are schematic diagrams of the automatic tightening device and its fastening device designed for an embodiment of the present invention.
Figure 3B:
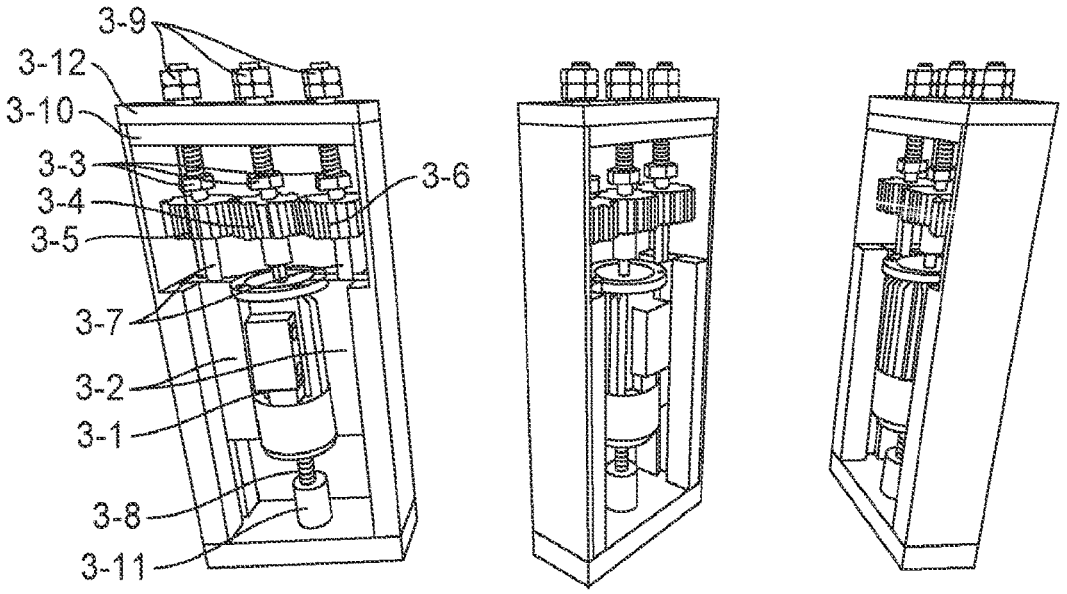
Figure 3C:
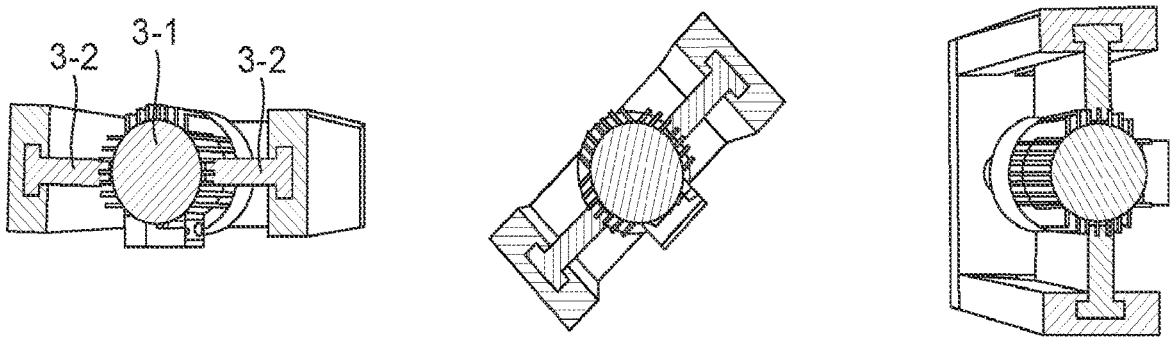
Figure 3D:
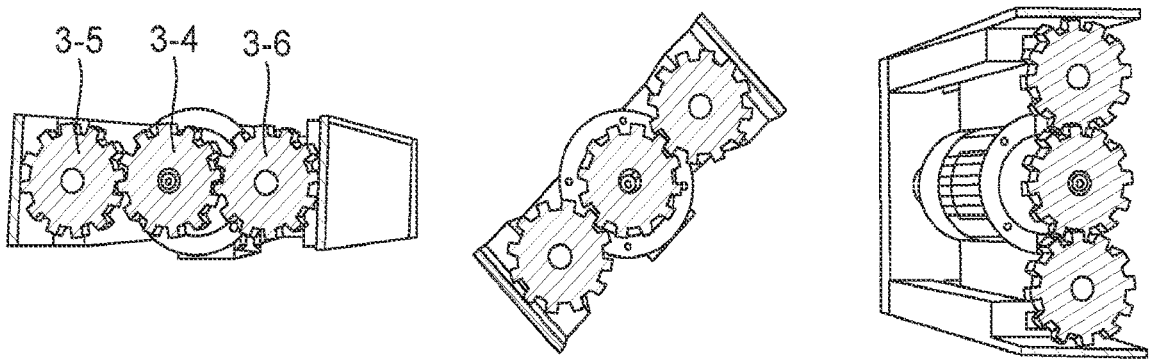

The modular building system of the present invention focuses on efficiency and overall aesthetics by prefabricating various components, including interior floors, bathroom floors, column decorations, ceilings, lighting fixtures, and roofs, in the factory. The entire building is then assembled following the structural descriptions and installation sequence outlined in the accompanying figures. This method not only ensures high construction quality but also requires minimal labor and significantly reduces on-site construction time.

This invention provides a prefabricated building structure. In one embodiment, said prefabricated building structure comprises: a) an upper floor slab, comprising at least one column, each of said at least one column comprises a movable connection end and a free end; b) a lower floor slab, comprising at least one column slot, each of said at least one column slot positioned to correspond to said movable connection end; c) a spacing slab, comprising a set of guide rails, wherein said spacing slab is positioned between said lower floor slab and said upper floor slab; said at least one column is initially in a horizontal position; when said upper floor slab is raised, said free end of said at least one column is guided by said set of guide rails into a corresponding column slot among said at least one column slot, causing said at least one column to adopt an upright position.

In one embodiment, said at least one column comprises two or more columns, wherein said two or more columns do not overlap when placed in a horizontal position.

In one embodiment, said spacing slab is made of a material selected from lightweight hard materials. In another embodiment, the lightweight hard materials comprise hard paper-based materials. In a further embodiment, the lightweight hard materials comprise a hard paper cover and a lightweight inner core.

In one embodiment, said upper floor slab comprises: a) a roof level slab; or b) at least one intermediate floor slab and a roof level slab.

In one embodiment, said prefabricated building structure further comprises an automatic tightening device for tightening connections in said prefabricated building structure.

In one embodiment, said automatic tightening device secures said movable connection end to said floor slab when said at least one column is in an upright position.

In one embodiment, said automatic tightening device comprises an electric wrench and at least one bolt.

In one embodiment, said prefabricated building structure further comprises a floor slab fixing mechanism, which secures said upper floor slab, spacing slab, and lower floor slab together when said at least one column is in a horizontal position.

The present invention also provides a building. In one embodiment, said building comprises: a) at least two of said prefabricated building structures in the present invention; b) one or more connecting floor slabs which corresponds to number of said upper floor slabs and said lower floor slabs; c) partition components; wherein said connecting floor slabs are installed between said at least two prefabricated building structures to form a single floor; said partition components divide different spaces within said single floor.

In one embodiment, said at least two prefabricated building structures further comprise interior wall slide rails fixed on the upper or lower floor slabs, and said partition components comprise interior walls; wherein said interior wall slide rails are configured to guide said interior walls.

In one embodiment, each of said interior walls comprises a hanger piece, said hanger piece comprises a support rod and a set of rollers, wherein said support rod is centrally located and said set of rollers is bottom located; wherein said hanger piece is located at the top of said interior wall and connected to a wall body via said support rod; said hanger piece is positioned within said interior wall slide rails.

In one embodiment, said banger piece comprises a shape selected from the group consisting of circular, square, and rectangular shapes.

In one embodiment, each of said interior walls comprise an interior wall locking device for securing said interior walls.

In one embodiment, said interior wall locking device comprises an upper fixing component and/or a lower fixing component; a) said upper fixing component comprises said interior wall slide rail and a recessed slot on said interior wall, wherein said interior wall slide rail is pressed into said recessed slot to secure an upper part of said interior wall; b) said lower fixing component comprises a fixing element at a bottom of said interior wall and a fixed connector on said lower floor slab or said upper floor slab, wherein said fixing element and said fixed connector are connected to secure a lower part of said interior wall.

In one embodiment, said prefabricated building structure, said connecting floor slabs, and said partition components are connected at connection points for power, pipelines, or water pipes.

In one embodiment, said interior walls are adapted for use with an interior wall assembly device, wherein said interior wall assembly device comprises: a) a docking rail configured to interface with a built-in slide rail in said upper floor slab; b) a storage area for storing interior walls; c) a first interior wall transport mechanism for transporting interior walls from said storage area to said docking rail; and d) a second interior wall transport mechanism for transporting interior walls from said docking rail to said built-in slide rail.

In one embodiment, said prefabricated building structure further comprises exterior wall slide rails fixed to edges of said upper floor slab or said lower floor slab, and said partition components comprises exterior walls; wherein said exterior wall slide rails are configured to guide said exterior walls.

In one embodiment, said exterior walls are adapted for use with an exterior wall assembly device, wherein said exterior wall assembly device comprises: a) a docking rail configured to interface with a built-in slide rail in said upper floor slab; b) a storage area for storing exterior walls; c) a first exterior wall transport mechanism for transporting exterior walls from said storage area to said docking rail; and d) a second exterior wall transport mechanism for transporting exterior walls from said docking rail to said built-in slide rail.

In one embodiment, said upper floor slab comprises exterior wall locking devices for interlocking with exterior wall locking devices at a top part of said exterior wall.

In one embodiment, said upper floor slab comprises a downward pressing interlock structure, wherein said downward pressing interlock structure is mounted on a receiving structure on said partition components, such that said downward pressing interlock structure and said receiving structure interacts to lock and secure in place said partition components in place and prevent displacement. In one embodiment, said downward pressing interlock structure applies at least a portion of weight of said upper floor slab on said partition components.

In one embodiment, the building of this invention is assembled using a method in which said upper floor slab is raised to create a space for placing said partition components, and upon lowering said upper floor slab, said upper floor slab presses down on said partition components to lock and secure its displacement. In one embodiment, at least a portion of weight of said upper floor slab will be pressing down on said partition component. Methods for raising said upper floor slab include but not limited to the use of screw jacks, cranes, pneumatic rods, hydraulic jacks, etc. Hydraulic jacks are merely used as an illustration in the present invention. A skilled person would readily understand that any equipment capable of raising the upper floor slab would be an equivalent of the devices described in this invention and fall into the scope of this invention. In another embodiment, said building comprises a jack for raising said upper floor slab to create a space for placing said partition components and, upon lowering said upper floor slab, to secure the displacement of said partition components.

In one embodiment, said jack is positioned within a lifting space on said movable connection end, wherein said lifting space comprises an outer sleeve located on said upper floor slab and an inner sleeve connected to said at least one column; said outer sleeve encircles said inner sleeve, such that when said jack raises said upper floor slab from within said inner sleeve, movement of said upper floor slab is constrained by the trajectory of said outer sleeve, thereby stabilizing said upper floor slab.

In one embodiment, said prefabricated building structure, said connecting floor slabs, and said partition components further comprises one or more automatic tightening devices for tightening connections in said building.

In one embodiment, each of said one or more automatic tightening devices comprise an electric wrench and at least one bolt.

The present invention further provides a method for assembling the building in the present invention. In one embodiment, said method comprises: a raising step to lift said upper floor slabs to create a space for inserting said partition components; and a lowering step where a downward pressing interlock structure of said upper floor slabs press down on said receiving structure to lock said partition components in place and prevent displacement by bounding said partition components in its intended locations. In one embodiment, a portion of weight of said upper floor slabs is applied to said partition components.

In one embodiment, said raising step or lowering step is performed using machines comprising one or more selected from the group consisting of screw jacks, cranes, pneumatic rods, and hydraulic jacks.

Example 1

Prefabricated Building Structure

The present invention provides a prefabricated building structure. FIGS. 1A to 1E illustrate an embodiment of the present invention, whereby said prefabricated building structure comprises an upper floor slab (1-1), comprising at least one column (1-11), each of said at least one column comprises a movable connection end (1-111) and a free end (1-112); a lower floor slab (1-2), comprising at least one column slot (1-21), with each of said at least one column slot (1-21) positioned to correspond to said movable connection end (1-111); and a spacing slab (1-3), comprising a set of guide rails (1-31); wherein said spacing slab (1-3) is positioned between said lower floor slab (1-2) and said upper floor slab (1-1).

FIGS. 2A to 2F illustrate another embodiment of the present invention, whereby said at least one column (1-11) is in a horizontal position, and when said upper floor slab (1-1) is raised, said free end (1-112) of said at least one column (1-11) is guided by said set of guide rails (1-31) into said at least one column slot (1-21), causing said at least one column (1-11) to adopt an upright position. In the prefabricated building structure of the present invention, said at least one column comprises two or more columns (1-11), which do not overlap when said two or more columns are in a horizontal position. This design reduces the height of said prefabricated building structure during transportation, making it easier to transport. Said spacing slab (1-3) is made of a hard, lightweight material. In an embodiment, said lightweight hard material comprises a hard paper cover material and a lightweight inner core. Based on the number of floors required for a building, said upper floor slab can serve as a roof level slab for constructing a single-story building, or it can comprise at least one intermediate floor slab and a roof level slab, allowing the building to have more than one story. The prefabricated building structure of the present invention comprises a column guiding and protection system. To guide columns accurately into column slots, long columns are equipped with hard lightweight guide rails (2-1) specifically designed for this system. These guide rails are used when raising the columns, enabling them to slide along the rails into the column slots (1-21). At the end of the sliding process, a cardboard stopper (2-3) is positioned to prevent the columns from exceeding the column slot position. Two sides of the hard cardboard slot (2-2) are elevated. In one embodiment, these are 2-12 inches high. This design effectively restricts column movement during sliding. The cardboard at the column slot entrance can be shaped into a flared opening (2-4) to facilitate the entry of said column if needed. The spacing slab is secured during transportation by a protrusion on its lower edge, which is clamped between two rows of rollers at the base of the exterior wall, limiting lateral movement (2-6). Near the middle of the spacing slab, there is a row of beveled edge components (2-5) to provide positioning support when the intermediate floor slab is lowered during installation. These components can be easily cut and removed after installation is completed. This system prevents damage to the floor slab's finished surface and avoids the use of more expensive alternatives, such as attaching wheels to the column base. Although attaching wheels to the column base could also allow the column to slide into the column slot, this approach increases costs, and the wheels are difficult to remove once they have entered the column slot.

The prefabricated building structure of the present invention may further comprise an automatic tightening device for tightening connections in said prefabricated building structure. In one embodiment, the automatic tightening device is adapted for tightening bolts at any connections in said prefabricated building structure. In another embodiment, the automatic tightening device is adapted for any mechanisms for tightening the connections in said prefabricated building structure e.g. screws, nails or other forms of fasteners or their combination that is capable of securing the connections in said prefabricated building structure. FIGS. 3A to 3D illustrate an embodiment of the automatic tightening device, whereby said automatic tightening device is used to secure said movable connection end to the floor slab when said at least one column is in an upright position. In one embodiment, said automatic tightening device comprises an electric wrench and at least one bolt. This embodiment features a uniquely designed motor (3-1), a multi-head (3-3) motorized fastening device to automatically tighten the bolts, with the motor fixed on a base, and connected to a control wire, which runs through the floor slab and the interior of the column to an external controller. Said automatic tightening device can be applied to the top and bottom of columns, the connections between floor slab beams, the fixing of exterior walls, or other areas requiring bolts. This design enables electronic automated structural fixation, saving labor while making installation faster and safer. Since the parts requiring structural fixation are positioned at high or concealed locations, manual operation would require workers to climb ladders, increasing difficulty and safety risks. The automatic tightening device in the present invention is designed with a motor (3-1) that drives gears (3-4), which in turn drives a left gear (3-5) connected to a bolt and a right gear (3-6) connected to another bolt. Each of the two gears is mounted on a slidable fixing element (3-2) that moves up and down via a fixed rod (3-7). When the motor rotates, the bottom-connected screw rod (3-8) rotates and rises within an elongated nut (3-11) that is fixed at the base, applying an upward force to the upper part The rotation of the motor causes the upper screw rod (3-3) on the gear to rotate upward and tighten together with a nut (3-9) fixed to a panel (3-12), thereby fastening the fixing panel (3-10) with the fixing panel (3-12). This design allows simultaneous tightening of multiple bolts by arranging additional gears in parallel. Since there are left and right gears, the thread directions of the left and right bolts are different. In this embodiment, all connection wires, such as those for jacks and motors, are pre-installed at the factory by running through the floor slabs and terminating at a unified location. During on-site installation, the system only requires connecting to a power source for operation.

Figure 4A:
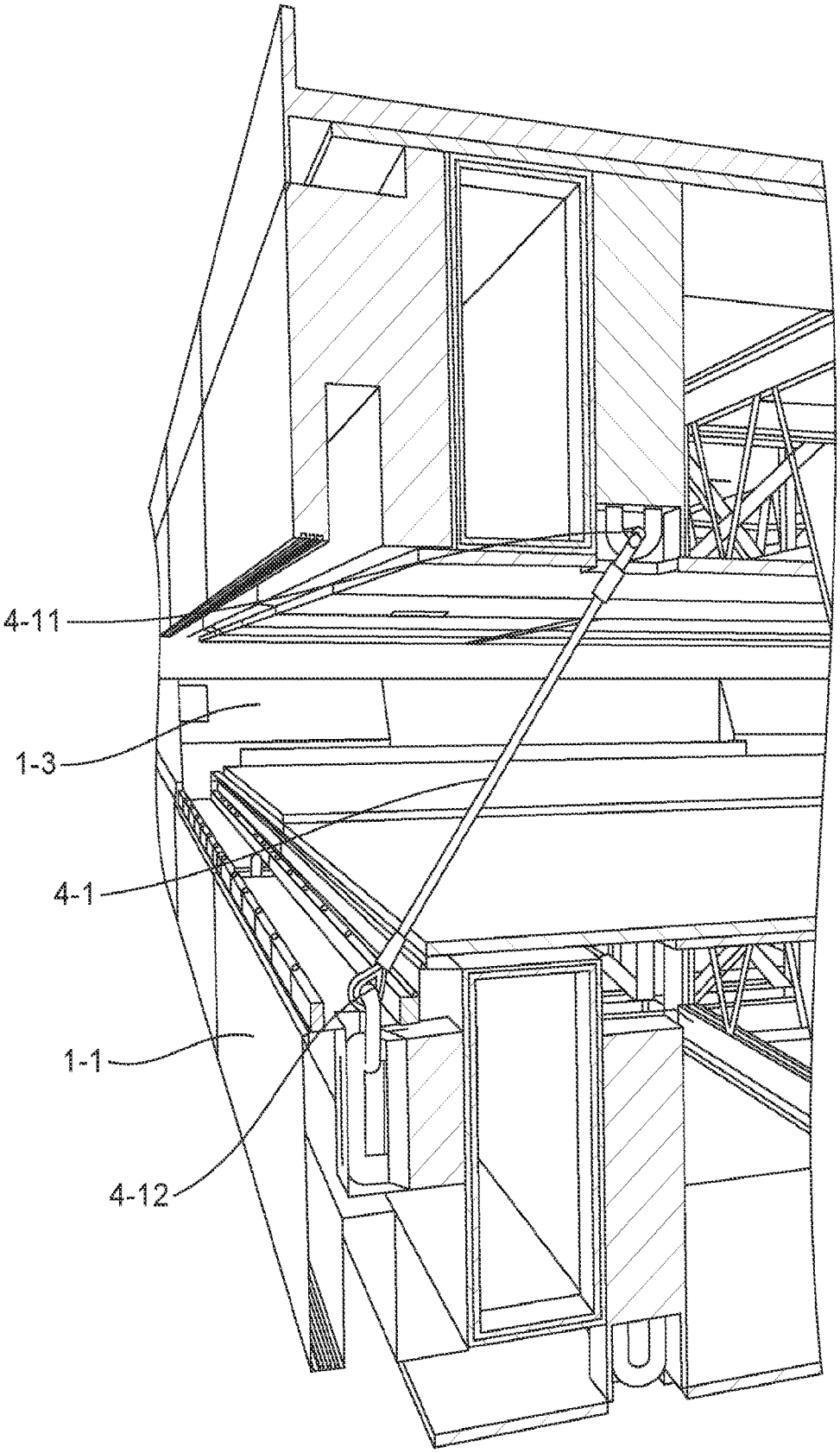
FIG. 4A illustrates a tension rope-type floor slab fixing component (4-1) in an embodiment of said prefabricated building structure. When said at least one column is in a horizontal position, the upper floor slab hook (4-11), the spacing slab (1-3), and the lower floor slab hook (4-12) are fixed together.
Figure 4B:
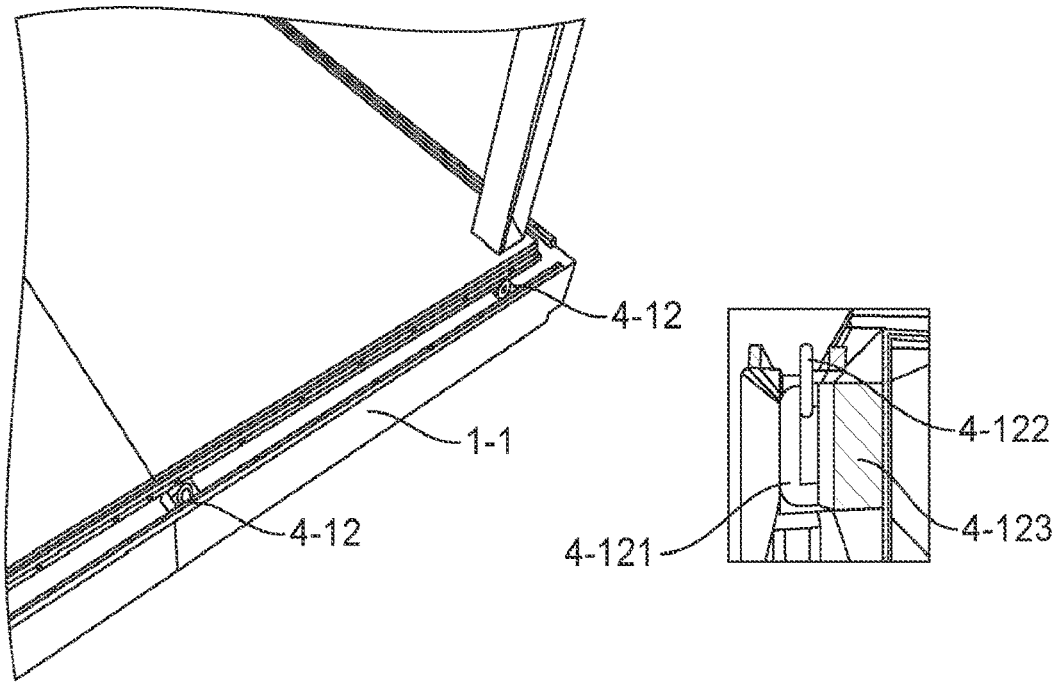
FIG. 4B shows the lower floor slab hook (4-12), including a movable ring (4-122) and a fixed ring (4-121). Component 4-123 is a connector linked to the structural beam.

FIGS. 4A to 4B illustrate a tension rope-type floor slab fixing component (4-1) in the prefabricated building structure of the present invention. This component secures the upper floor slab hook (4-11), the spacing slab (1-3), and the lower floor slab hook (4-12) together when said at least one column is in a horizontal position. The hook (4-12) comprises a movable ring (4-122) and a fixed ring (4-121). Component 4-123 is a connector linked to the structural beam.

Figure 5A:
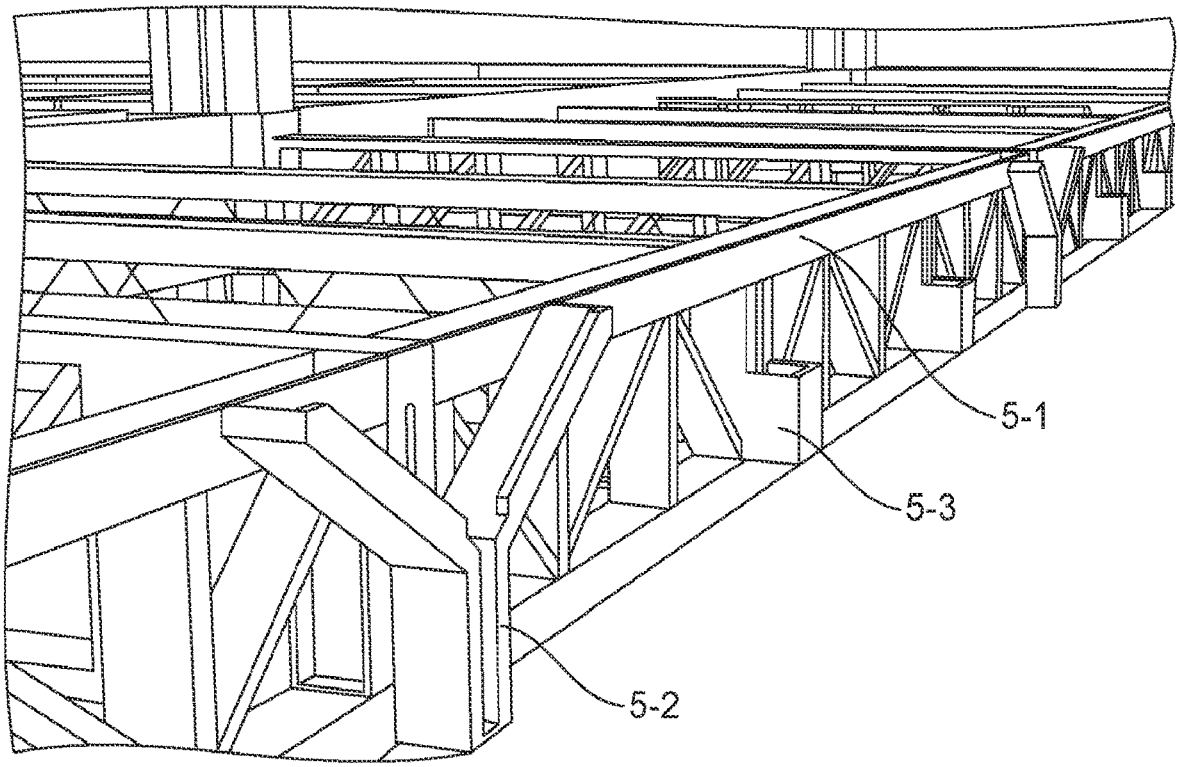
FIGS. 5A to 5J illustrate the use of different fasteners between the floor slabs of said prefabricated building structure to stabilize the structure in an embodiment of this invention.
Figure 5B:
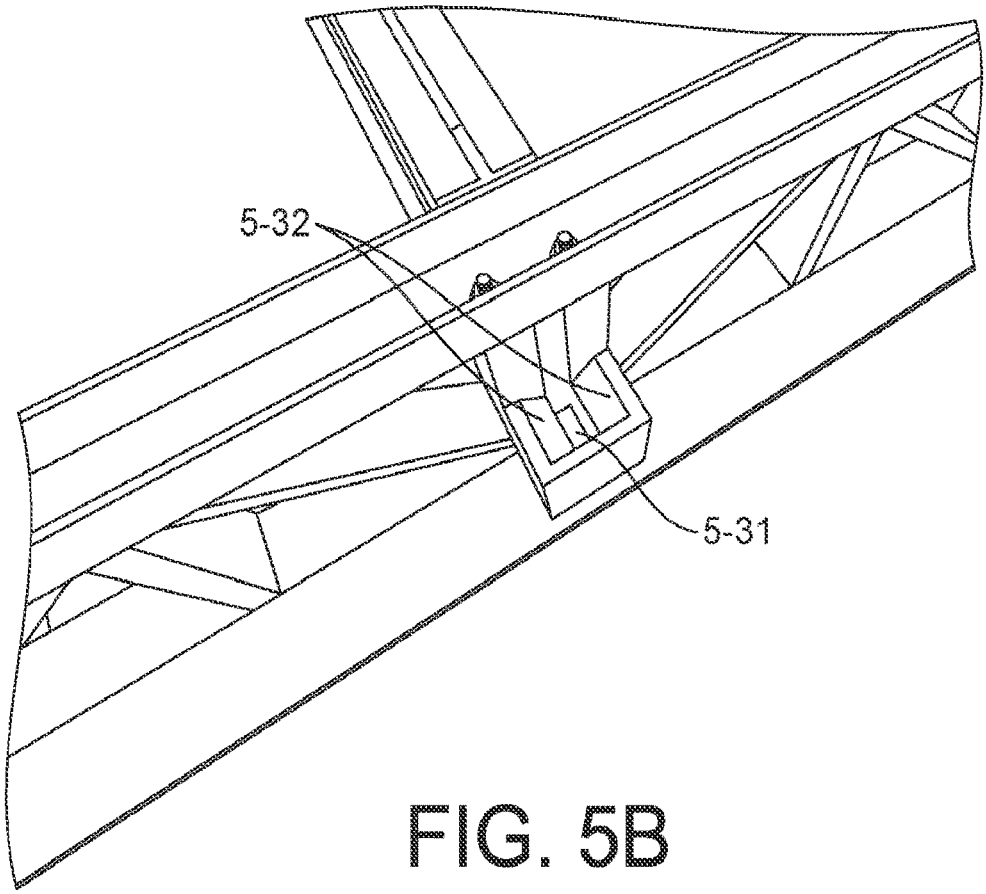
Figure 5C:
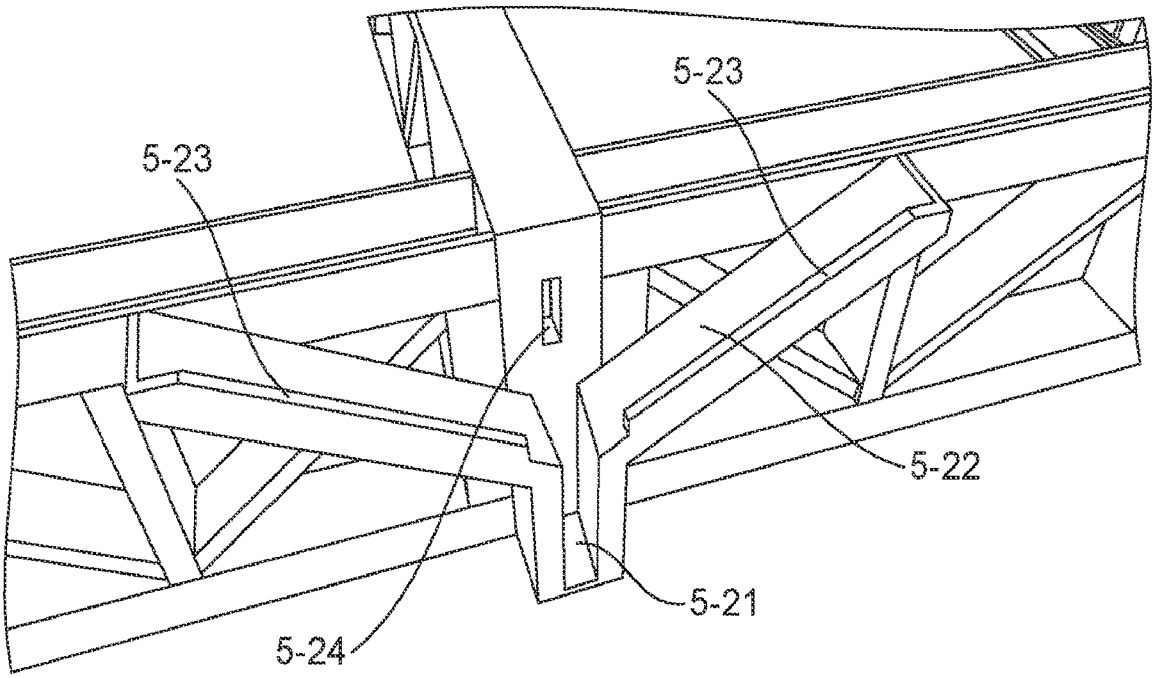
Figure 5D:
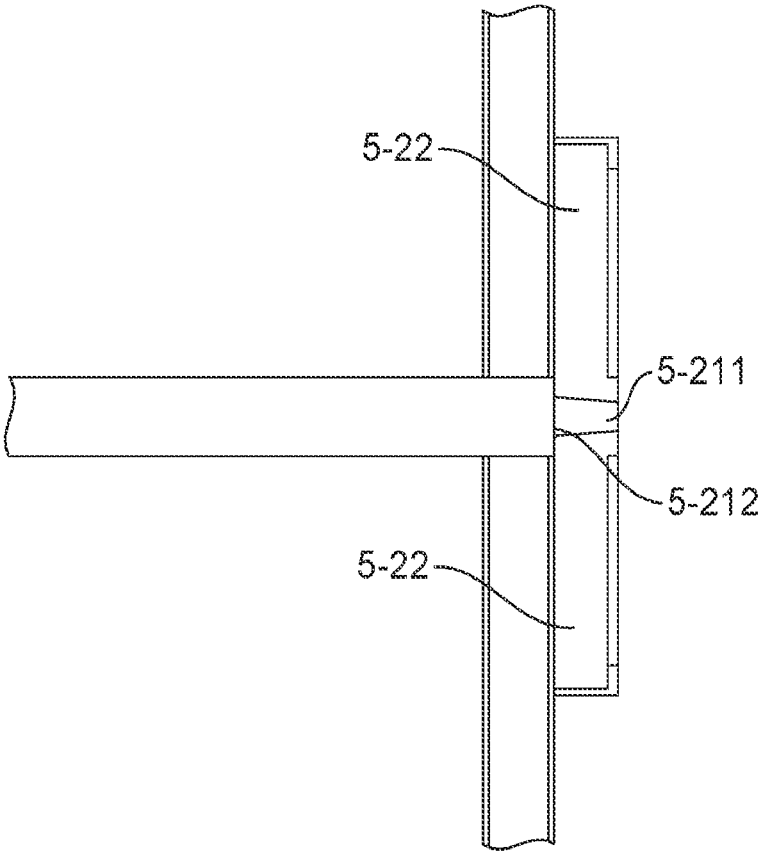
Figure 5E:
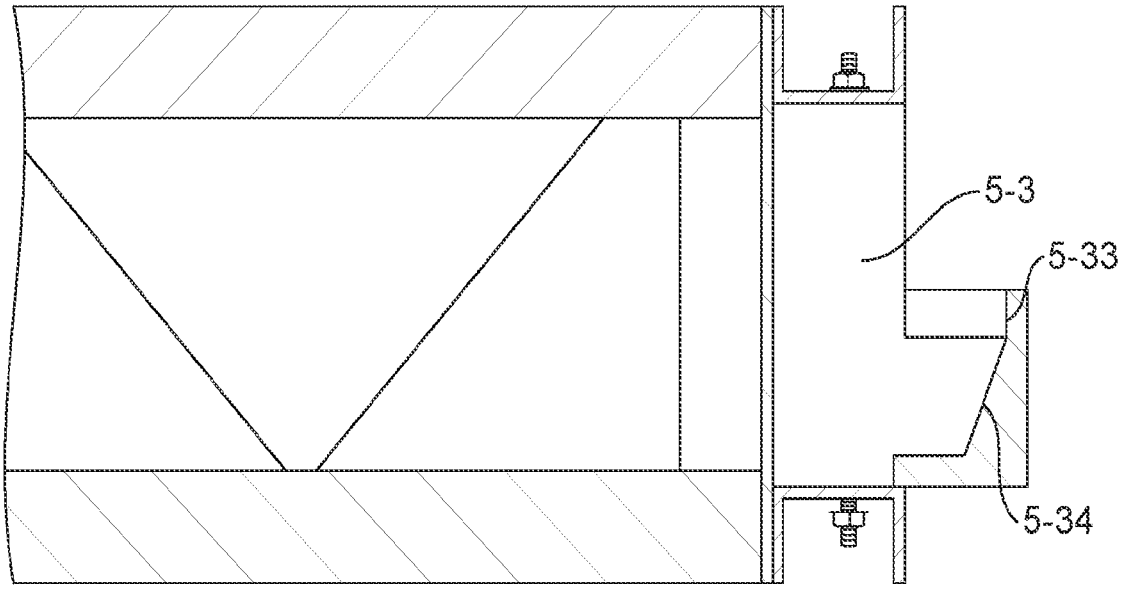
Figure 5F:
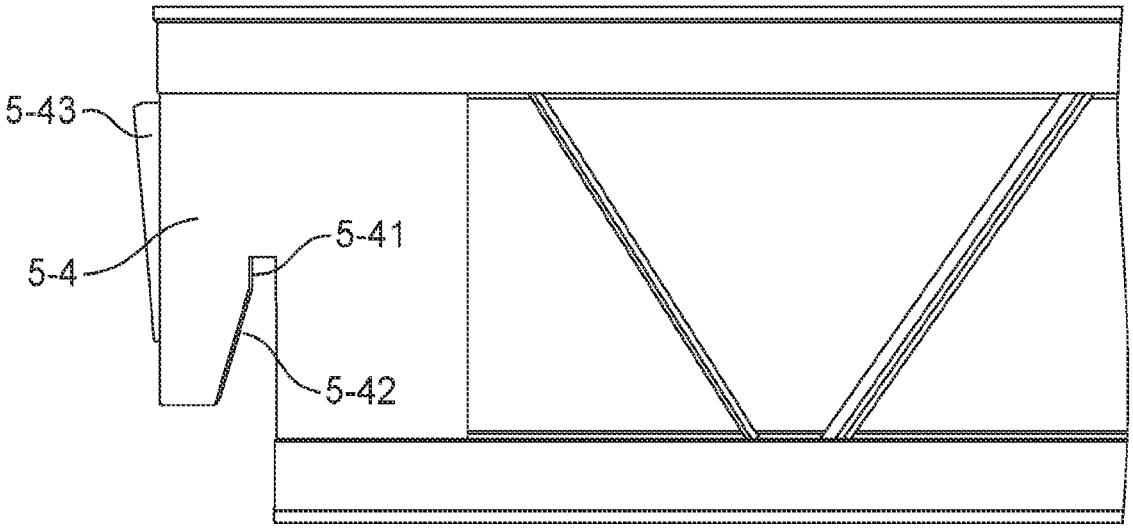
Figure 5G:
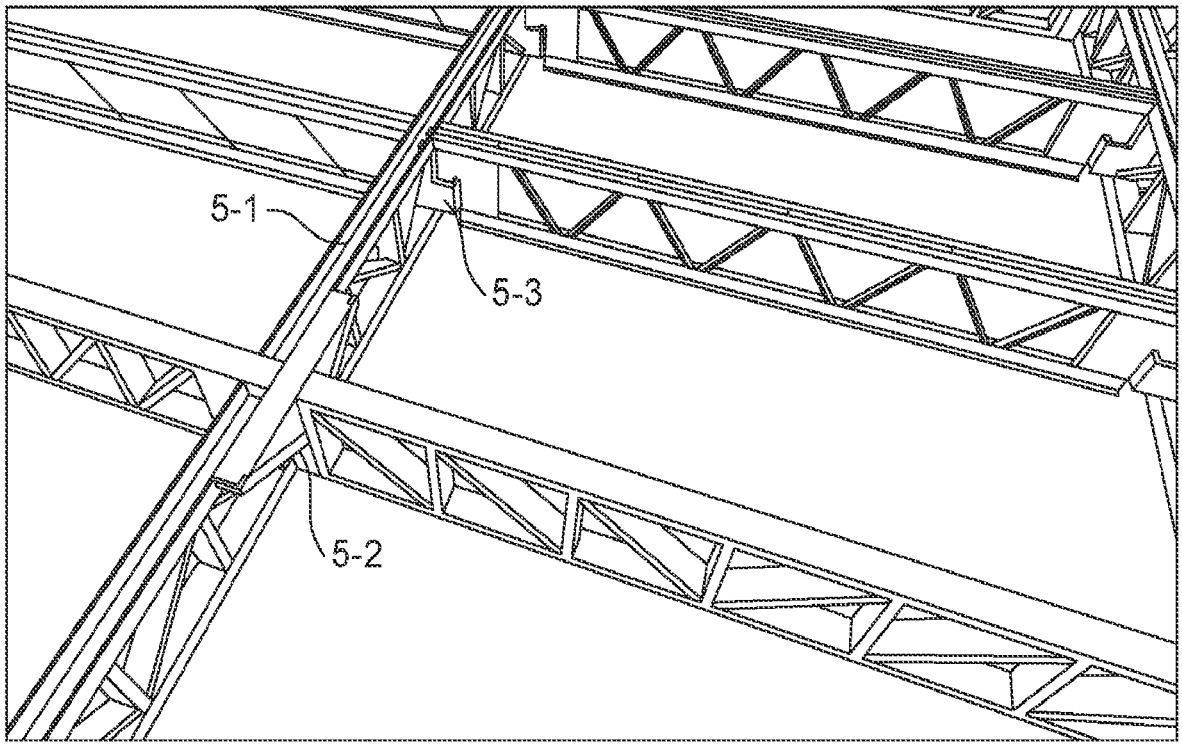
Figure 5H:
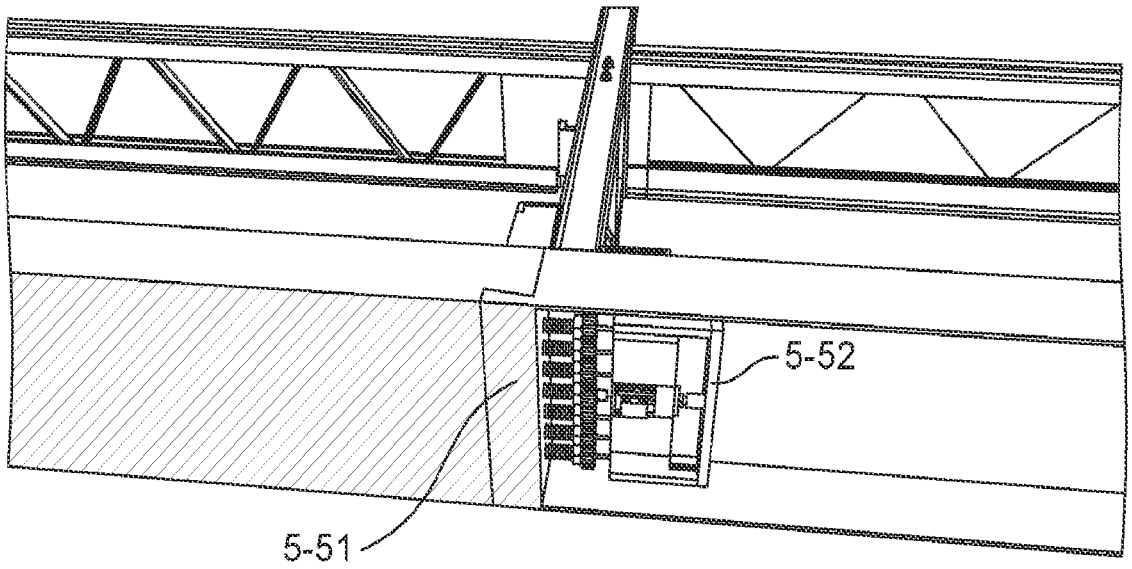
Figure 5I:
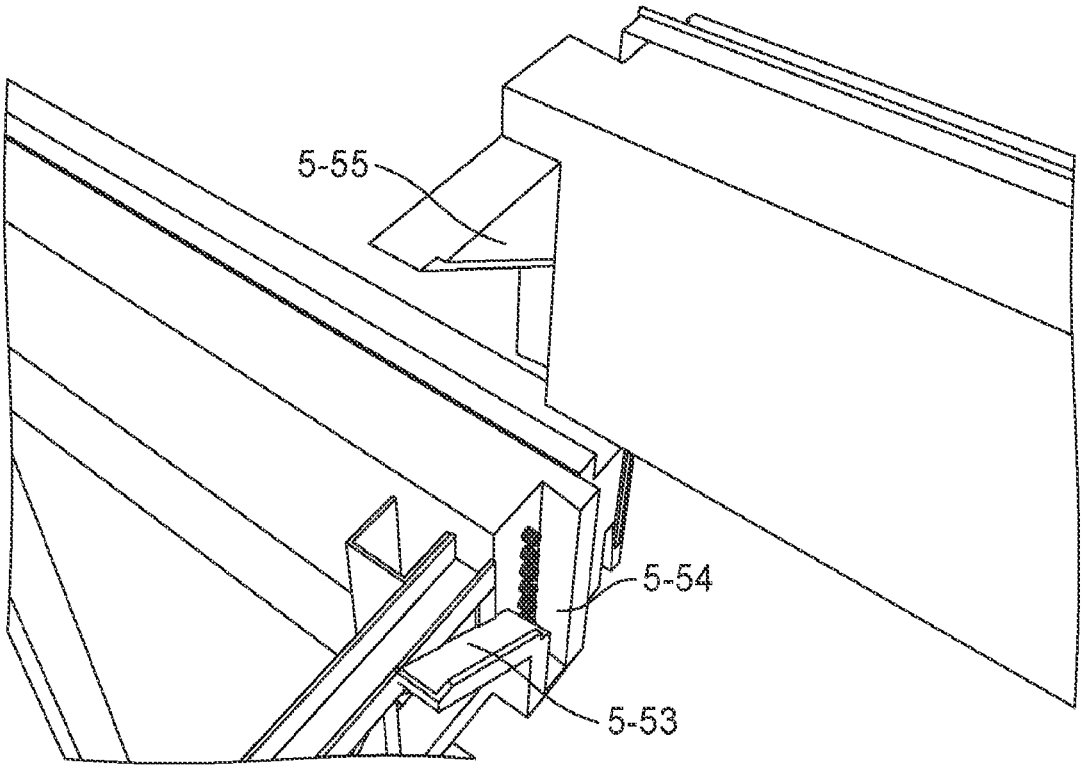
Figure 5J:
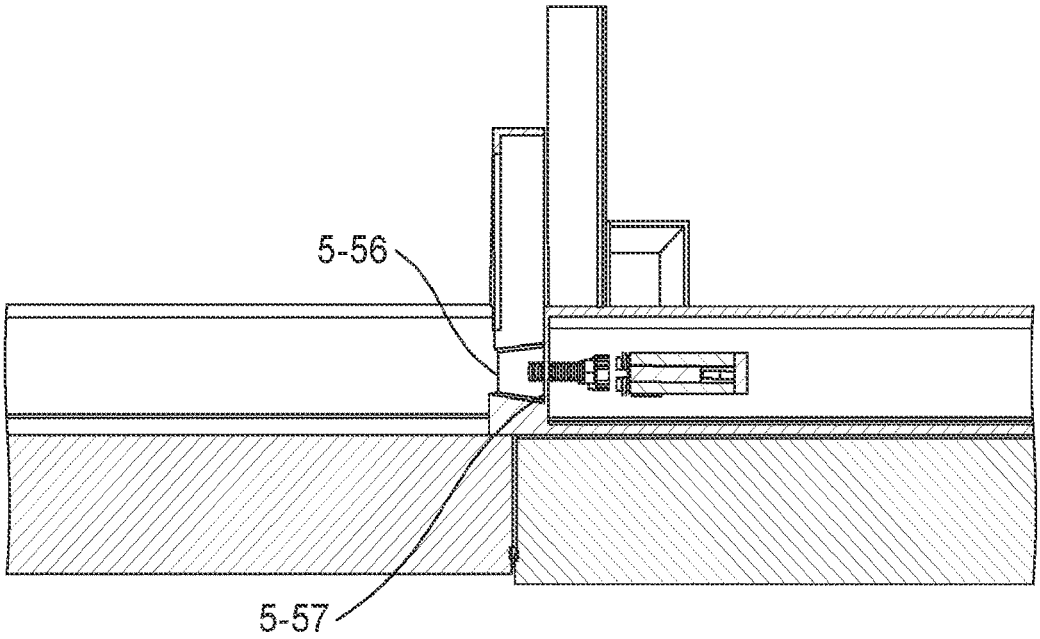

The present invention features different fasteners between structural floor slabs to stabilize the structure. FIGS. 5A to 5G illustrate embodiments of the fasteners. Large Y-shaped buckle slots and regular fasteners on beams: The long edge beam (5-1) of the intermediate floor slab is designed with multiple large Y-shaped buckle slots (5-2) and regular fasteners (5-3) on its edge, protruding 1-6 inches, facilitating the engagement of buckle heads (FIG. 5A). Regular fasteners on the middle beam edges include buckle slots (5-31) with beveled openings (5-32) to allow the floor slab to be placed smoothly (FIG. 5B). Large Y-shaped buckle slot design; The large Y-shaped buckle slots are located on the beam edges (FIG. 5C). The opening of the large Y-shaped slot is made as wide as possible, with long beveled edges (5-22) and buckle slots (5-21). The upper edge of the long beveled edge comprises a protrusion (5-23) to prevent the buckle head from sliding out when placed within. The purpose of the large Y-shaped slot is to provide necessary lateral wiggle room for the floor slab during placement, making it easier for the buckle head to slide into and lock into the slot (5-21). The large Y-shaped buckle slots are 0.01-1 inch higher than adjacent regular fasteners. The lower section of the large Y-shaped slots is designed to be narrower at the front (5-211) and wider at the back (5-212), forming a dovetail shape to prevent the buckle head of the floor slab from sliding out (FIG. 5D). The corresponding surface of the buckle head includes a slot (5-24) (shown in FIG. 5C), and the vertical movement of the floor slab is restricted by a spring clip. Regular fasteners feature straight edges (5-33) and beveled edges (5-34) designed to correspond to the buckle head (5-4). The straight edge resists lateral forces, while the beveled edge facilitates insertion (FIG. 5E). Precise fit of the buckle head and buckle slot: As shown in FIG. 5F, the buckle head is designed with beveled edges (5-42) for easy insertion and right-angle edges (5-41) to restrict lateral movement once engaged. The coordinated interaction between the buckle head and the internal design of two types of buckle slot enables the floor slabs to pull each other tightly using their own weight, ensuring stability after installation (FIG. 5G). FIG. 5H shows that half of the edge structural beam is a dovetail shaped connection (5-51) and paired with a fastening device (5-52) to secure and reinforce the connection of the edge structural beams. FIG. 5I illustrates the internal part of the structural beam is a half-Y beveled interface (5-53) extending to the dovetail buckle slot (5-54) on the edge structural beam for connecting to the dovetail buckle (5-55) of the intermediate floor slab. FIG. 5J shows that the dovetail structure maintains a narrower rear section (5-56) and a wider front section (5-57) to prevent the connection points from disengaging.

Figure 6A:
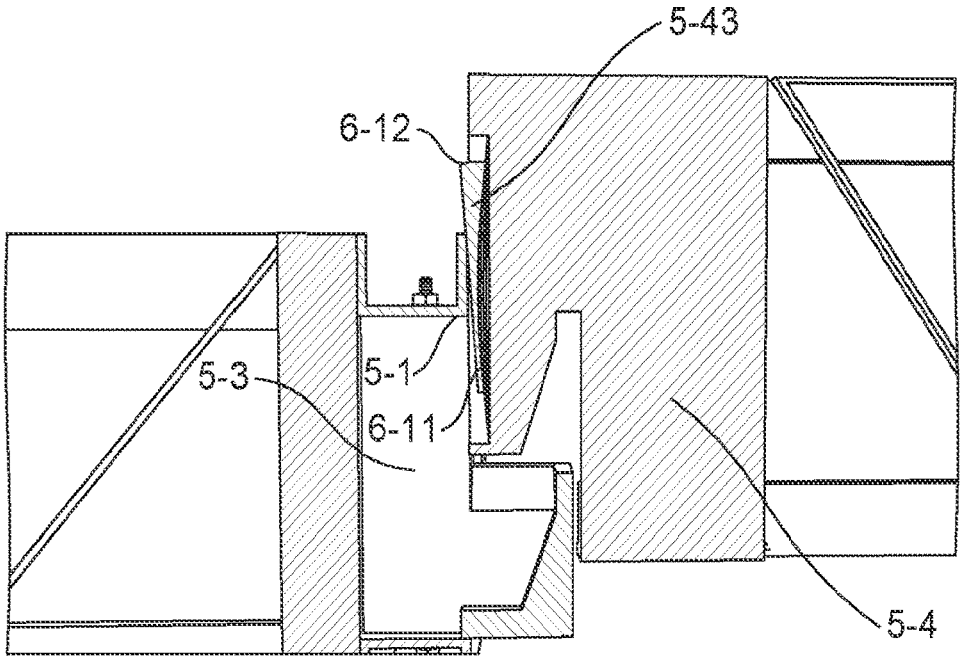
FIGS. 6A and 6B show the application of spring clips in an embodiment of the present invention.
Figure 6B:
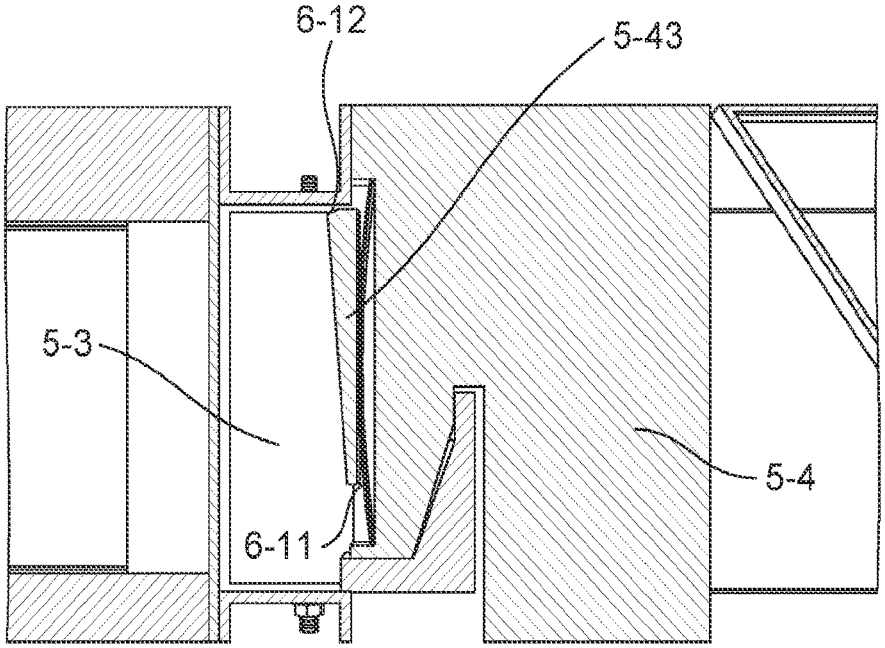

FIGS. 6A to 6B illustrate the application of the spring clip in an embodiment of the present invention. In FIG. 6A, the buckle head is designed with a spring clip (5-43) containing a spring piece (6-11). When the floor slab is pressed down, the spring piece compresses inward. Upon reaching the designated position, the spring piece expands outward to engage with the spring clip slot (5-1) on the long edge beam (FIG. 6B), preventing upward movement. The buckle head features a beveled design (6-12) to facilitate smoother insertion.

Figure 7A:
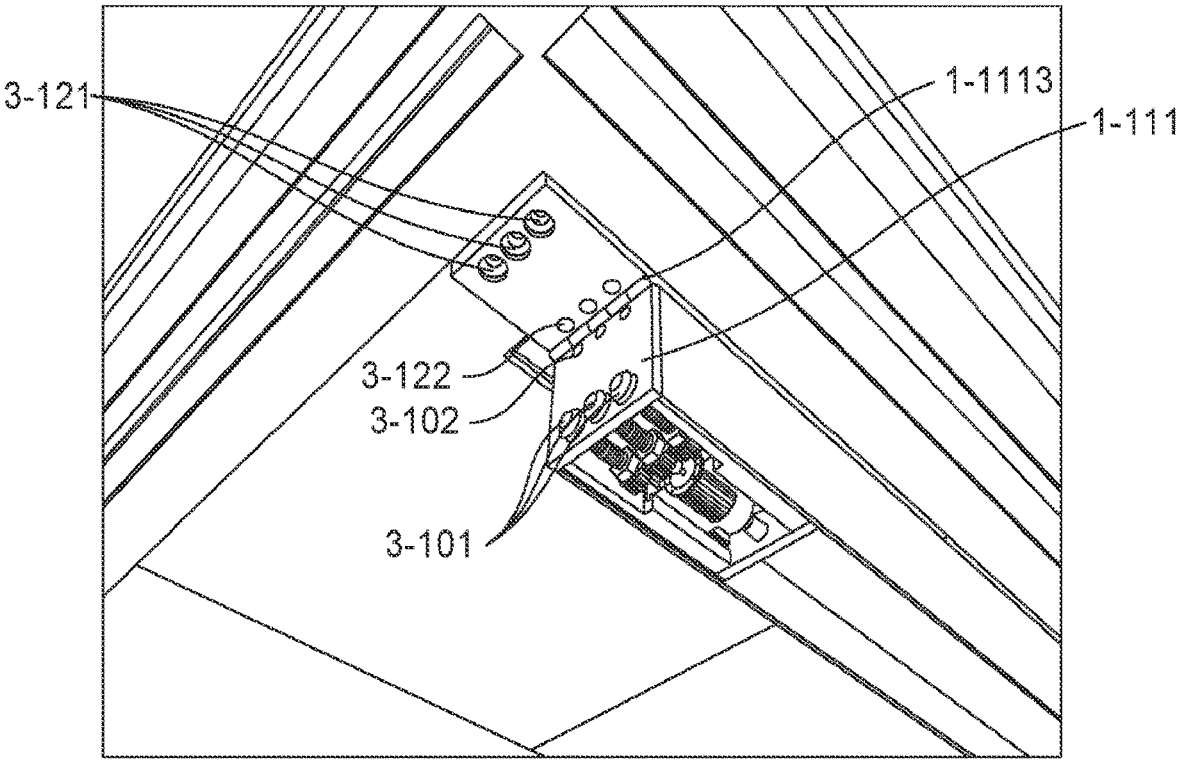
FIG. 7A illustrates the design of the movable connection end in an embodiment of this invention, an innovative feature ensuring quick and accurate installation of the column.
Figure 7B:
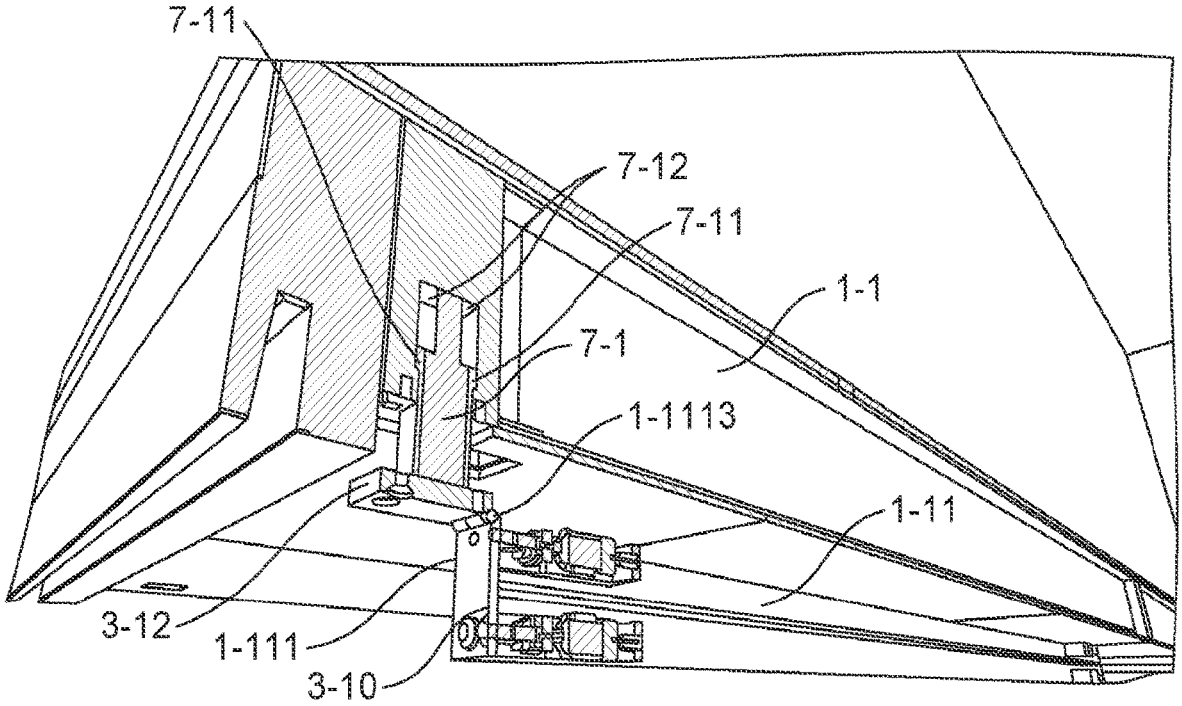
FIG. 7B further illustrates the column cap design in this embodiment.
Figure 8:
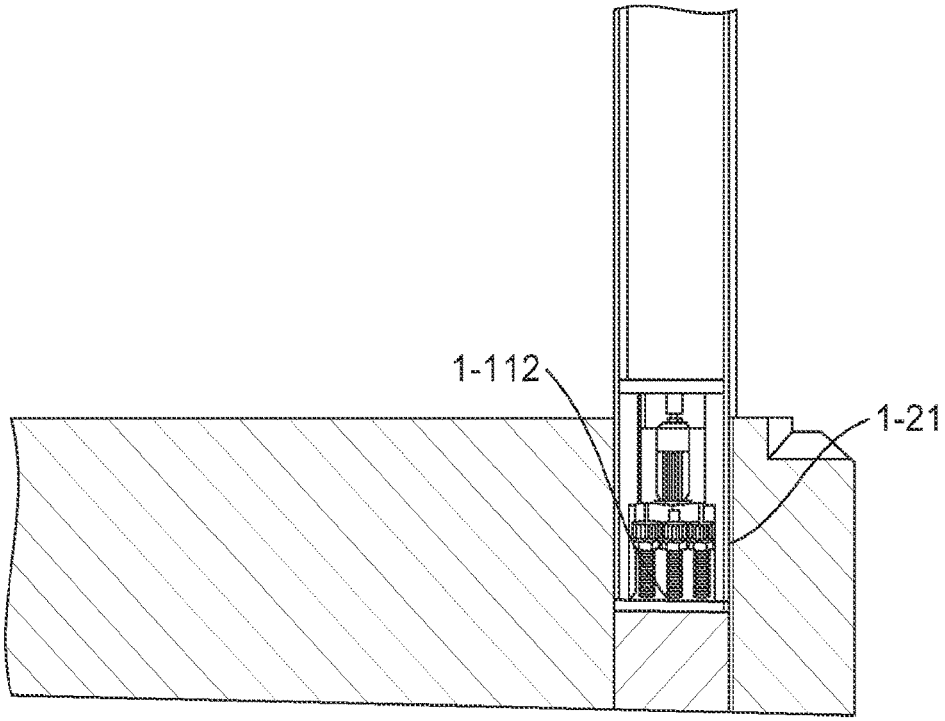
FIG. 8 shows that the base of each column is configured with a dedicated column slot (1-21).

FIGS. 7A to 7B illustrate the movable connection end in an embodiment of the present invention which comprises hinges,. The movable connection end (1-111) of the column comprises a hinge at one of its sides forming a hinged side (1-1113). One or more of the non-hinged sides features a concave (3-121) and convex (3-101) design, which assists in positioning and restricts movement when the column is raised to an upright position. The hinged side (1-1113) comprises regular holes (3-122, 3-102). This innovative design allows the column to be easily folded and unfolded while providing precise guidance during installation, ensuring the column can be quickly and accurately positioned. Column cap design: The column cap comprises a first plate (3-12) where the jack is fixed, a second plate (3-10) where the column is fixed, the outer casing of the jack (7-1) and its connection point with the floor slab which employ a nesting structure combined with the bottleneck principle (7-11) to provide mutual tension pulling each other. This design prevents the movable connection end of the column with the hinge (1-111) from detaching when the second-floor slab is lifted. The nesting structure offers an internal adjustable space (7-12) to allow movement (FIG. 7B). In one embodiment, the internal adjustable space is 1-12 inches. Column slot positioning: Each column base is configured for a dedicated column slot (1-21) (FIG. 8), enabling the free end (1-112) of the column to fit securely into the column slot (1-21).

Example 2

Building Assembly

The prefabricated building structure of the present invention serves as a fundamental component for constructing buildings. A building assembled according to the present invention generally comprises at least two prefabricated building structures, and partition components; wherein said upper floor slabs and said lower floor slabs of said at least two prefabricated building structures are connected at connections to form a single floor; and said partition components divide said single floor into different spaces. In one embodiment, said connections comprise one or more connecting floor slabs which corresponds to number of said upper floor slabs and said lower floor slabs.

In one embodiment, said upper floor slab comprises a downward pressing interlock structure, wherein said downward pressing interlock structure is connected to a receiving structure on said partition components, such that said downward pressing interlock structure interacts with said receiving structure to lock said partition components in place and prevent displacement. Said interaction between said downward pressing interlock structure and said receiving structure can be initiated by any method capable of raising said upper floor slab to create a space for placing said partition components, and then lowers said upper floor slab to lock said partition components in place. Examples of such methods include but not limited to screw jacks, cranes, pneumatic rods, and hydraulic jacks.

Figure 9A:
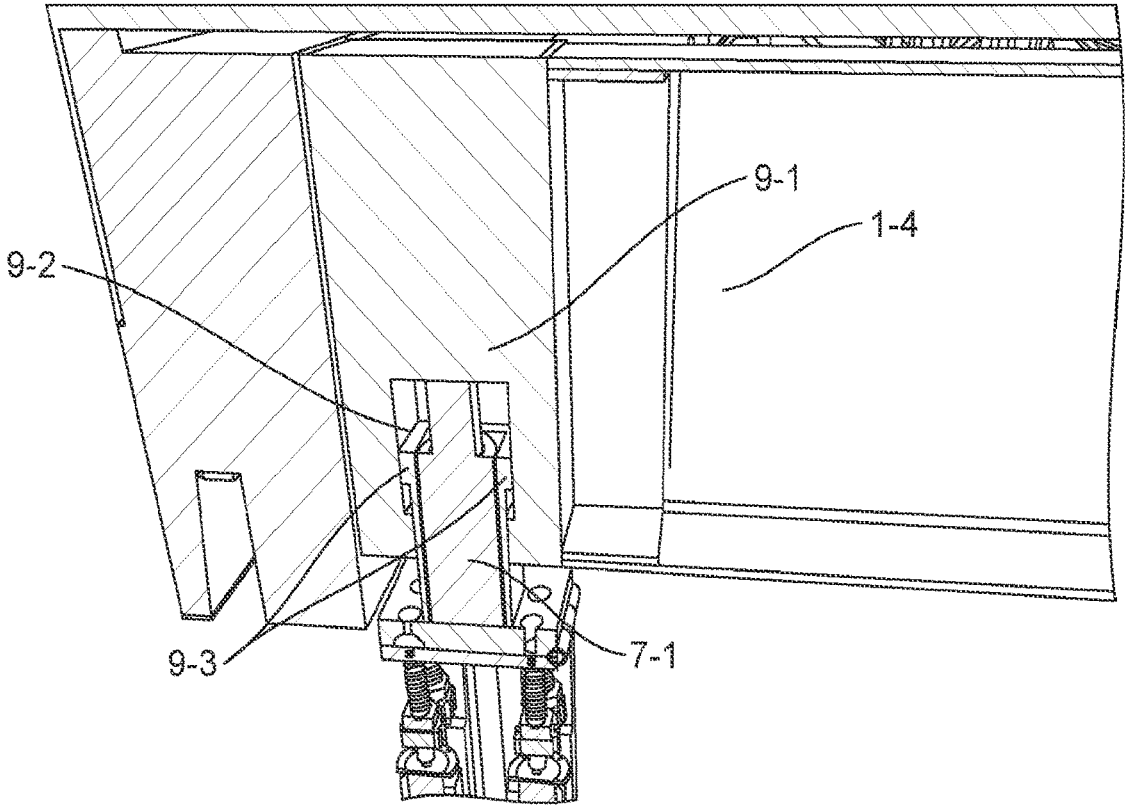
FIG. 9A is a schematic diagram of the jack described in an embodiment of the present invention.
Figure 9B:
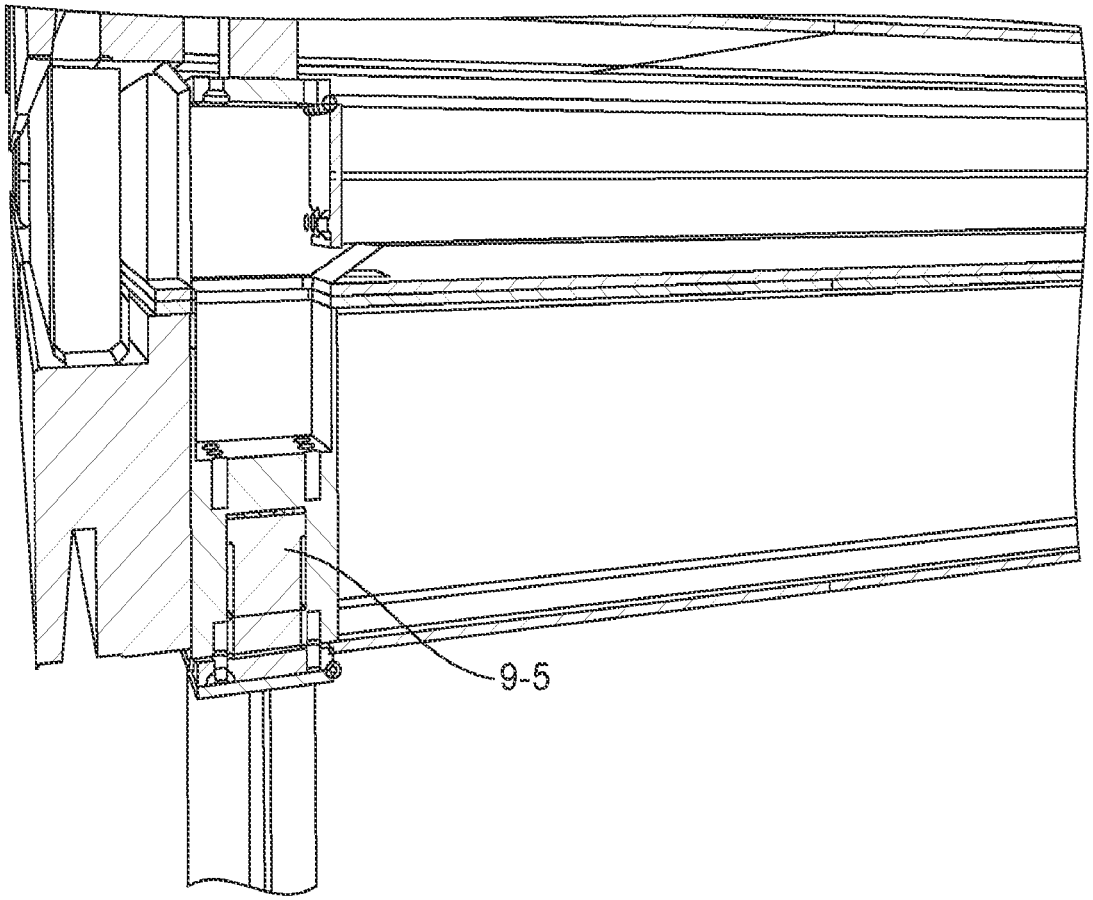
FIG. 9B further illustrates said jack in its closed state.

FIGS. 9A and 9B illustrate an embodiment of the present invention, wherein the building comprises a jack (7-1) for raising said upper floor slab (1-4) to create a space for inserting said partition components. In one embodiment, said jack is positioned within a lifting space above said movable connection end, wherein said lifting space comprises an outer sleeve (9-1) positioned on said upper floor slab and an inner sleeve (9-2) connected to said at least one column. The inner and outer sleeves are secured by a clip (9-3) to prevent detachment. Said outer sleeve encircles said inner sleeve, constraining the movement of said jack within the trajectory of said outer sleeve when raising said upper floor slab from within the inner sleeve, thereby stabilizing said upper floor slab. FIG. 9B further illustrates the closed state of the jack (9-5).

Figure 10A:
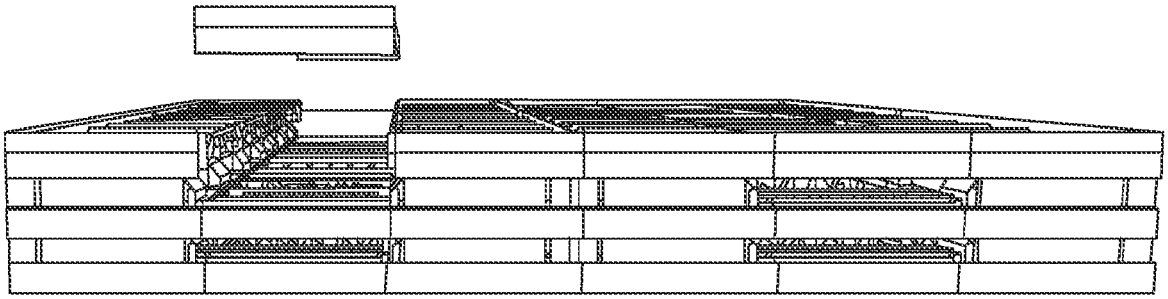
FIG. 10A illustrates the modular structure and assembly method in an embodiment of a building constructed with the present invention.
Figure 10B:
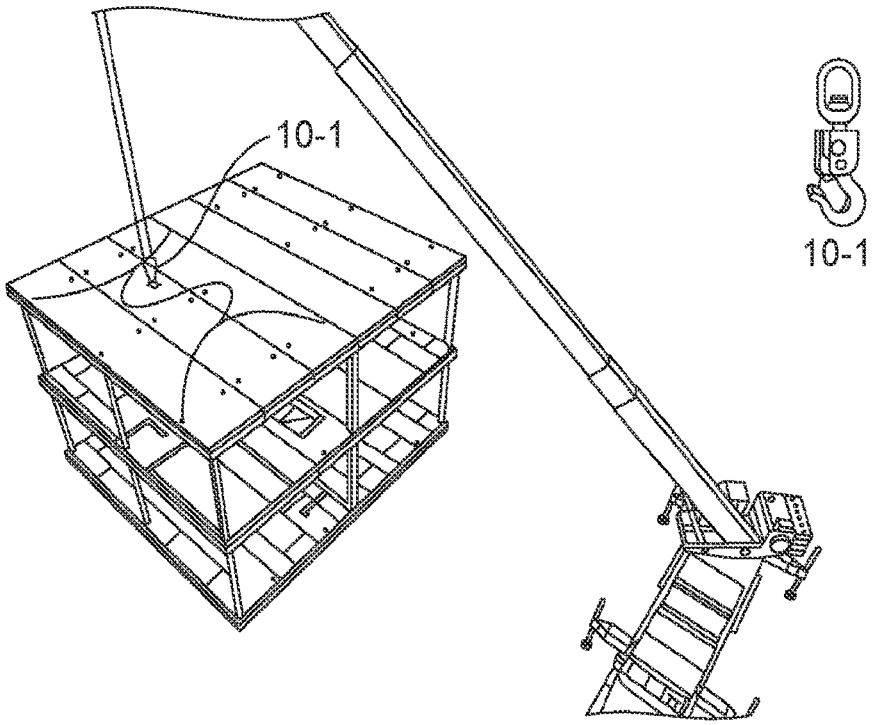
FIG. 10B shows the operation of automatically releasing the hook after a floor slab is lifted into place in an embodiment of this invention.

FIGS. 10A and 10B illustrate an embodiment of a building assembled according to the present invention, demonstrating the modular structure and assembly method of the invention. Sequential Installation of Structural Floor Slabs (FIG. 10A): Conventional installation methods involve lifting individual floor slabs one at a time. In contrast, the present invention connects multiple layers of floor slabs, e.g. three floor slabs, together at the factory, allowing them to be lifted and installed simultaneously. This approach increases the lifting speed by three times or more Advantages of the Invention: Safe and Efficient Lifting Operations: Conventional lifting operations require construction workers to perform high-risk tasks at elevated heights. After each slab is lifted and installed, workers must climb onto the floor slab to manually detach the hooks in preparation for the next lift. This process is not only inefficient but also fraught with safety hazards. In contrast, the present invention centralizes all lifting hook attachment and detachment tasks at a relatively safe height. This eliminates the need for dangerous work at elevated heights, significantly improving safety and convenience during construction. Additionally, by pre-assembling portions of the floor slabs at the factory, the number of on-site lifting operations is reduced, further increasing installation speed and efficiency. The method of lifting multiple pre-assembled floor slabs in a single operation significantly reduces construction risks while drastically shortening the construction timeline. As shown in FIG. 10B, a remote-controlled electric switch hook (10-1) allows slabs to be lifted and automatically detached from hooks specially designed on the roof level slab. All these operations are completed within a safe working height, greatly reducing operational risks, significantly lowering labor costs, and optimizing the safety, convenience, and cost-effectiveness of the construction process.

Figure 11:
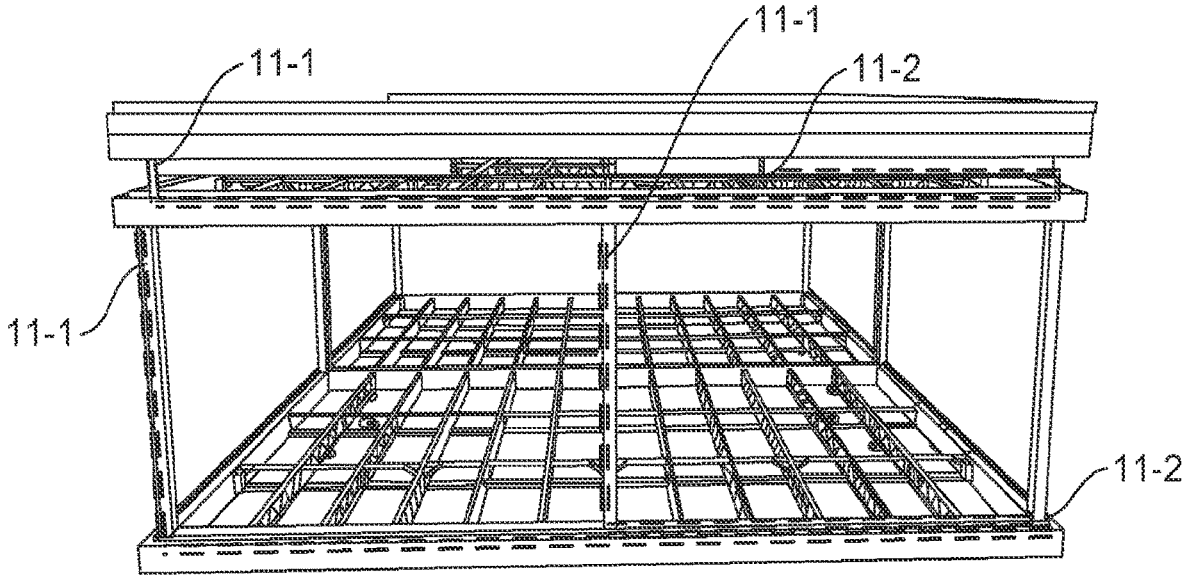
FIG. 11 illustrates the column positioning and automatic adjustment methodology in an embodiment of the present invention.

FIG. 11 illustrates an embodiment of the column positioning and automatic adjustment methodology of the present invention: At both ends of the long edge of the floor slab, ropes connecting two columns pass through the beam and are linked together to ensure the accurate positioning of the columns. On one side, the rope is attached to the upper floor slab, at the location where the column is connected to (column positioning rope 11-1). The rope passes through the beam to the other side, where it is connected to the base of another column (column positioning rope 11-2). Since the total length of the rope is fixed, when the floor slab is lifted, the rope pulls the columns and the floor slab together. As the floor slab lifts the rope, the columns are gradually pulled upright, and the tension in the rope ensures the columns approach or achieve a vertical position. This process allows the columns to automatically move into the precise positions with little or no manual intervention. Without the assistance of the ropes for positioning, each column would require workers to manually align it into place. This process would not only be cumbersome but would also significantly increase labor costs. Additionally, the heavy weight of the floor slabs poses safety risks during manual handling, especially for slabs above the second floor, which are too high for workers to operate effectively. The innovative method in the present invention easily addresses these challenges.

When the columns are accurately positioned in the column slots, multiple jacks working concertedly are used to lift the entire floor slab, creating a space for the installation of interior walls and exterior walls, and when the floor slab is lowered, it provides force to support various other components: i. The closing and supporting of the upper and lower sections of the interior walls, as well as the sockets within the interior walls and its positioning functionality, require the lifting of the floor slab (to create space) and its subsequent lowering (to provide force by the weight of the floor slab). ii. For the upper structure of the exterior walls to slide, the floor slab must be lifted to create sliding space. iii. The edge sealing strips of the exterior and interior walls are activated by the force exerted by the descending floor slab, which pushes the sealing rods into position. iv. MEP (Mechanical, Electrical, and Plumbing) related systems, such as drainage pipes, exhaust pipes, and socket connections require the floor slab to be lowered to ensure a tight fit and proper functionality.

Figure 12:
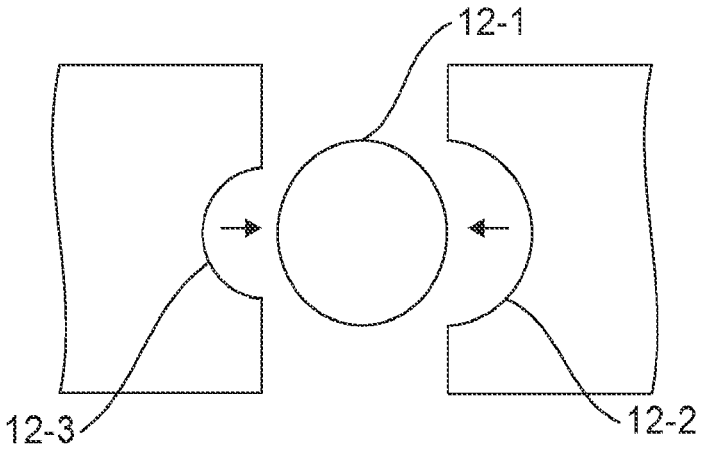
FIG. 12 illustrates an embodiment of this invention to provide sound proofing and water proofing between floor slabs.

FIG. 12 illustrates an embodiment of the waterproof design between floor slabs in the present invention: To provide sound insulation and prevent water leakage between floor slabs, a cylindrical rubber strip (12-1) is configured along a larger semi-circular edge (12-2). The semi-circular edge (12-2) for fixing the strip is larger than the semi-circular edge (12-3) on the other side. When the floor slab is pressed down, the cylindrical rubber strip (12-1) deforms and compresses into the smaller semi-circular edge (12-3), creating a water-tight seal.

Figure 13A:
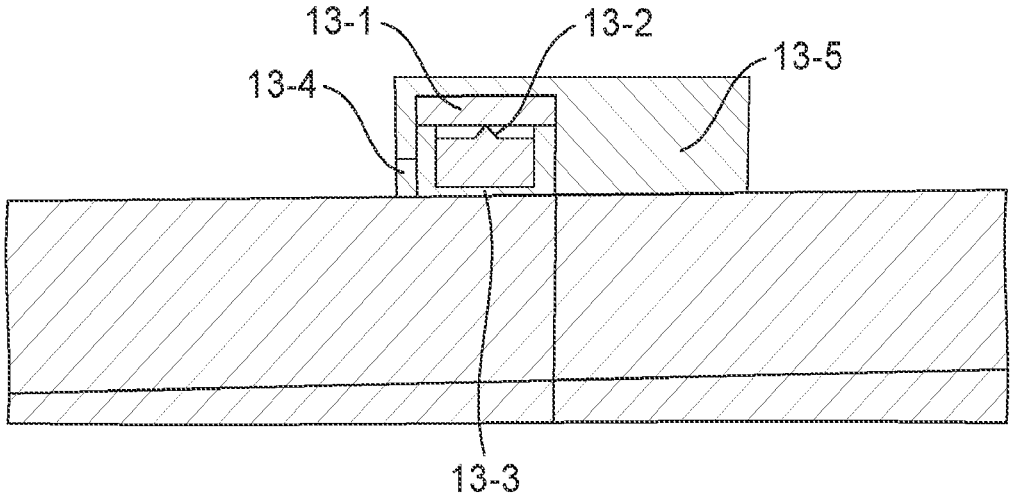
FIGS. 13A and 13B show the waterproof structure of the roof level slab in an embodiment of the present invention.
Figure 13B:
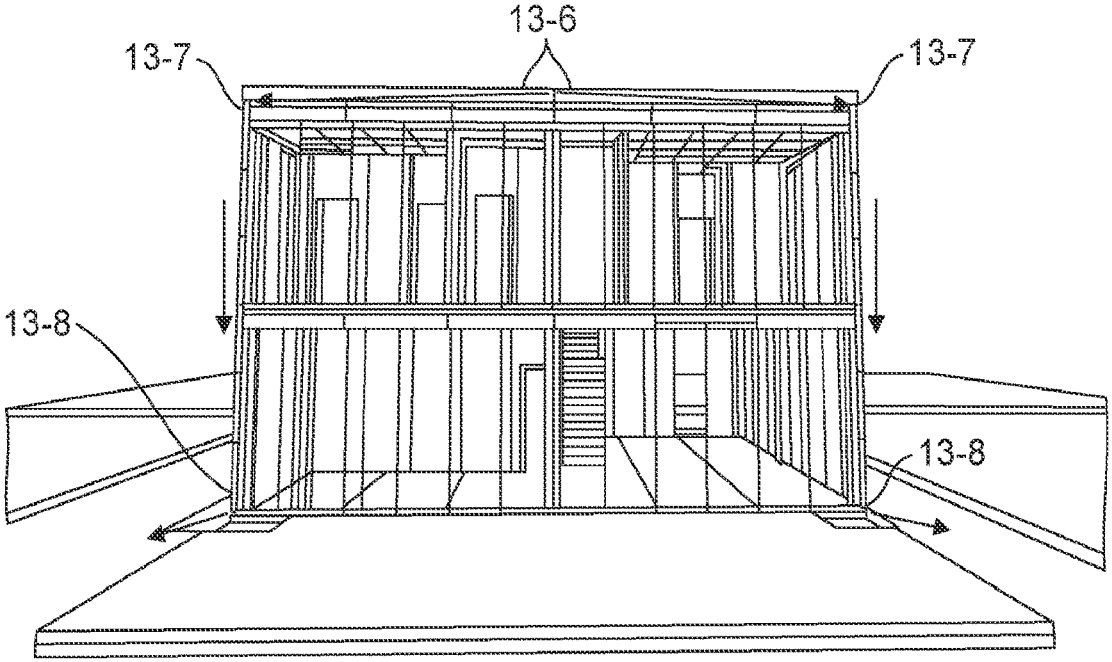

FIGS. 13A and 13B illustrate an embodiment of the waterproof design for roof level slabs in the present invention: For the two roof level slabs, the left slab comprises a protruding component (13-3) with triangular waterproofing protrusions (13-2). The right slab has a hook-shaped component (13-5) with a hook head (13-4) that locks automatically during floor slab installation. These features create an effective waterproof barrier at the connection points between the slabs. When the slabs are secured, the waterproof rubber strip (13-1) is compressed, preventing water from entering and forming an integrated physical water-tight seal. The roof level slabs may have a slight slope designed to automatically pitch rainwater toward designated drainage points, effectively preventing water accumulation and leakage. In one embodiment, the slight slope is 0.5%-2%. This ensures long-term dryness of the roof and comfort within the building. As shown in FIG. 13B, two roof drainage channels are positioned at the back of the house (13-7). Water on the roof is divided at the central point (13-6) and directed by the slight slope towards both sides (13-7), where the water is channeled downwards to the ground-level via drainage down spouts (13-8).

In one embodiment, said prefabricated building structure further comprises exterior wall slide rails fixed to the edges of said upper floor slab or said lower floor slab; said partition components comprise exterior walls; said exterior wall slide rails are adapted to guide said exterior walls. In another embodiment, said upper floor slab comprises exterior wall locking devices for interlocking with exterior wall locking devices at a top part of said exterior wall.

Figure 14:
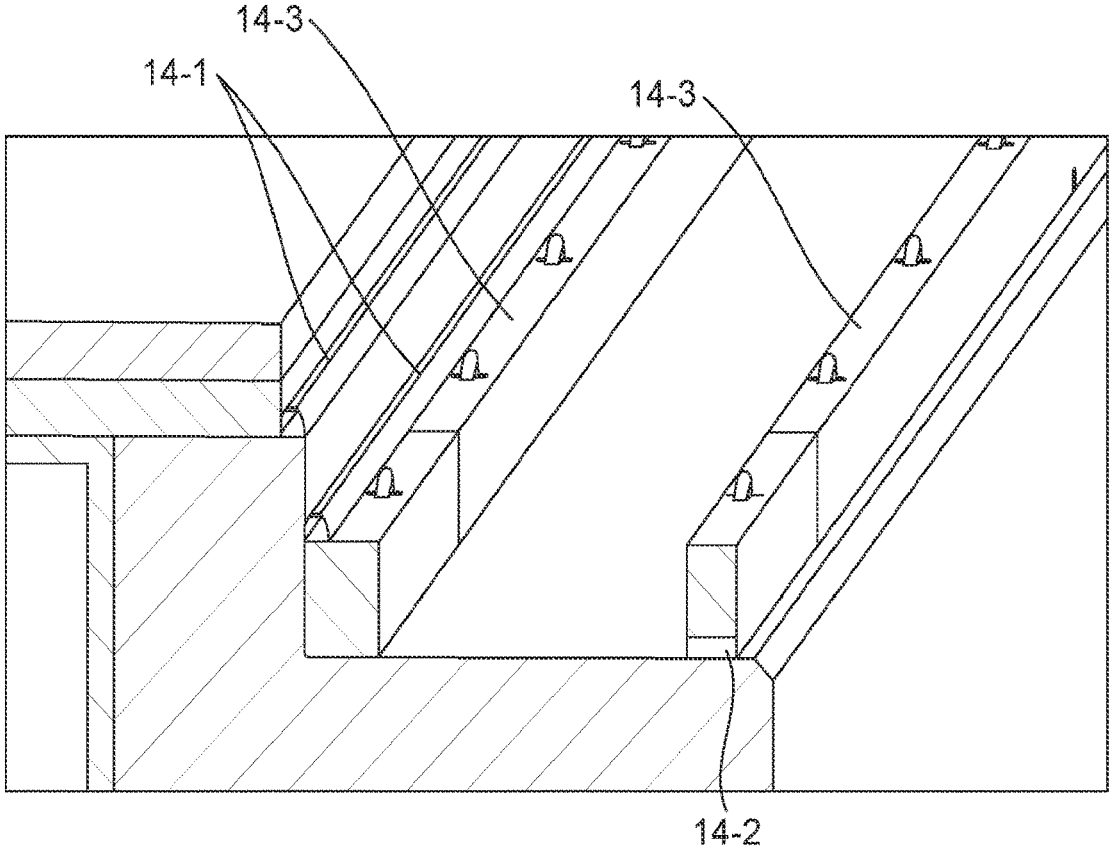
FIG. 14 demonstrates the base design of the modular exterior wall along with the sliding mechanism in the present invention.

FIG. 14 illustrates an embodiment of the modular exterior wall provided by the present invention comprising a sliding mechanism for the exterior wall base. The wall base is configured with wheels (14-3) on both sides to simplify the installation process of the exterior wall by sliding. On the interior-facing side, two stepped rubber strips (14-1) provide waterproofing, wind proofing, and soundproofing functions, with the dual strips offering enhanced protection. Additionally, a drainage channel (14-2) is designed at the bottom to prevent water accumulation.

Figure 15:
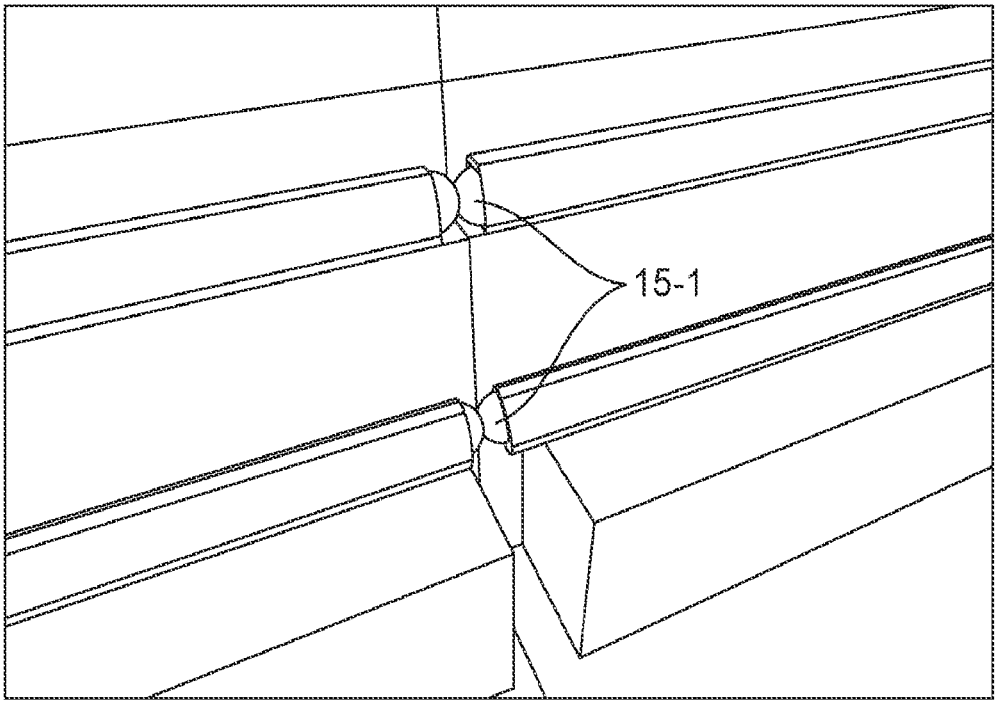
FIG. 15 illustrates the spherical shaped joints at the end of the rubber strips for the floor slab connections in an embodiment of this invention.

FIG. 15 illustrates an embodiment designed to ensure the continuity of the rubber strips between each floor slab. The ends where the rubber strips contact are spherical shaped (15-1). When the exterior wall is pressed down, the spherical ends on both sides protrude and compress against each other.

Figure 16:
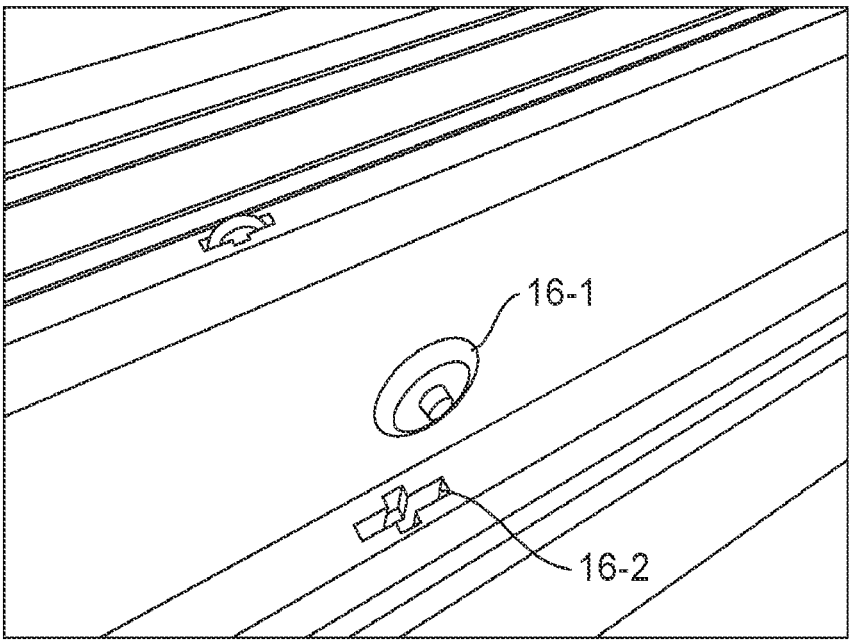
FIG. 16 shows the wheel design in the sliding mechanism, where the wheels are directly secured into the wheel slots.

FIG. 16 illustrates an embodiment where the wheel (16-1) is designed to directly snap into the wheel slot (16-2).

Figure 17:
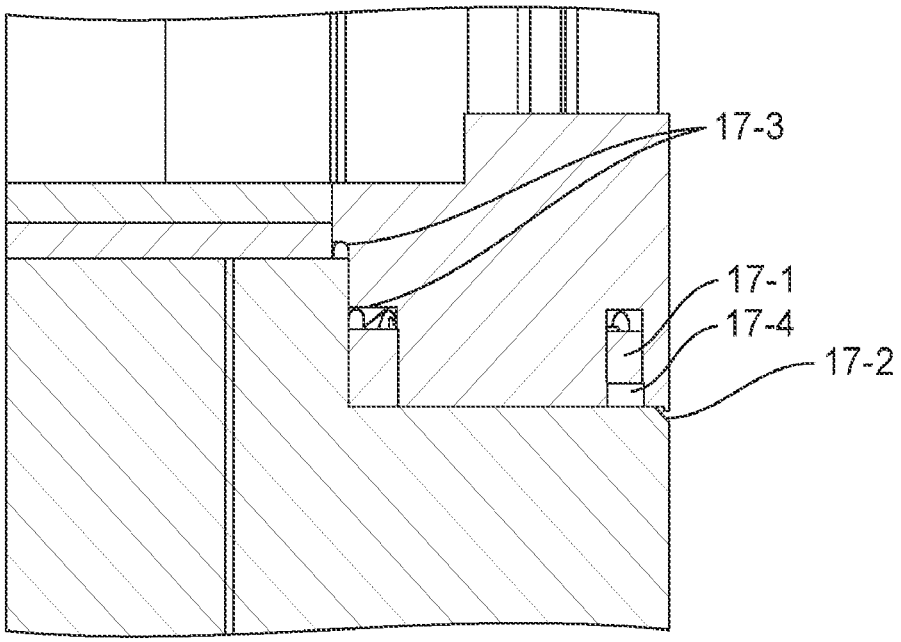
FIG. 17 shows the design of slots in the base structure of the exterior wall in an embodiment of this invention.

FIG. 17 illustrates an embodiment where the structural slot (17-1) is used to restrict the inward and outward movement of the exterior wall panel. The outer side comprises a sloped waterproof design (17-2) and a stepped design (17-3). When the floor slab is pressed down, it provides a force compressing the rubber strip, achieving physical wind proofing, waterproofing, and soundproofing. Even if water enters, it is drained through the bottom drainage channel (17-4).

Figure 18:
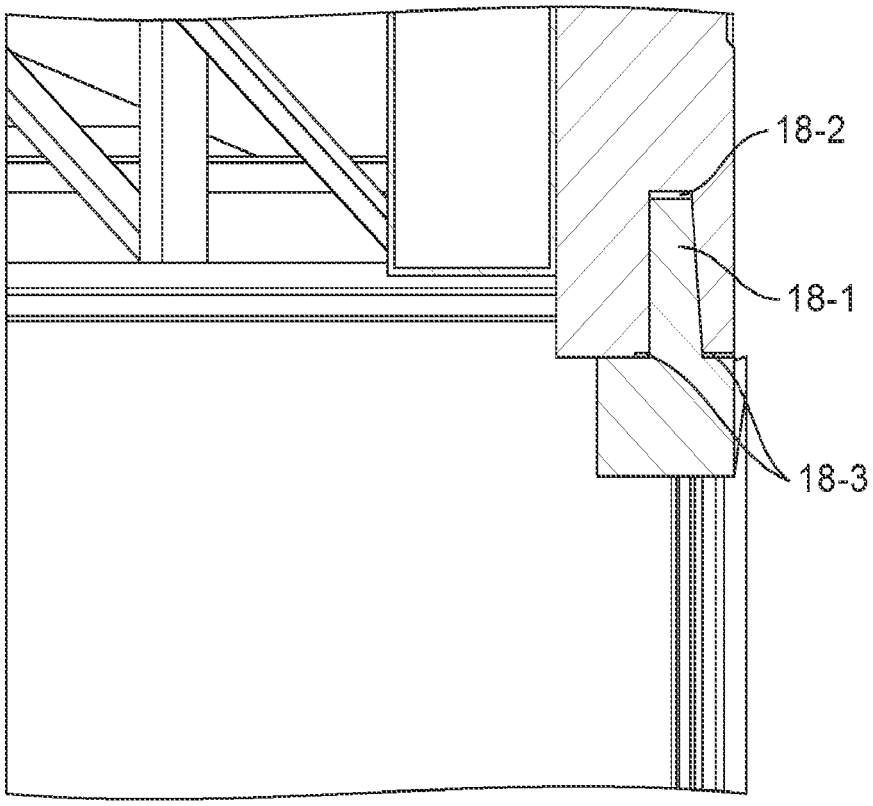
FIG. 18 shows the trapezoidal structure design of the top of the exterior wall.

FIG. 18 illustrates an embodiment where the top of the exterior wall features a trapezoidal structure (18-1), facilitating the insertion and movement of the exterior wall. On the top of the contact point between the floor slab and the exterior wall panel, there is a semi-circular sealing rubber strip (18-2), while the bottom of the floor slab has a sealing strip (18-3). When the floor slab is pressed down, these components provide sealing, achieving waterproofing, windproofing, and thermal insulation functions.

Figure 19:
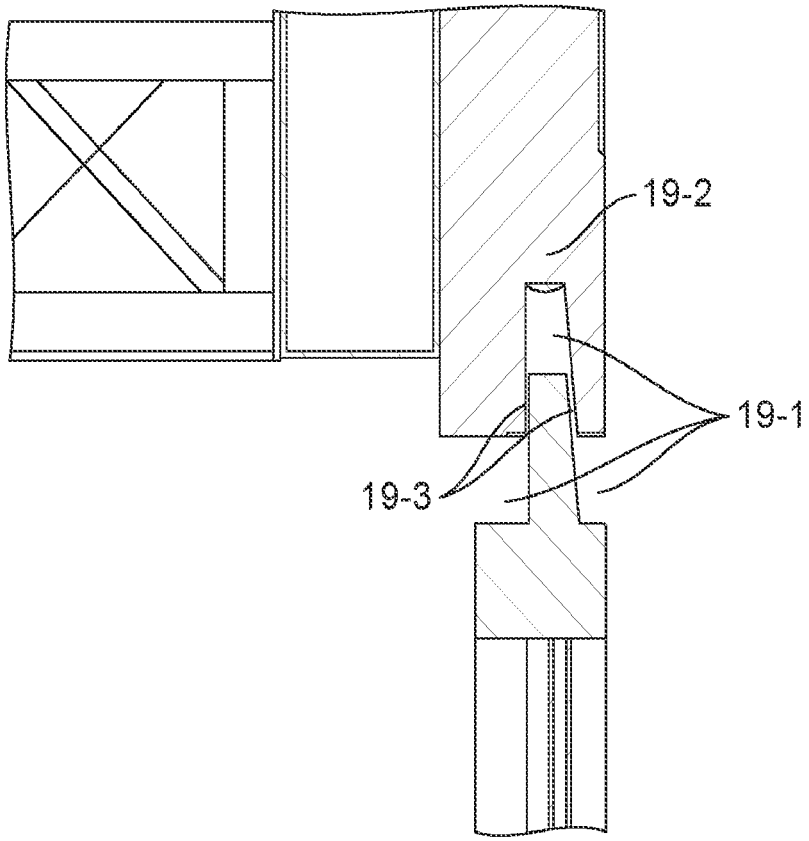
FIG. 19 illustrates the structural connection of the exterior wall top when the floor slab is lifted by a jack in an embodiment of this invention.

FIG. 19 illustrates an embodiment where, when the upper floor slab (19-2) is lifted by a jack, a gap (19-1) is created between the exterior wall panel and the upper floor slab. Although the two components are in a loosened state, the exterior wall panel is still constrained within the floor slab slot (19-3) without falling out. This unique design allows easier and safer sliding of the exterior wall panel. Additionally, the trapezoidal design at the top of the exterior wall panel facilitates its insertion into the gap of the floor slab.

Figure 20:
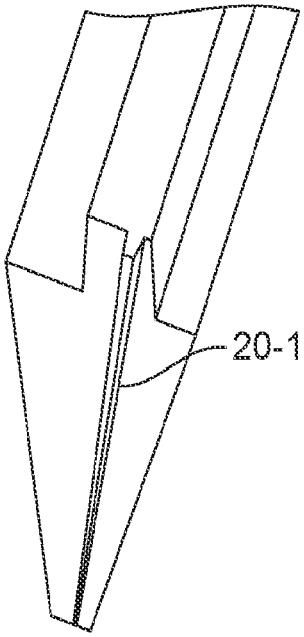
FIG. 20 illustrates the exterior wall jointing method in the present invention.
Figure 21A:
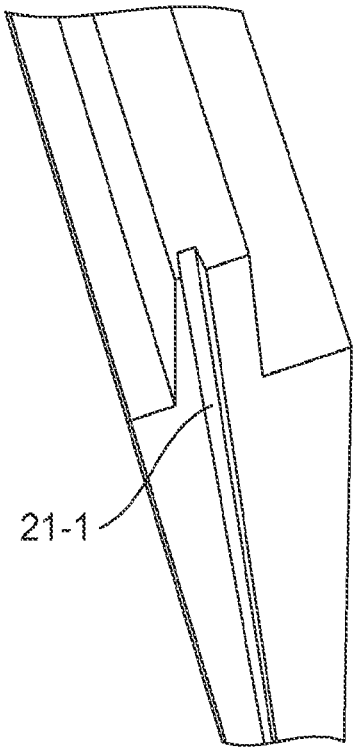
FIGS. 21A to 21C further illustrate the exterior wall jointing method, where one side is protruding trapezoidal strip and the other side is recessed trapezoidal slot.
Figure 21B:
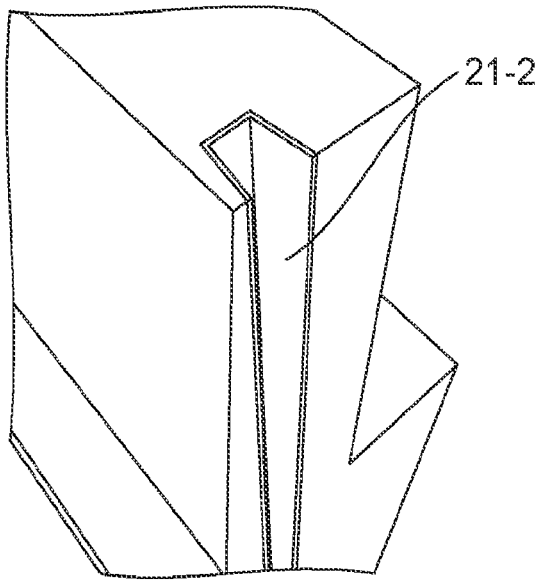
Figure 21C:
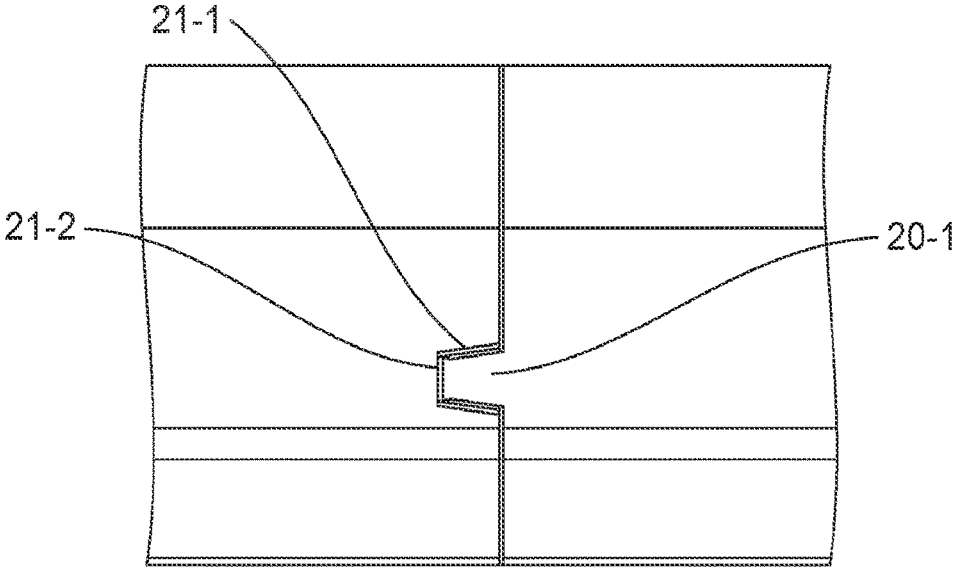

FIG. 20 and FIGS. 21A to 21C illustrate an embodiment of the exterior wall jointing method in the present invention: In FIG. 20, the jointing method involves one exterior wall panel having a trapezoidal edge (20-1), while the other panel has a recessed trapezoidal edge (21-1) as shown in FIGS. 21A to 21C. This design facilitates easy interlocking. The recessed trapezoidal edge comprises a rubber waterproof strip (21-2), which effectively provides waterproofing and wind proofing functions.

Figure 22A:
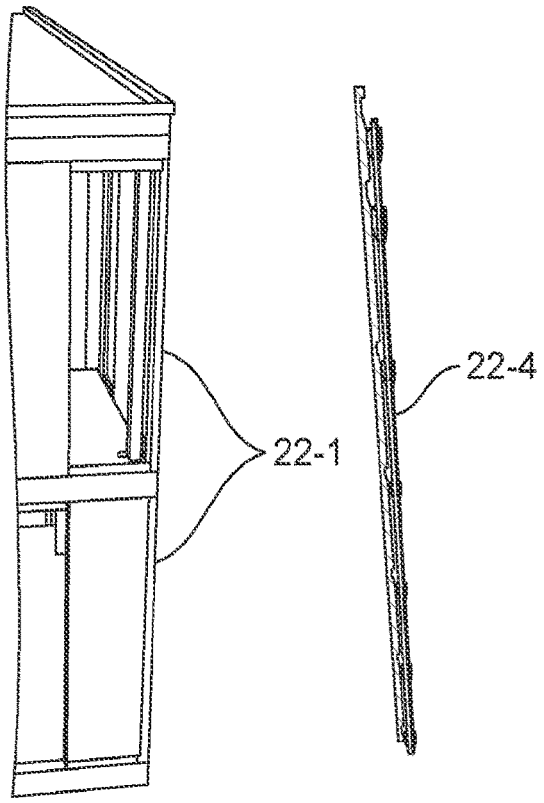
FIGS. 22A to 22E illustrate the design and operation process for corner edge trim and the long pushing rod design in an embodiment of the present invention.
Figure 22B:
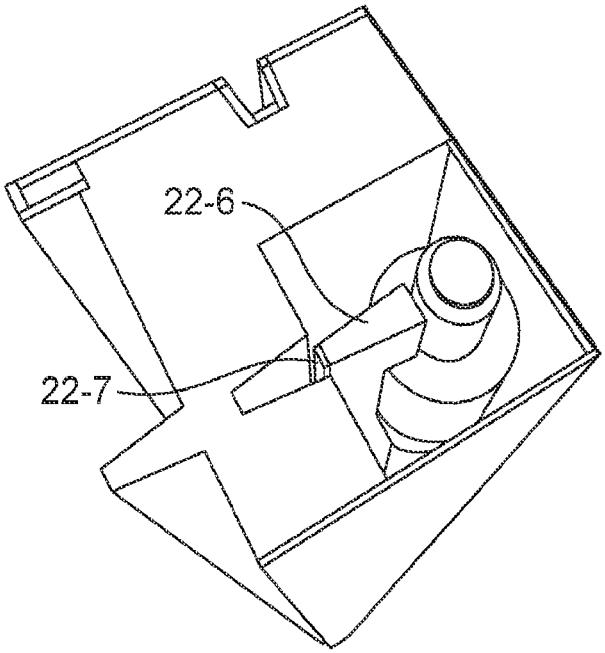
Figure 22C:
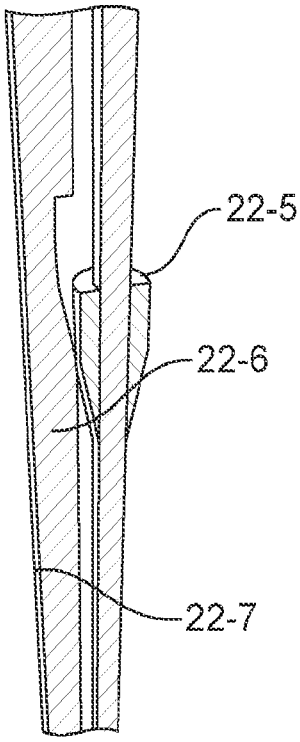
Figure 22D:
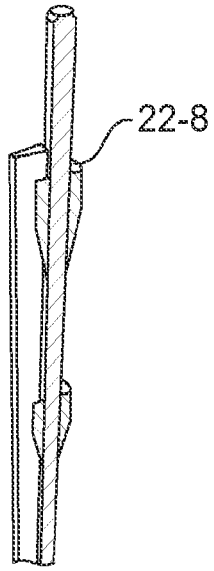
Figure 22E:
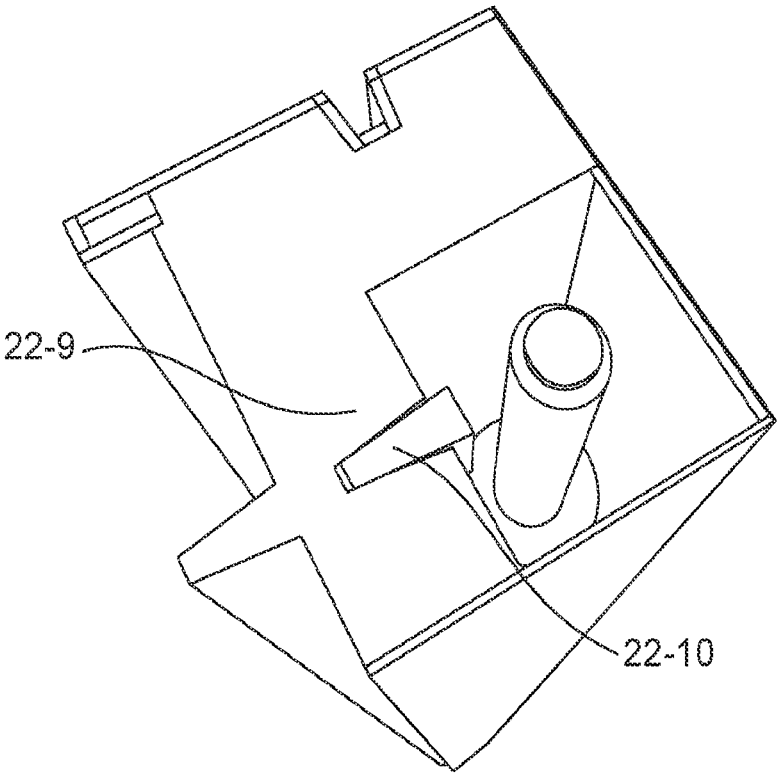
Figure 22F:
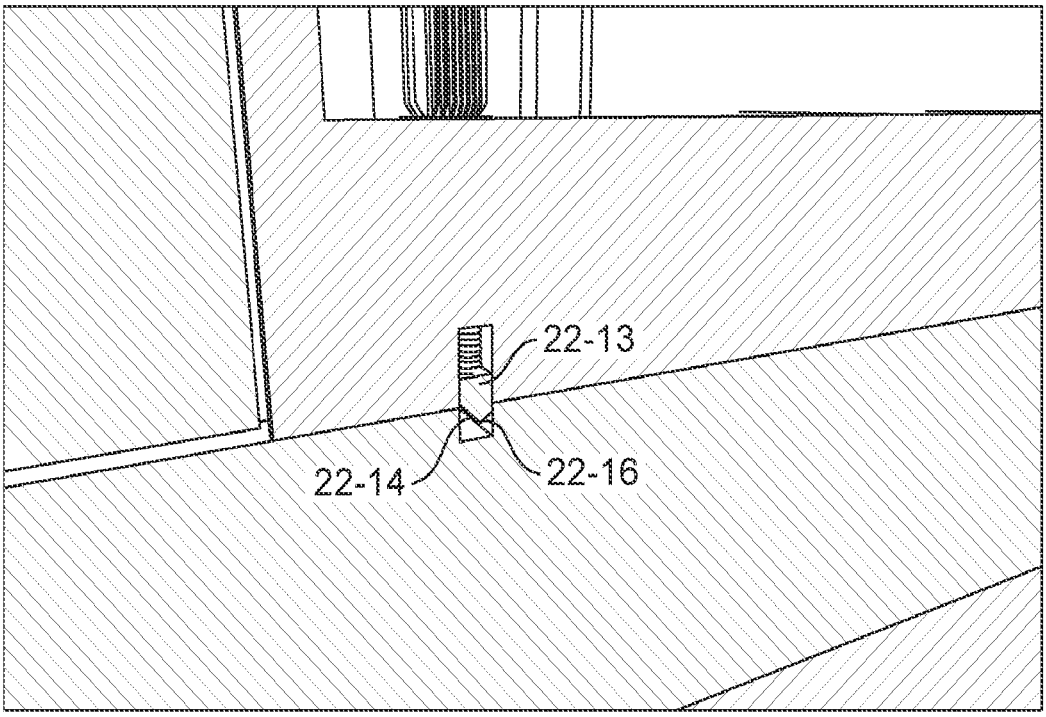
FIGS. 22F to 22G show the interlocks designed to prevent the exterior wall from moving in the reverse direction.
Figure 22G:
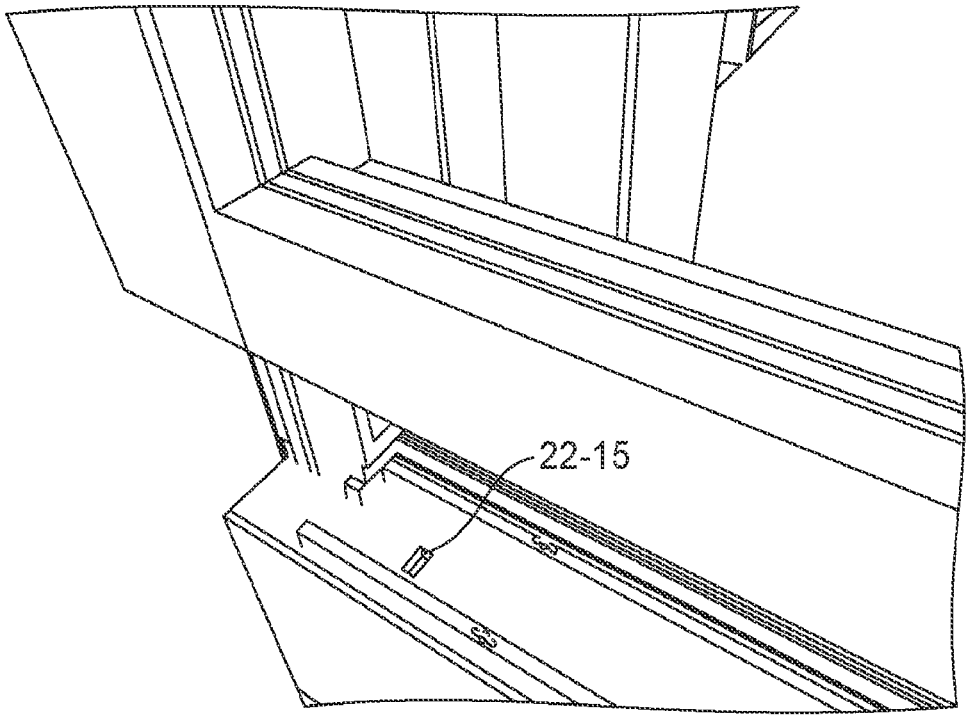

FIGS. 22A to 22E illustrate an embodiment of the corner edge trim in the present invention. In FIG. 22A, the corner edge trim (22-1) is designed to have a long pushing rod (22-4), which can be of various shapes, running from the top to bottom. When the floor slab is pressed down, the rod locks into the buckle slots of the upper and lower floor slabs. There is a trapezoidal structure (22-5) surrounding the rod. On the lateral side of the rod, there is a movable sealing rod (22-6) and a rubber strip (22-7), as shown in FIGS. 22B and 22C. When the floor slab is pressed down, the rod is pushed downward, and due to the trapezoidal shape, the sealing rod in its normal state (22-8) is pushed outward into the trapezoidal slot of the exterior wall's side (22-9), forming the final state (22-10) as illustrated in FIGS. 22D and 22E. In FIG. 22F, the bottom of the exterior wall is equipped with a spring clip (22-13) to prevent reverse movement of the exterior wall during installation. When the exterior wall slides in, component (22-14) in FIG. 22F is pushed upward, retracting inward like a door lock. When it reaches the slot (22-15) position shown in FIG. 22G, it locks into the slot. The beveled edge (22-16) in FIG. 22F facilitates insertion.

Figure 23A:
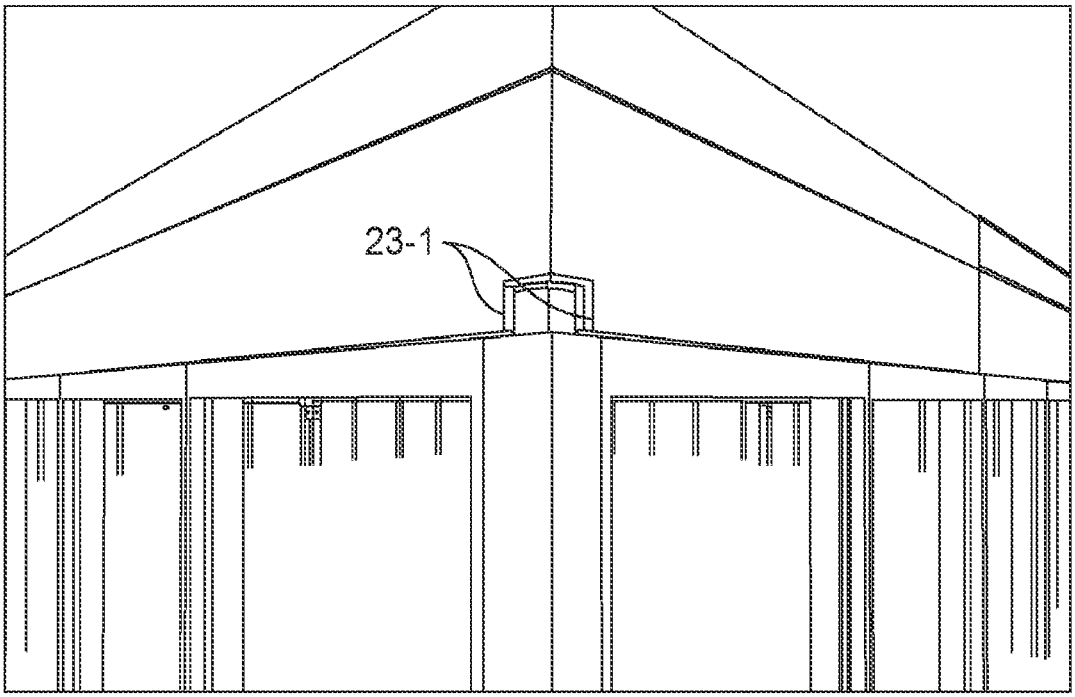
FIGS. 23A and 23B demonstrate the design and mechanism of the operable top corner openings in the slabs for installation of the building's exterior walls.
Figure 23B:
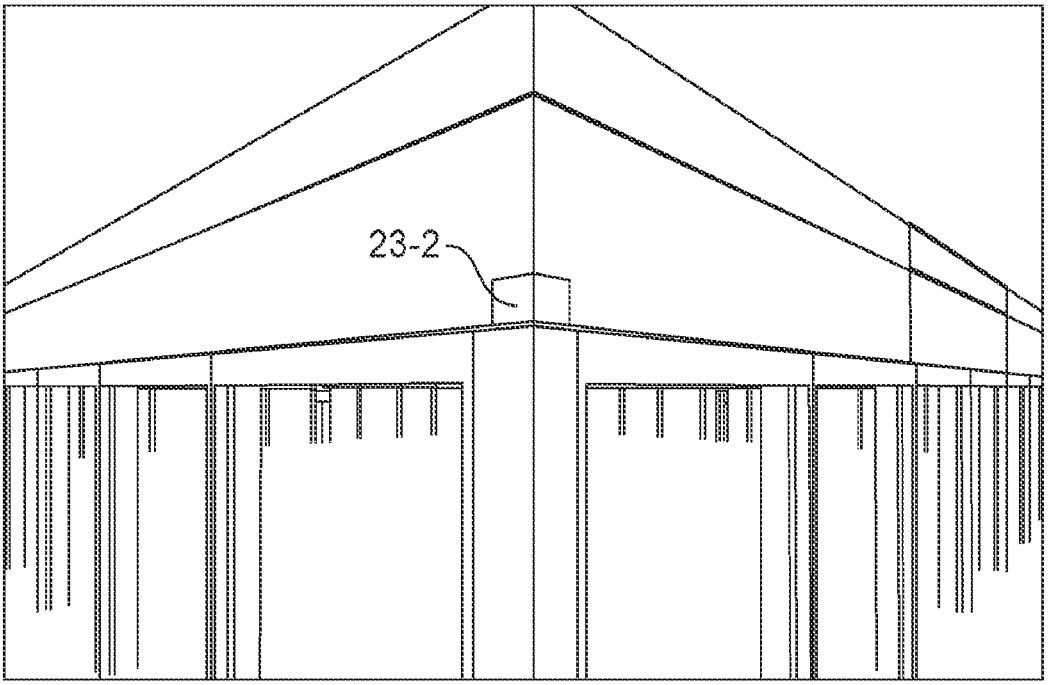

FIGS. 23A and 23B illustrate an embodiment of the design for the top edge of the exterior wall in the present invention. The top edge of the exterior wall comprises an opening (23-1), designed to allow the exterior wall to be installed via the edge of the floor slab. FIG. 23B shows that the opening relies on a motor or the movement of the floor slab itself to generate the necessary power. This power is mechanically transferred to the slab lifting structure (23-2). Once the current floor is fully installed, the jack lowers the slab, sealing the opening to prevent dust, rainwater, and other elements from entering the interior of the building through the opening.

Example 3

Interior of the Building

Figure 24:
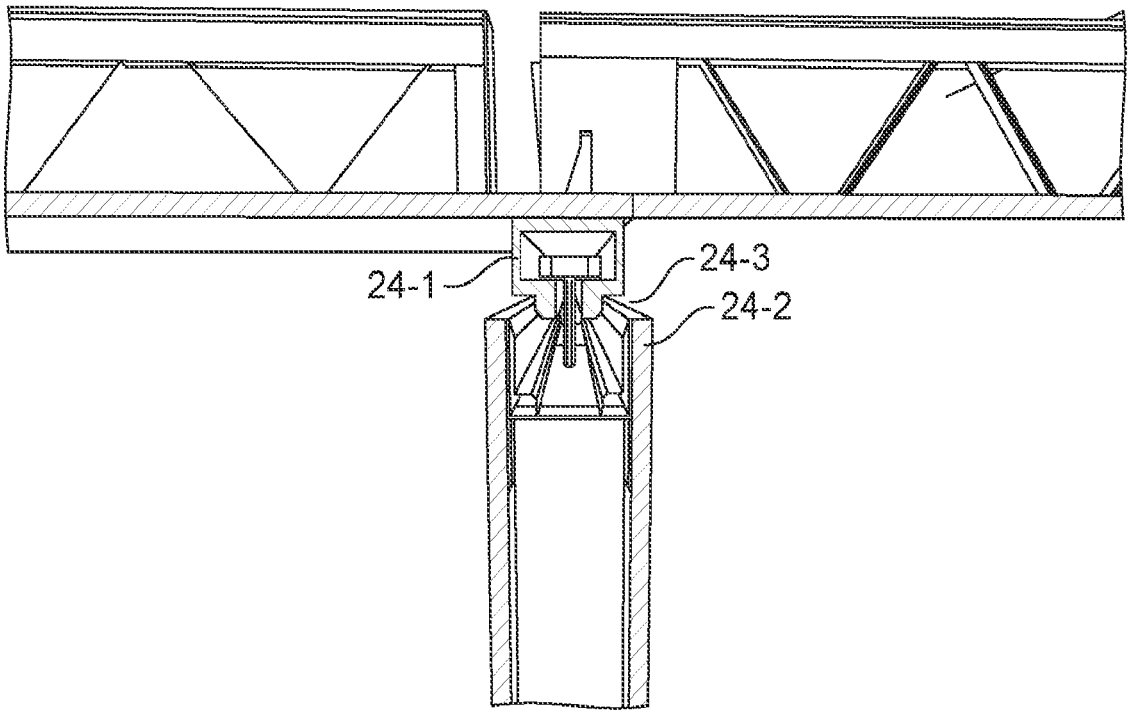
FIG. 24 illustrates the modular interior wall and its assembly method in an embodiment of the present invention.
Figure 25:
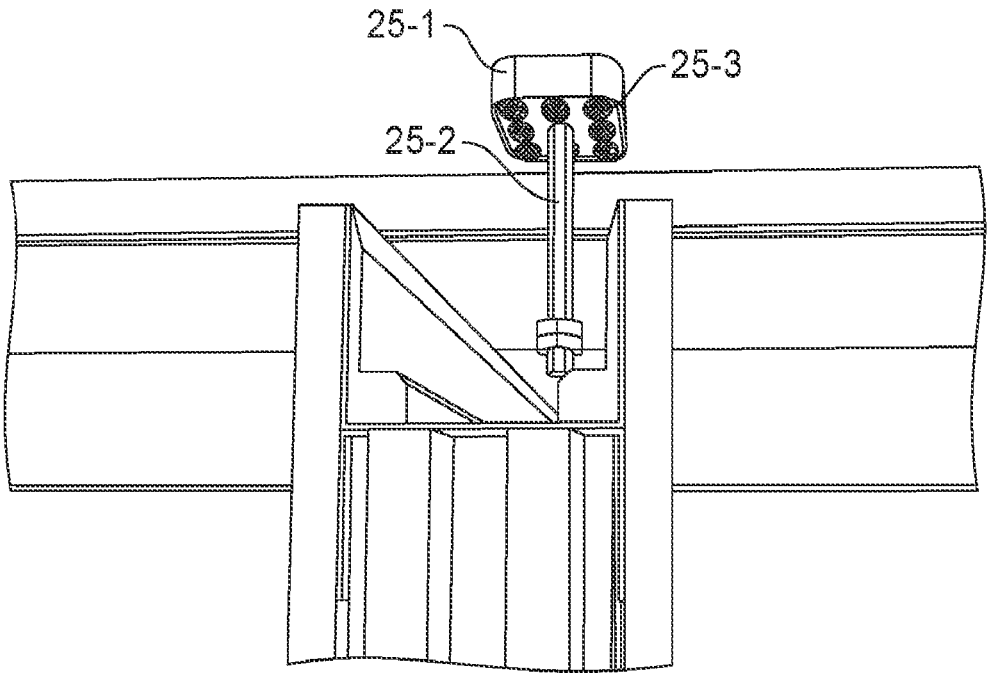
FIG. 25 shows an embodiment of the interior wall locking device for securing the interior walls.
Figure 26:
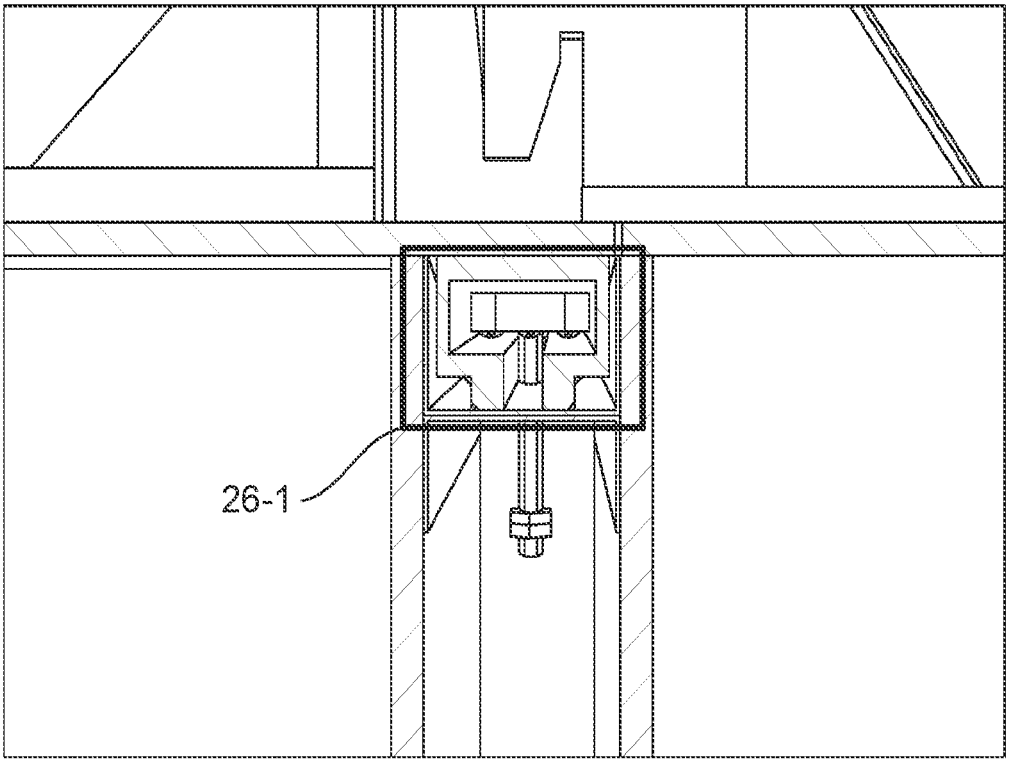
FIG. 26 illustrates the situation where, after the floor slab is lowered, the interior wall slide rail is pressed into the recessed slot to secure the upper part of the interior wall.
Figure 27A:
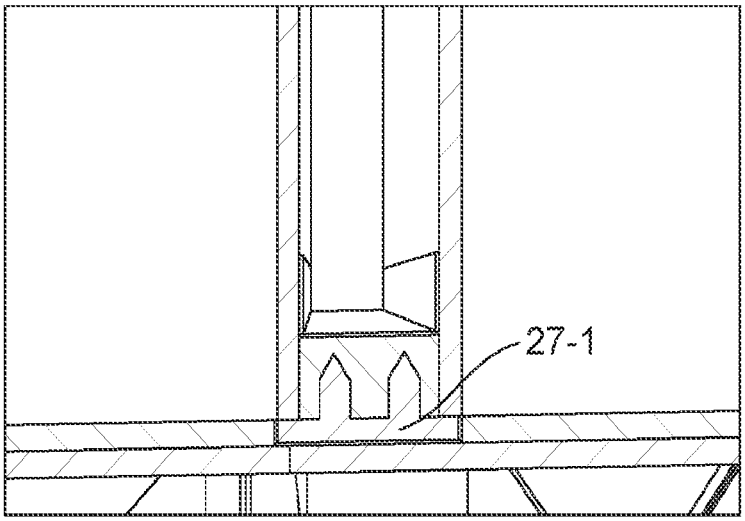
FIGS. 27A and 27B show the lower fixing components, including the fixing element at the bottom of the interior wall and the fixed connectors on either the lower floor slab or the upper floor slab. The fixing element is connected to the fixed connector to secure the lower part of the interior wall.
Figure 27B:
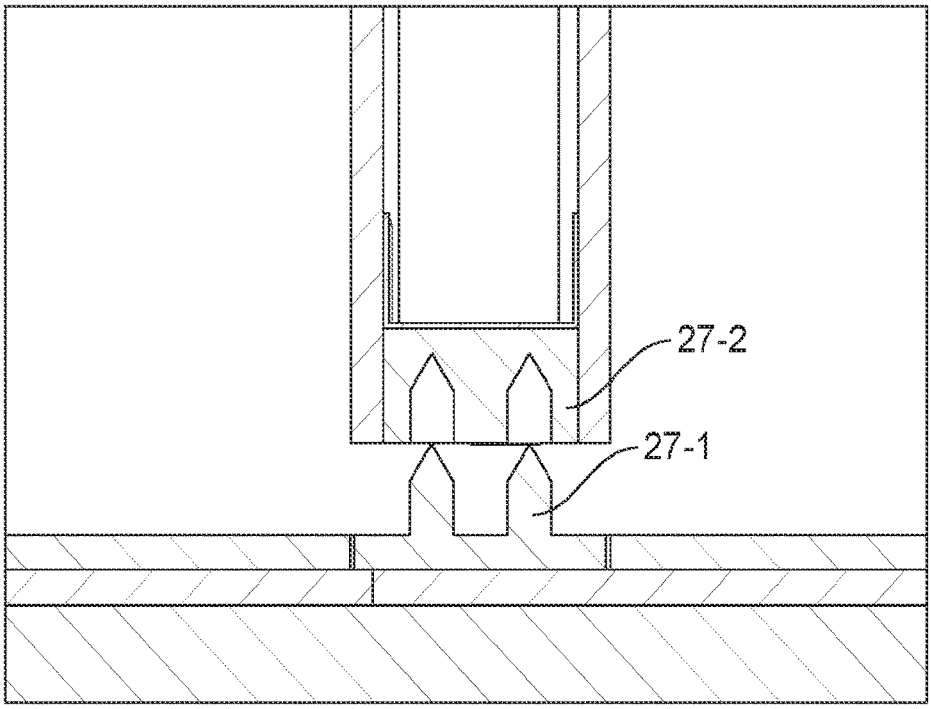

The present invention further provides modular interior walls and its assembly method (including decorative surfaces). FIG. 24 illustrates an embodiment of the present invention, where said prefabricated building structure further comprises interior wall slide rails (24-1) fixed to the floor slab. Said partition components comprise interior walls (24-2), and said interior wall slide rails are configured to guide said interior walls. When the floor slab is lifted, the interior walls separate from the slide rails (24-3), facilitating movement In the embodiment shown in FIG. 25, said interior wall comprises a hanger piece (25-1), which comprises a support rod (25-2) which is centrally located and a set of ball bearing rollers (25-3) at the bottom. Said hanger piece is located at the top of the interior wall and is connected to the wall body via said support rod. Said hanger piece is positioned within said interior wall slide rails. In one embodiment, the shape of said hanger piece is selected from circular, square, or rectangular shapes. In one embodiment, said interior wall comprises an interior wall locking device for securing said interior walls. As shown in FIGS. 26, 27A, and 27B, said interior wall locking device comprises an upper fixing component and/or a lower fixing component: a) said upper fixing component comprises said interior wall slide rail and a recessed slot on said interior wall. When the floor slab is lowered, said interior wall slide rail is pressed into said recessed slot to secure the upper part of said interior wall (26-1), b) said lower fixing component comprises a fixing element (27-2) at the bottom of said interior wall and a fixed connector (27-1) on said lower floor slab or said upper floor slab. Said fixing element and said fixed connector are connected to secure the lower part of said interior wall.

Figure 28:
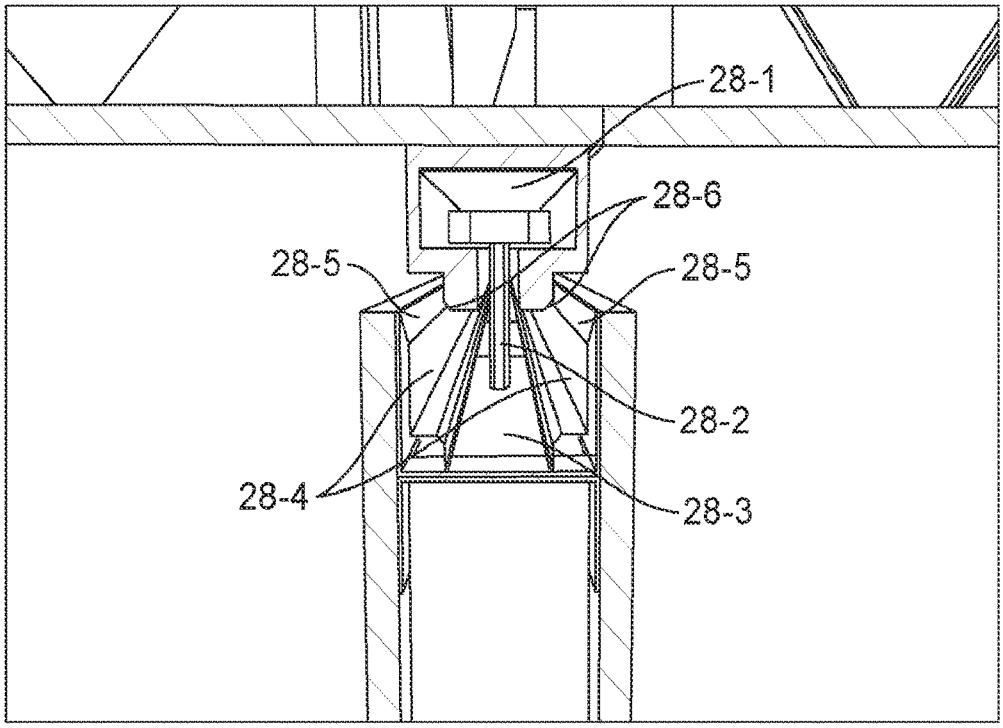
FIG. 28 demonstrates the use of a slide rail fixed on the floor slab as a fixing element and the recessed slot design of the interior wall.

FIG. 28 illustrates an embodiment where the slide rail (28-1) is fixed to the floor slab, allowing it to serve as a fixing element. When the floor slab is lifted by the jack, the entire interior wall detaches from the slide rail, facilitating movement and turning. When the floor slab is lowered, the central pushing rod (28-2) descends, and the upper part of the interior wall, designed with a recessed slot (28-3), encloses the slide rail (28-1). This configuration secures the upper part of the interior wall. The recessed slot is equipped with a soundproofing material (28-4) to provide sound insulation. Additionally, the top of the recessed slot includes a beveled edge (28-5), and the bottom of the rail has a beveled design (28-6), as shown in FIG. 28. These features facilitate easy insertion into the rail and allow for minor deviations during on-site construction.

Figure 29:
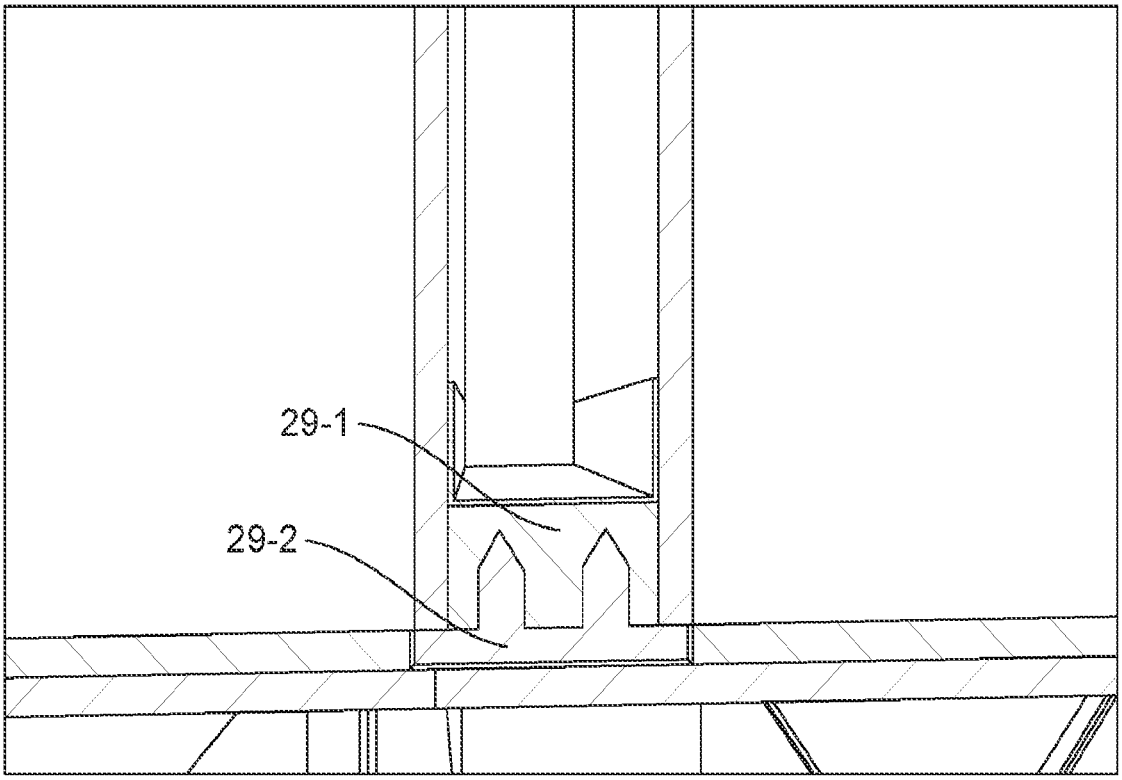
FIG. 29 shows two concave triangular pyramid design for the lower portion of the interior wall in an embodiment of the present invention.

FIG. 29 illustrates an embodiment where the lower part of the interior wall features two concave triangular pyramids (29-1) designed to fit into the base on the floor slab. The base is designed with two upright triangular pyramids (29-2). When the floor slab is lifted by a jack, the bottom of the interior wall separates from the base, facilitating movement and turning. When the floor slab is lowered by the jack, the two triangular components interlock, securing the interior wall in place. The triangular design allows for slight offsets, making it easier to insert the interior wall into the base. The base is also designed to support lateral forces acting on the interior wall. Conventional installation methods require manually locking each wall to secure it, making the process cumbersome. The design of the present invention simplifies the installation process.

Figure 30A:
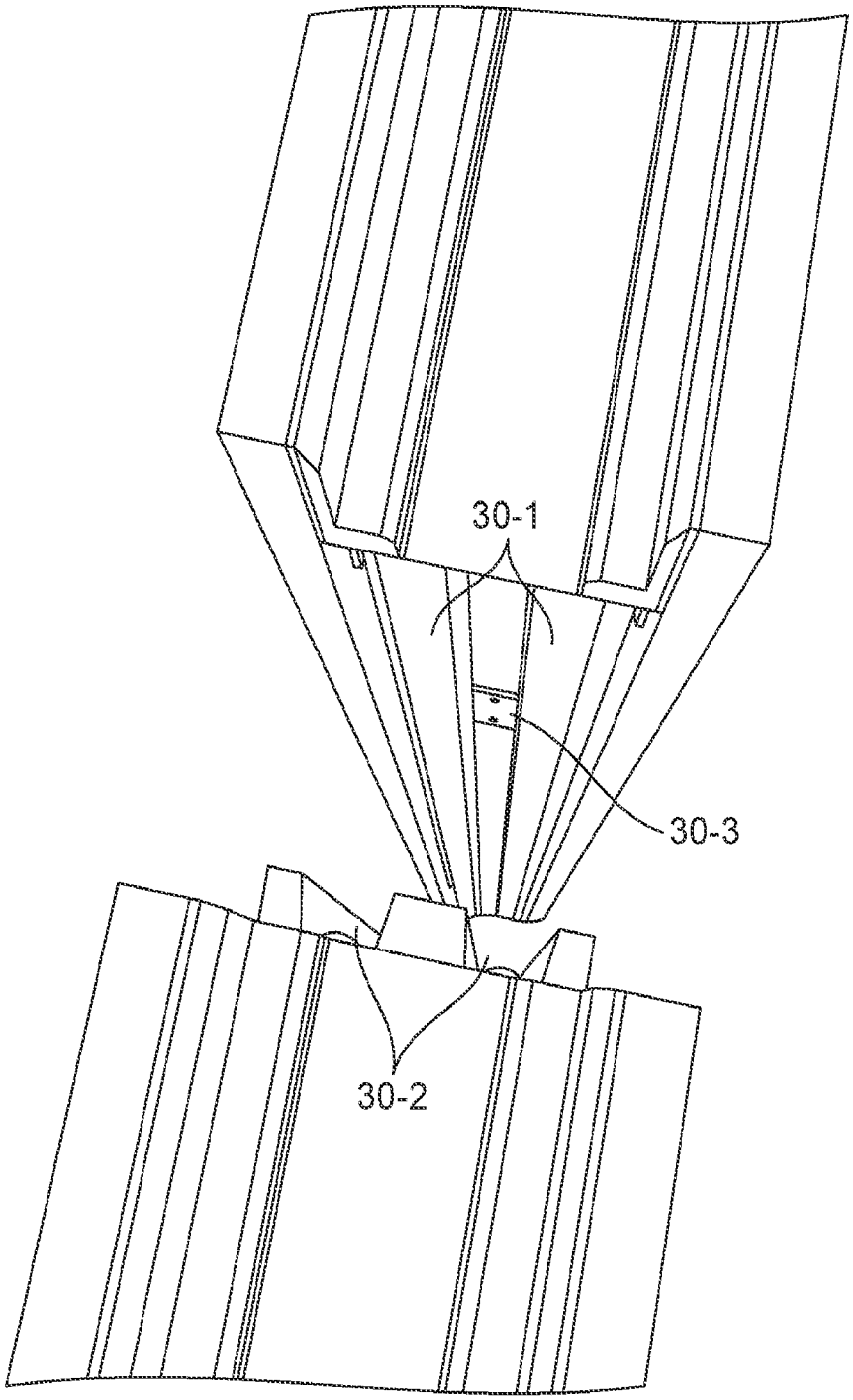
FIG. 30A illustrates the wall comprises primary-secondary grooves and ridges, and magnetic fasteners for jointing.
Figure 30B:
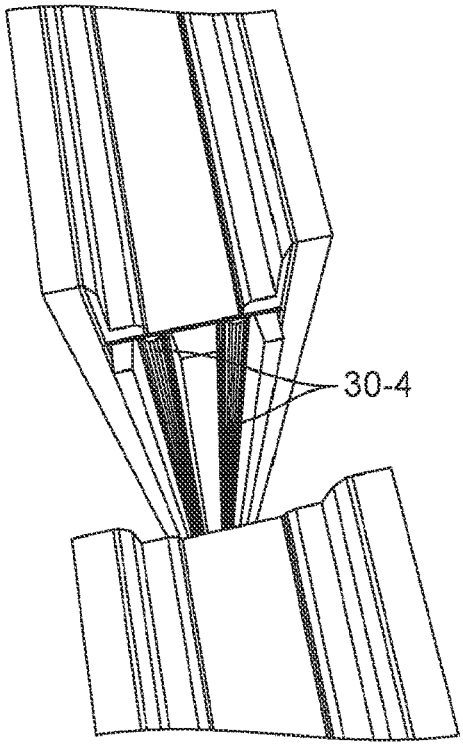
FIG. 30B illustrates the insertion of soundproofing strips to the sharp ridge to achieve soundproofing effects.

FIGS. 30A and 30B illustrate an embodiment where the wall comprises grooves (30-2) and ridges (30-1), and magnetic fasteners for connection (30-3). The magnetic fasteners ensure that the interior wall slides into the correct position, maintaining alignment of the wall when the top floor slab is pressed down. Additionally, the sharp ridges are inserted with soundproofing strips (30-4) to achieve soundproofing effects.

Figure 31A:
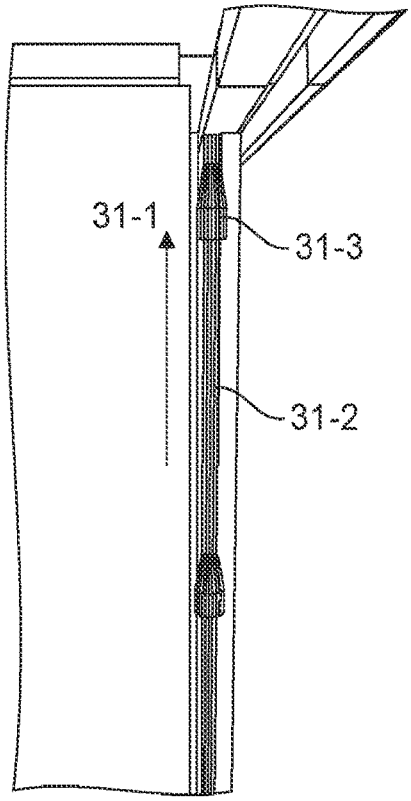
FIGS. 31A to 31C illustrate an embodiment where the interior walls meet perpendicularly with interior walls and to exterior walls via the interior wall edge trims.
Figure 31B:
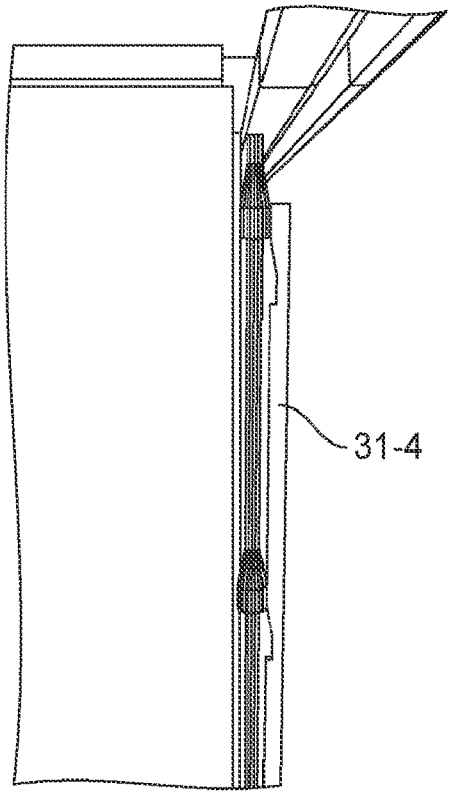
Figure 31C:
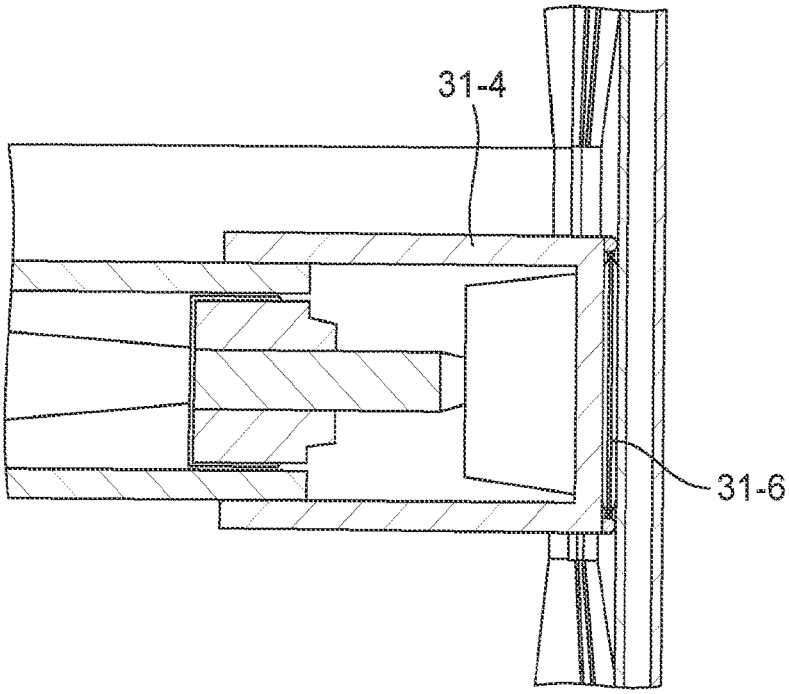

FIGS. 31A and 31B illustrate an embodiment where interior walls meet perpendicularly, forming a T intersection and the junction with the exterior wall also utilizes the same closure method, but in reverse. When the floor slab is lowered, the edge pushing rod (31-2) moves upward (31-1). (The rod can be of various shapes.) A reverse funnel shape (31-3) presses out the sealing strip (31-4). As shown in FIG. 31C, the sealing strip (31-4) comprises a rubber seal (31-6) that closes the junction between the interior wall and the exterior wall.

Figure 32A:
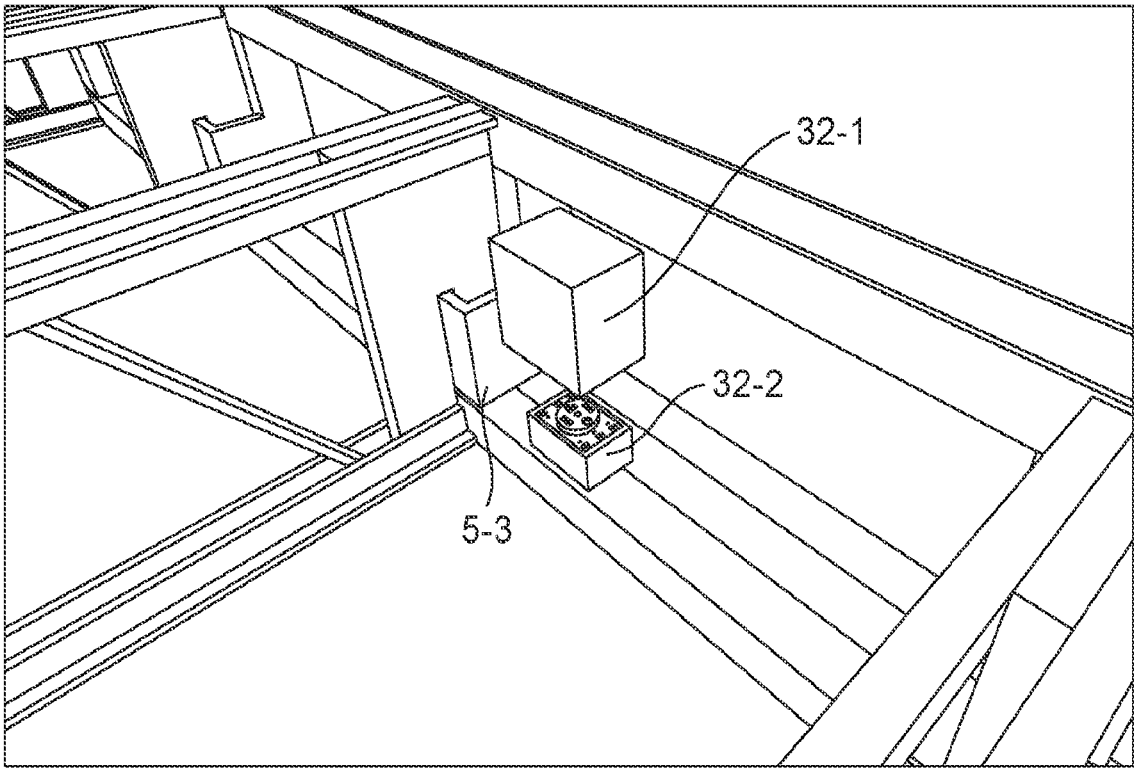
FIG. 32A shows the socket design on the floor slab, including a socket covered with an electrical box lid.
Figure 32B:
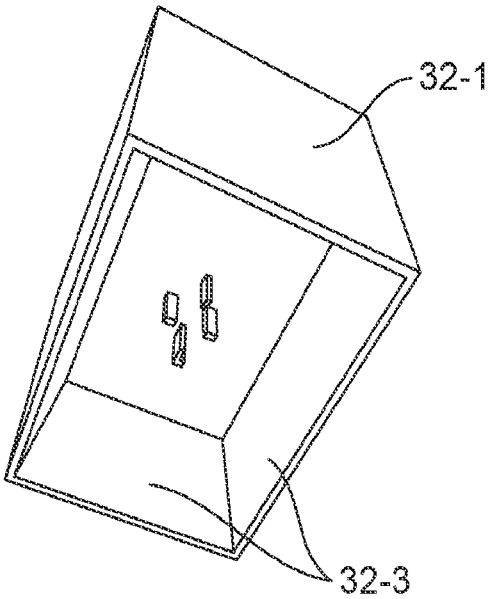
FIG. 32B illustrates the inclined design on the inner side of the electrical box lid for the floor slab.

FIGS. 32A and 32B illustrate an embodiment of the interior wall socket design in the present invention: In FIG. 32A, electrical wiring is pre-installed within the floor slab, and the socket connection is designed to fit between floor slabs. The electrical box socket (32-2) is placed on the beam as a protruding component. The electrical box lid (32-1) covers the socket as a waterproofing mechanism. The edges of the electrical box lid must not exceed the fastener (5-3), ensuring alignment with the overall structural edge for ease of transportation and installation. In FIG. 32B, the interior of the electrical box lid (32-1) is designed with a beveled edge (32-3), ensuring accurate insertion of plugs when placing the lid over the socket.

Figure 33A:
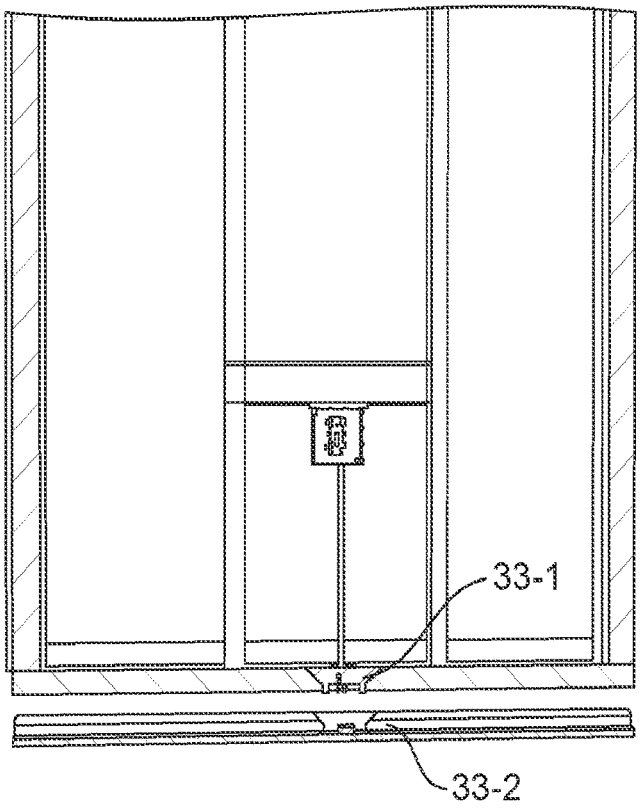
FIGS. 33A to 33D demonstrate the design for connecting power to interior walls and assisting in the positioning adjustment of interior walls in an embodiment of the present invention.
Figure 33B:
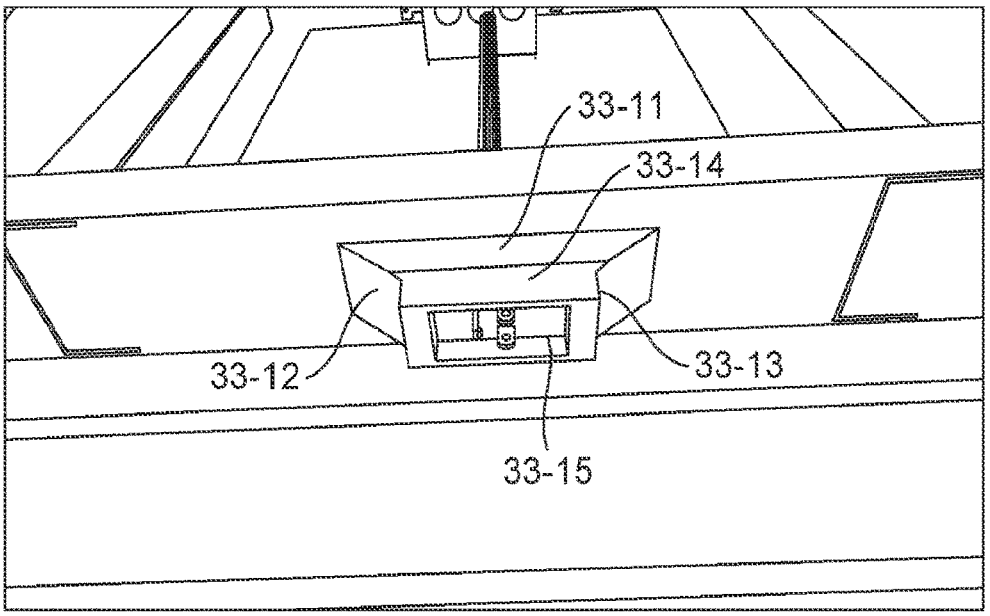
Figure 33C:
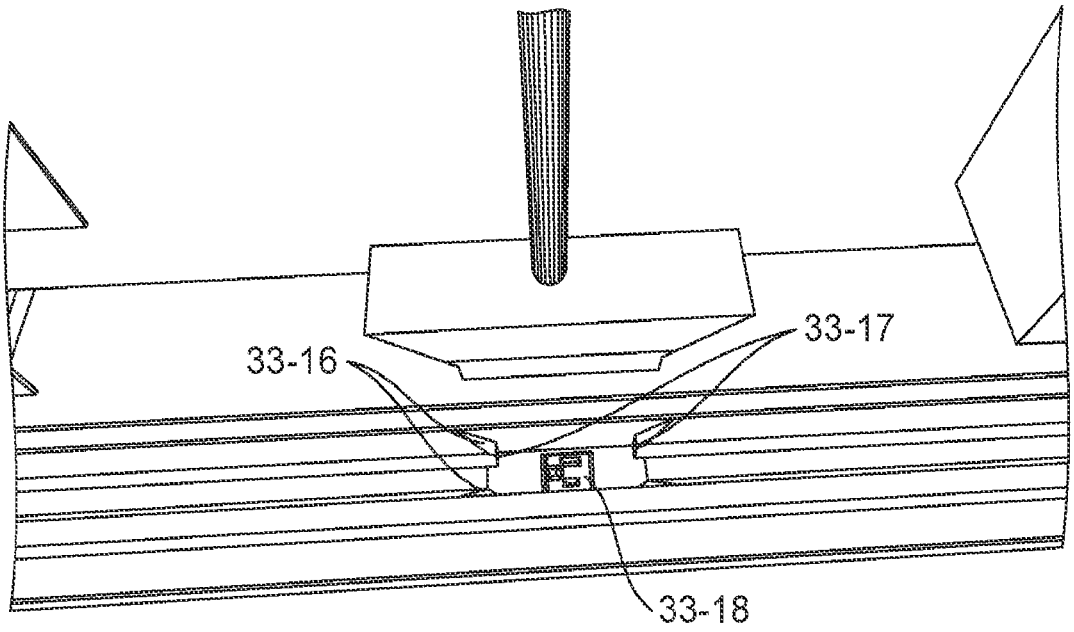
Figure 33D:
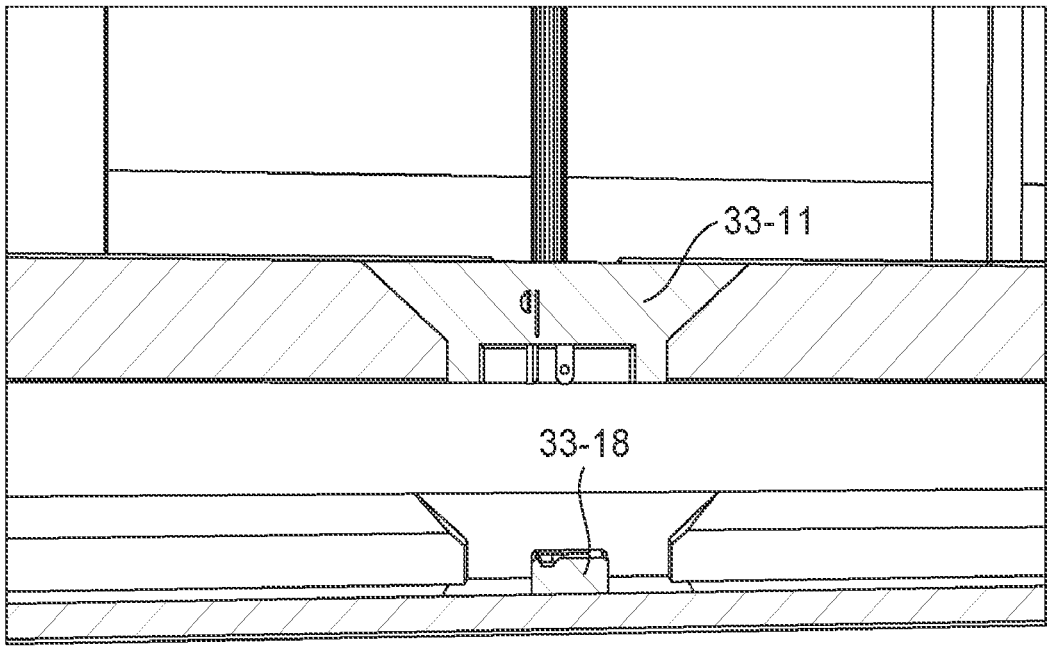

FIGS. 33A, 33B, and 33C illustrate an embodiment of the specially designed interior wall for the present invention. In FIG. 33A, the socket lid (33-1) and socket slot (33-2) are used for positioning, correcting positional deviations, and providing socket lid functionality. FIG. 33B shows the track at the bottom of the interior wall, which comprises a V-shaped fastener (33-11) with a beveled edge (33-12), a right-angle edge (33-13), and an additional beveled edge (33-14). These elements work together to control lateral deviation, allowing the interior wall to self-adjust under the weight of the descending floor slab. This ensures the interior wall accurately aligns with its designated position and allows plugs to be inserted correctly. A slight bevel (33-15) is included for easy engagement. The socket lid (33-11) houses the plug and prevents any water from flowing downwards. In FIG. 33C, the slot on the floor slab is designed with a corresponding bevel (33-16) and a right-angle edge (33-17) to engage with the fastener for positioning, alignment and accommodating the socket (33-18). FIG. 33D provides a cross-sectional view of the fastener and slot mechanism.

Figure 34A:
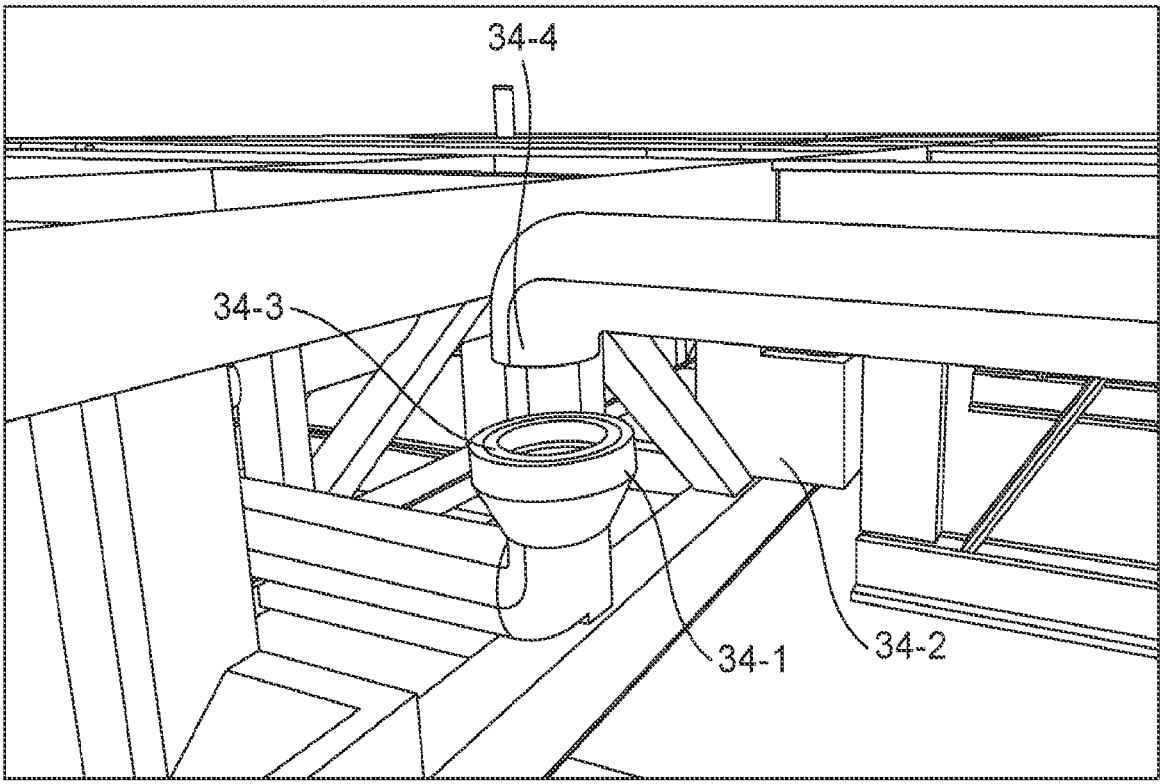
FIGS. 34A and 34B show an embodiment of the connection of ventilation pipes between floor slabs.
Figure 34B:
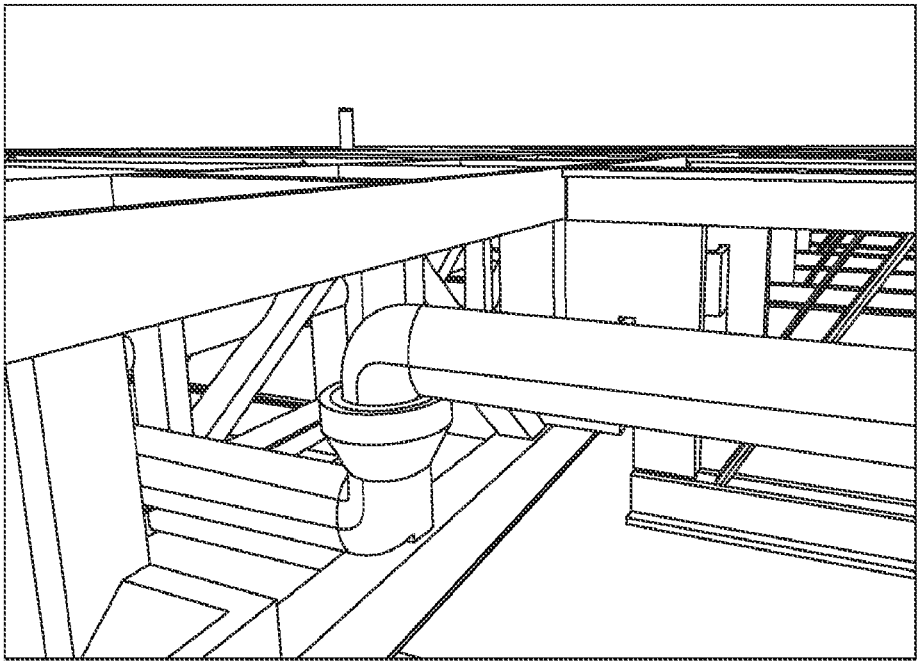

FIGS. 34A and 34B illustrate the connection of ventilation pipes between floor slabs in an embodiment of the present invention. In FIG. 34A, the pipe at the bottom comprises a funnel-shaped opening (34-1) that does not extend beyond the edge of the floor slab fastener (34-2). The entire interior of the funnel-shaped opening is covered with a rubber gasket (34-3) to prevent air leakage. When the pipe from above (34-4) on another floor slab is pressed down as the floor slab lowers, the pipe (34-4) is pressed into the funnel-shaped opening. The weight of the floor slab ensures a tighter connection between the pipes, as shown in FIG. 34B.

Figure 35A:
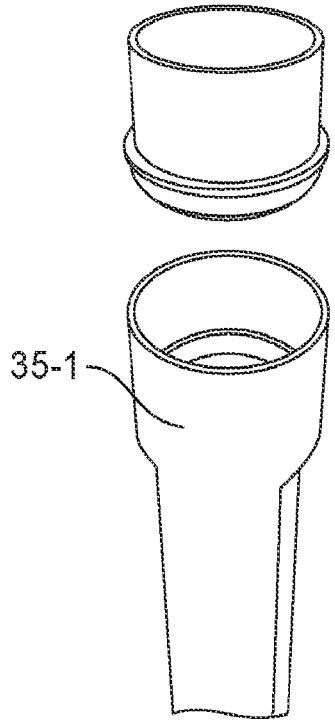
FIGS. 35A and 35B illustrate an embodiment of the connection of drainage pipes between floor slabs and interior walls.
Figure 35B:
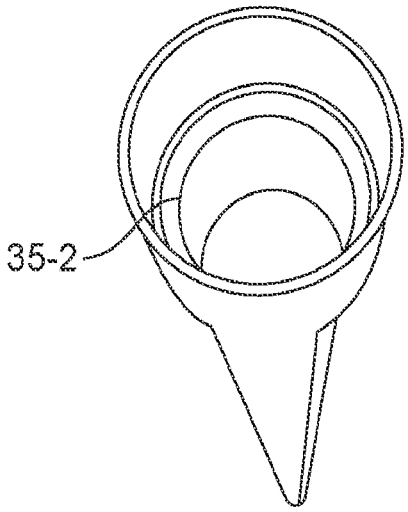
Figure 35C:
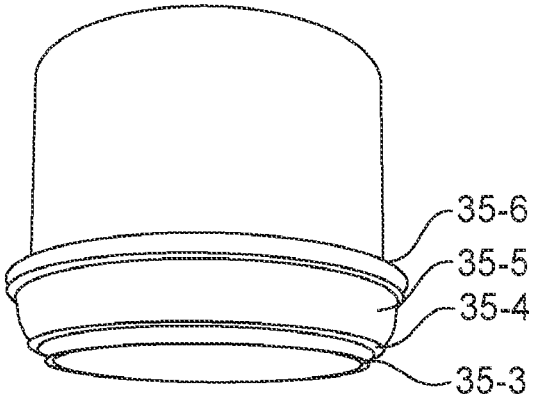

FIGS. 35A to 35C illustrate the connection between floor slabs and drainage pipes within interior walls in an embodiment of the present invention. In FIG. 35A, the interior wall cavity is increased to accommodate the drainage pipe. The lower pipe in the wall is designed with a widened opening (35-1), which comprises a wax ring (35-2) at the lower part of the widened opening, as shown in FIG. 35B. The upper pipe comprises an extended section (35-3) at the end for insertion into the lower pipe to direct water flow. A portion of the upper pipe (35-4) sits onto the wax ring, compressing it and securing it firmly at the widened opening of the lower pipe. The arc-shaped design (35-5) of the connection ensures that the compressed wax seals the space upward along the pipe. Additionally, the protruding section (35-6) reduces the remaining space, enhancing the sealing effect of the wax. The sealing force is provided by the weight of the floor slab when lowered by the jack, as shown in FIG. 35C.

Figure 36A:
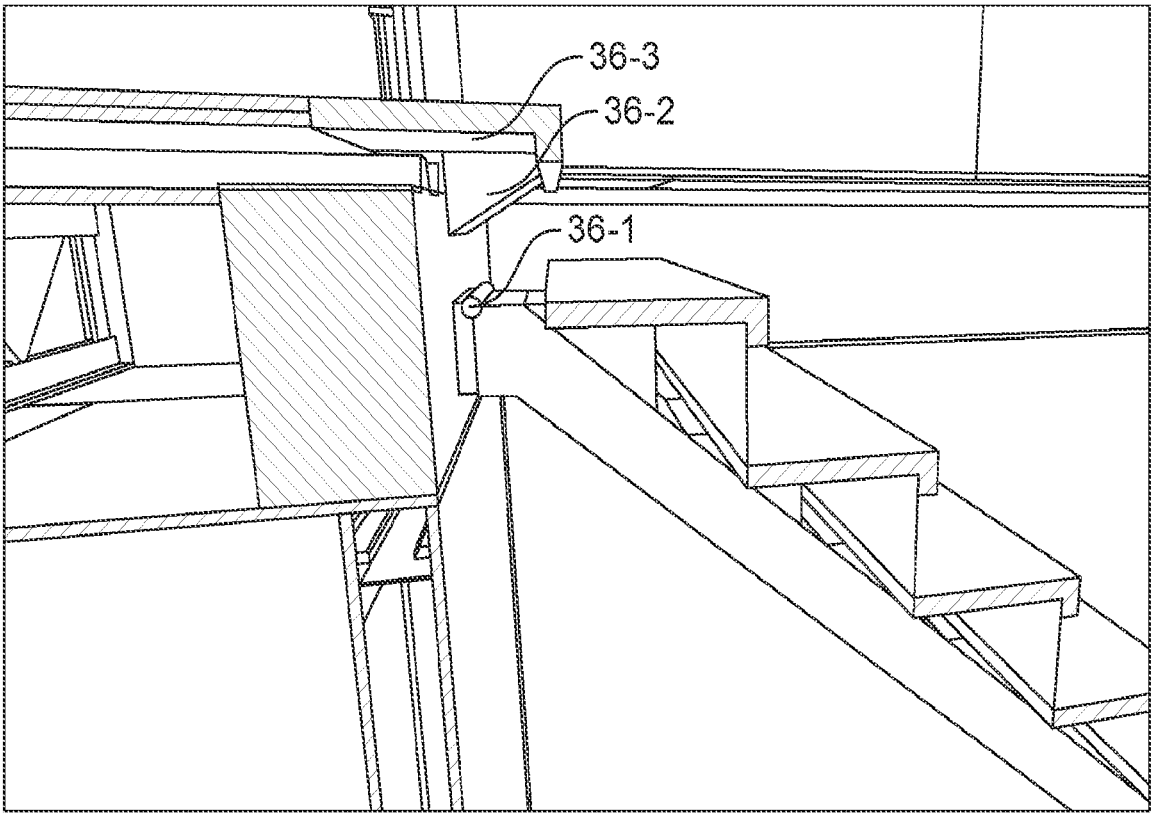
FIGS. 36A to 36C illustrate embodiments of the staircase design in the present invention.
Figure 36B:
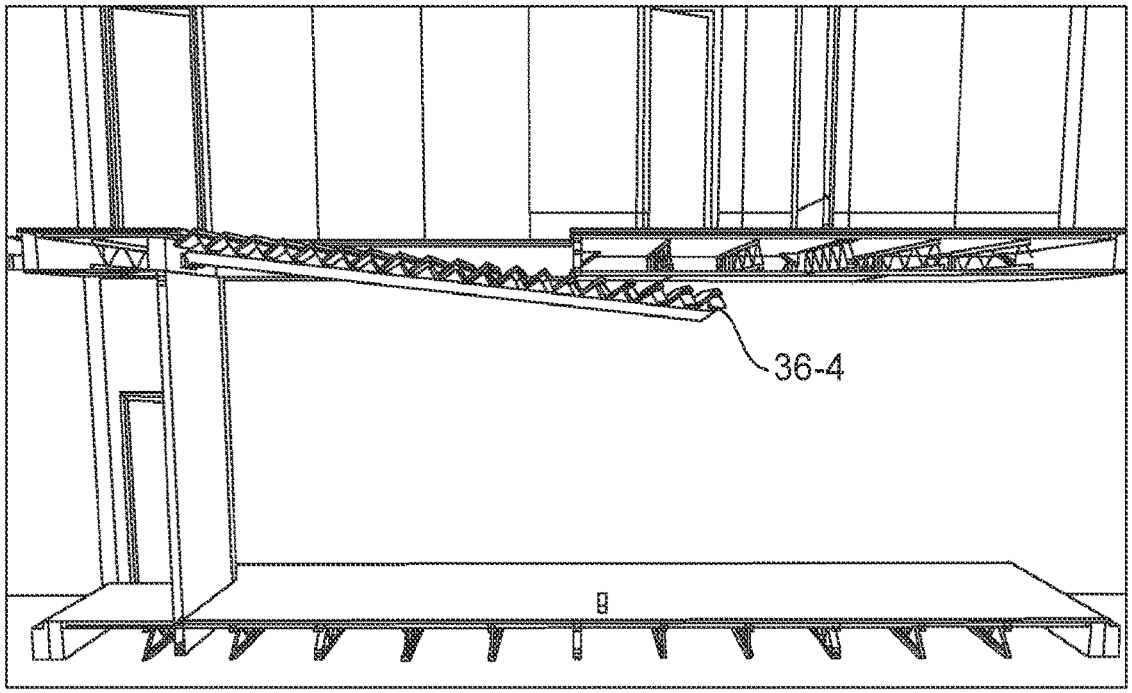
Figure 36C:
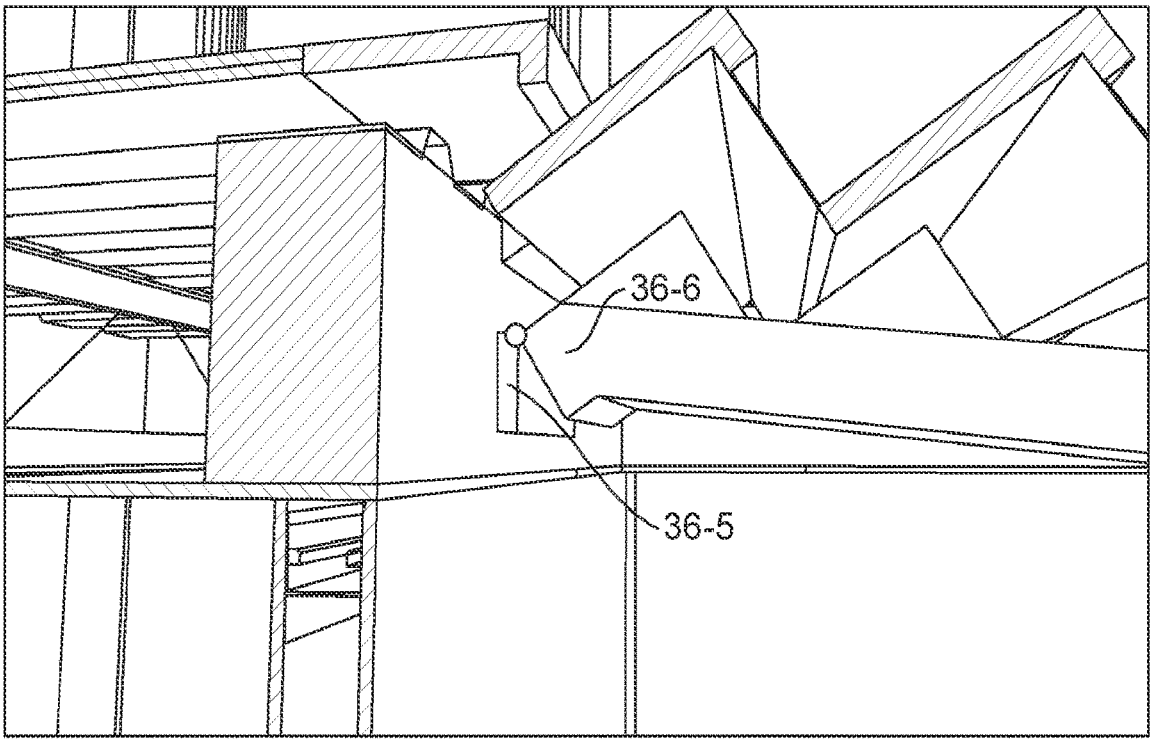

FIGS. 36A to 36C illustrate the staircase design in an embodiment of the present invention. In FIG. 36A, the staircase is designed to move up and down using a heavy-duty hinge (36-1). To provide angular space for staircase movement, a fixed diagonal support (36-2) anchors the top stair tread (36-3), separating it from moving with the rest of the staircase. FIGS. 36B and 36C depict the state of the staircase when it is lifted for transportation. The lower part of the staircase (36-4) rests against the lower floor slab, while the axis of rotation (36-5) of the upper part of the staircase leverages the structure (36-6) upward.

Figure 37A:
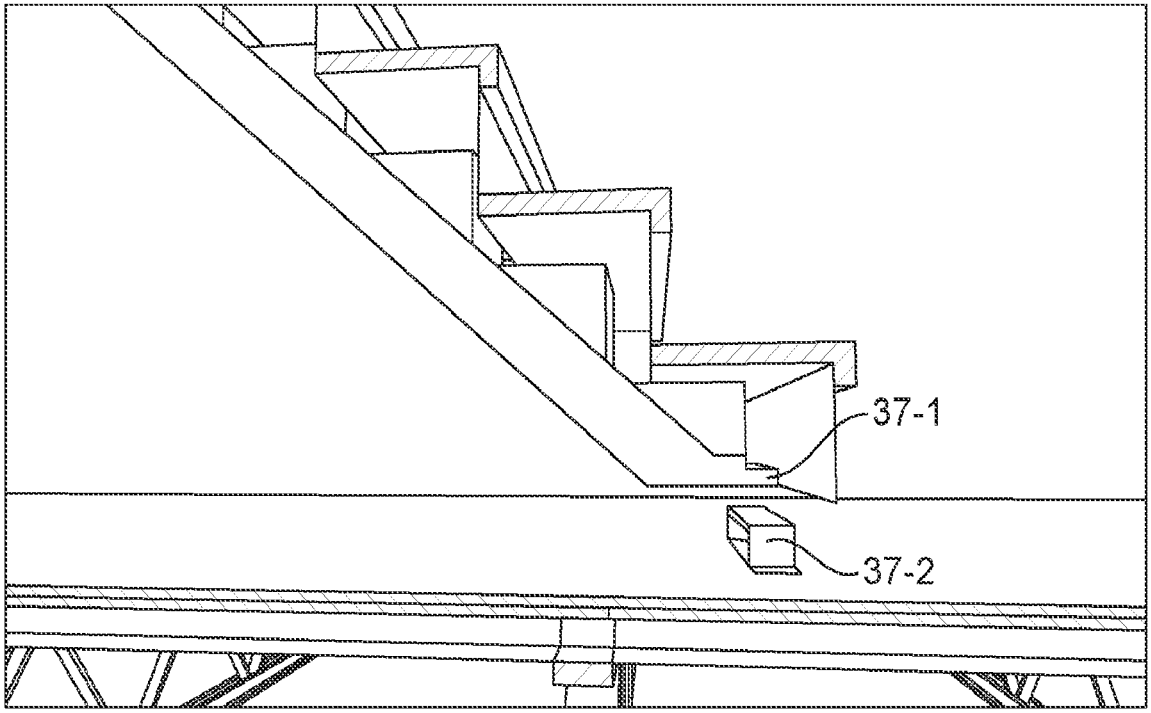
FIGS. 37A and 37B further illustrate the slot and clip design of the staircase in the present invention.
Figure 37B:
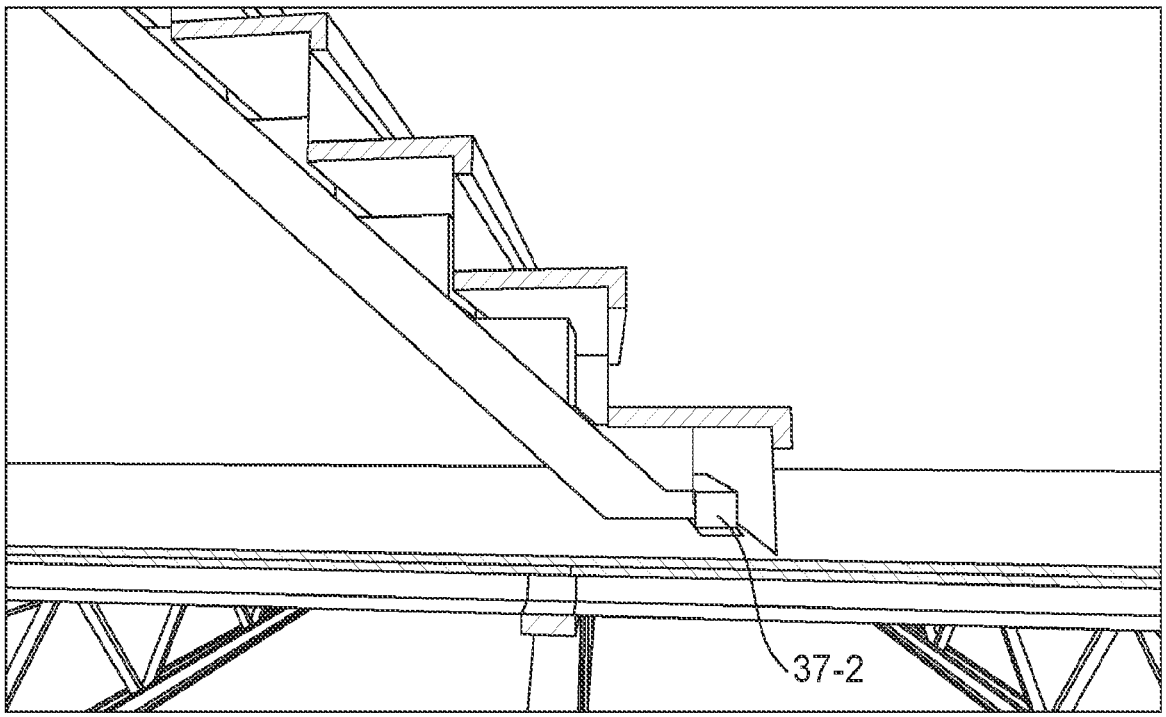

FIGS. 37A and 37B illustrate an embodiment where the lower part of the staircase is designed with a buckle slot (37-2) and a fastener (37-1). When the staircase is lifted along with the floor slab by the jack, it drags over the buckle slot (37-2). As the jack lowers the floor slab, the staircase fastener (37-1) is pushed into the buckle slot (37-2), securing the staircase in a fixed position.

Figure 38A:
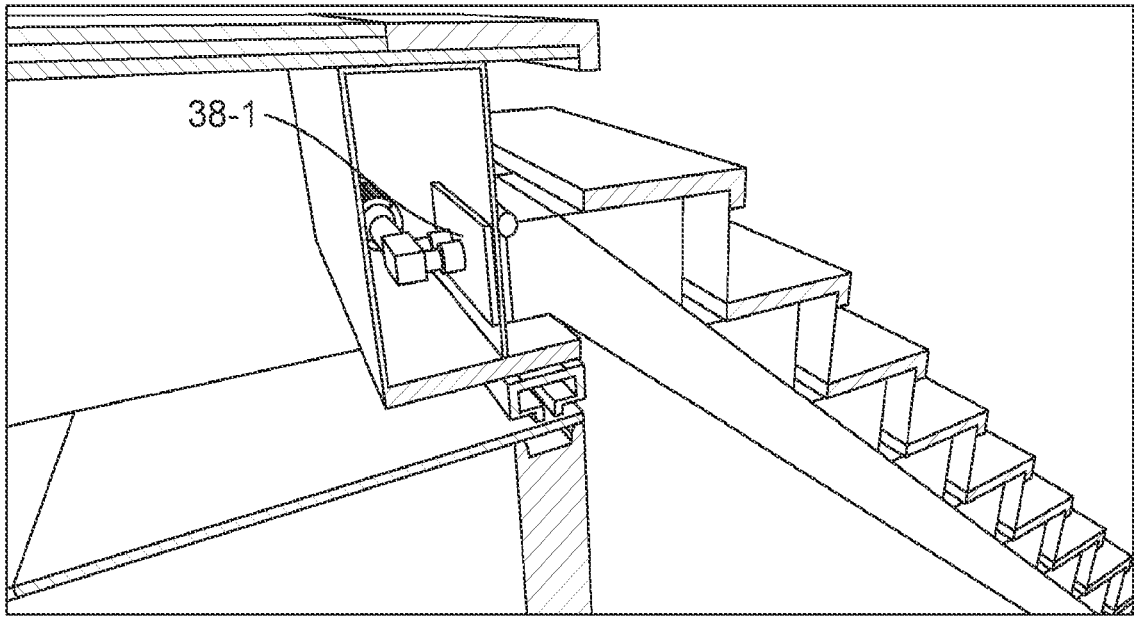
FIG. 38A shows a multi-head motor located behind the upper axis of the staircase, which tightens bolts to secure the staircase after positioning.

FIG. 38A illustrates an embodiment where, after the staircase is positioned, an automatic tightening device (38-1) located within the beam behind the upper axis of the staircase tightens the bolts to lock the staircase in place.

Figure 38B:
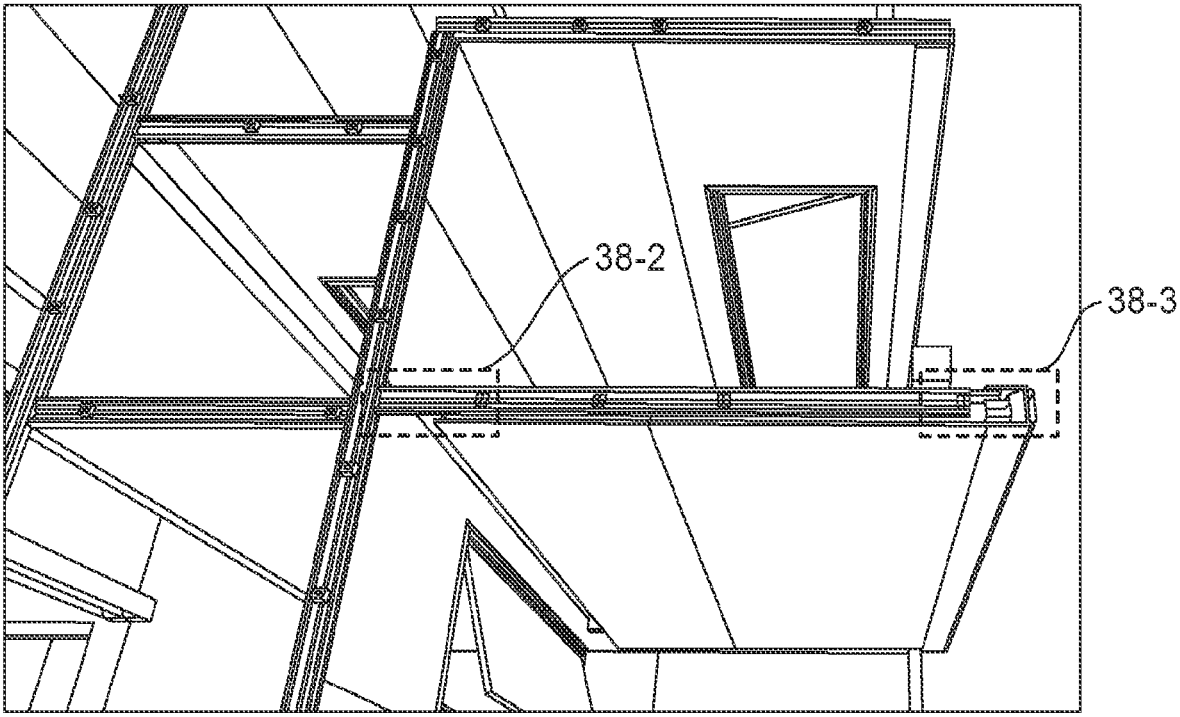
FIG. 38B presents an embodiment of interior wall supplementation in the present invention.

FIG. 38B illustrates an embodiment of interior wall supplementation in the present invention. To facilitate installation at the junctions of certain interior walls, where turning of the walls at the junction is obstructed, the interior wall slides along the track beyond the limit of the exterior wall edge (38-3) making the junction obstruction-free. Once the wall is in place, it is pushed back (38-2) to ensure a tight fit at the junctions.

Example 4

Auxiliary Devices for Building Assembly

Figure 39A:
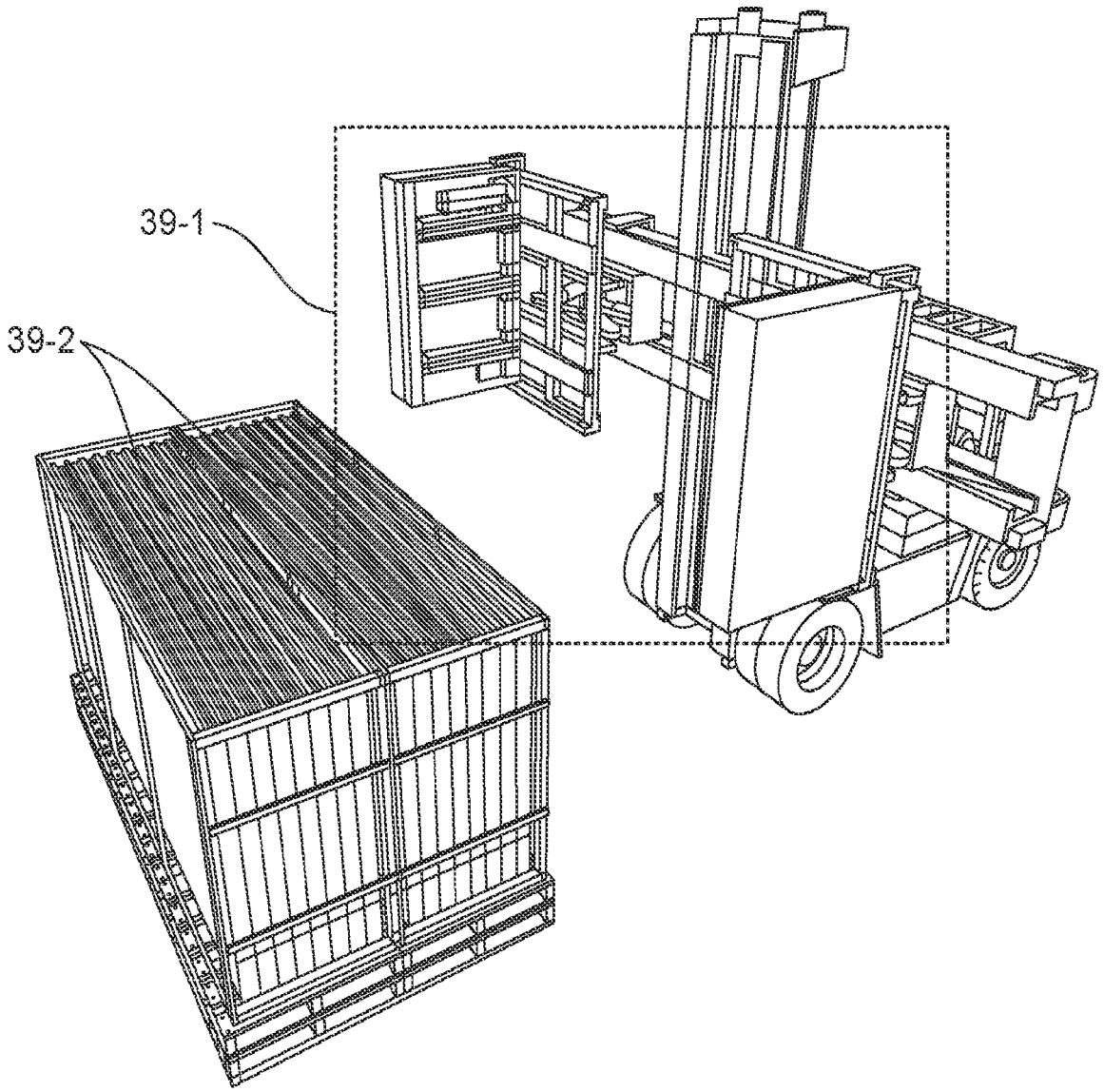
FIGS. 39A and 39B are schematic diagrams of embodiments of auxiliary devices for assembling the building of this invention.
Figure 39B:
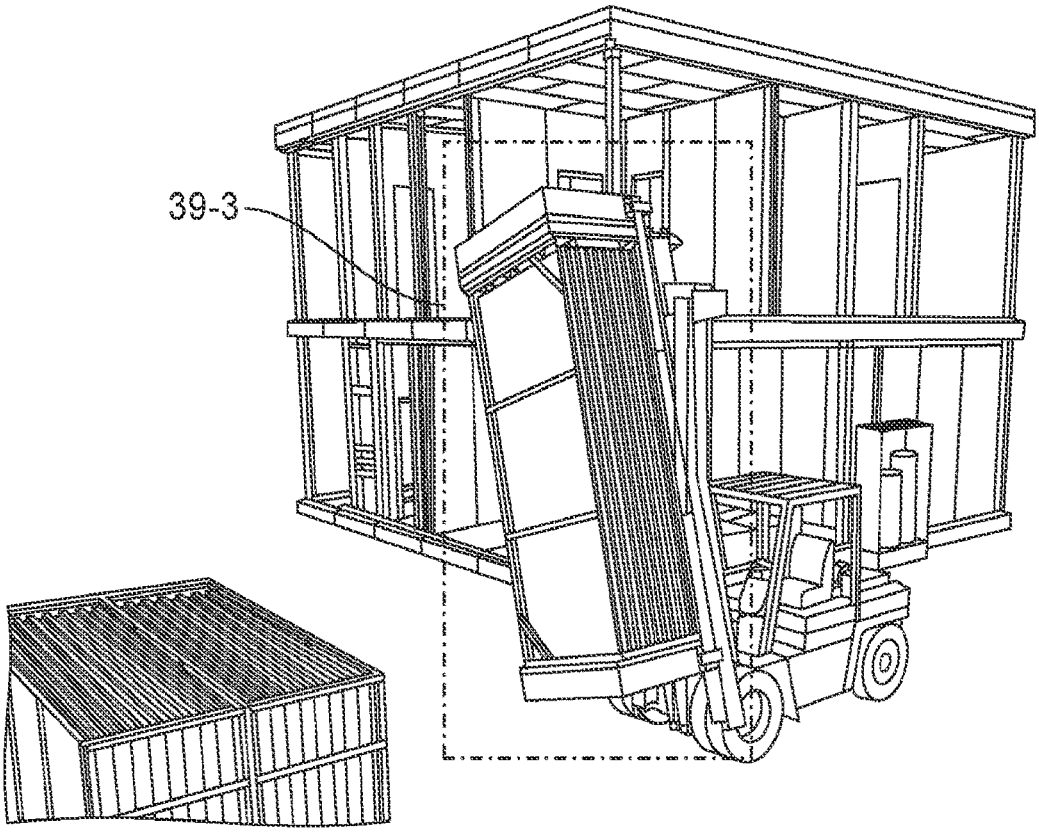
Figure 40A:
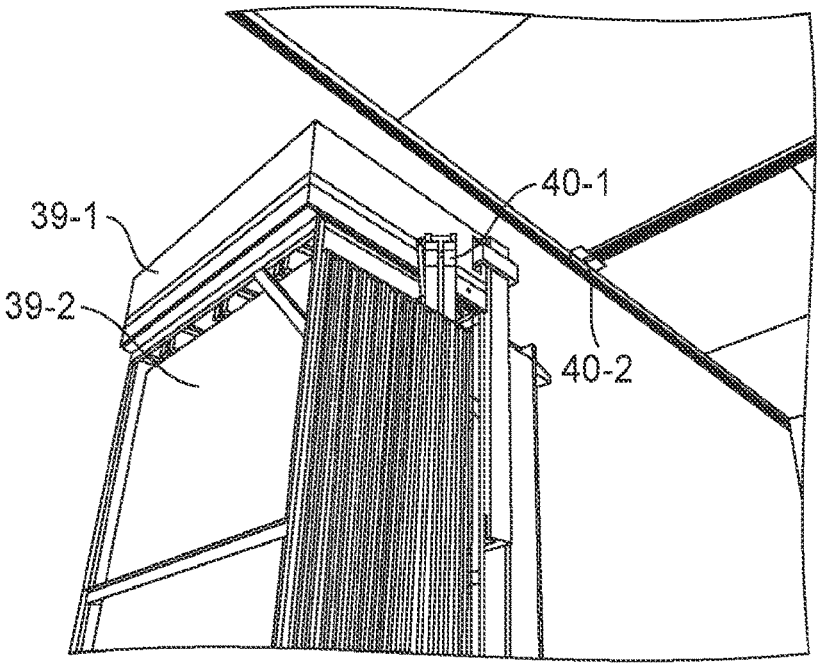
FIGS. 40A to 40G illustrate an embodiment of the interior wall assembly device's docking rail in the auxiliary devices for assembling the building of this invention.
Figure 40B:
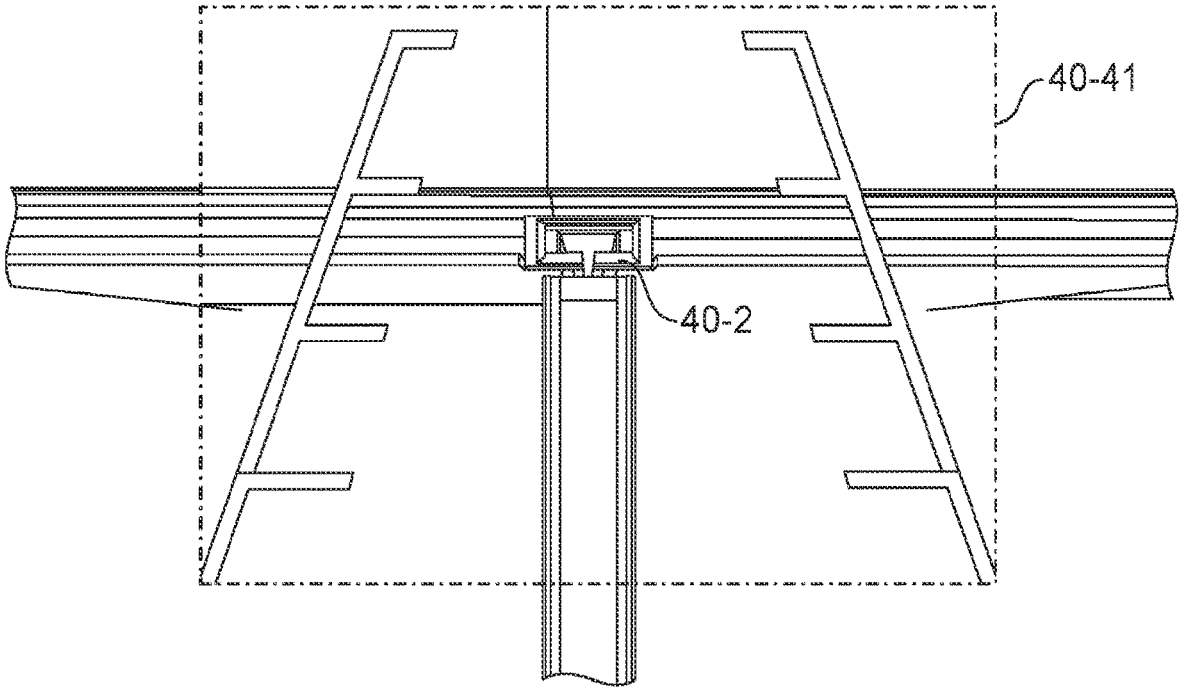
Figure 40C:
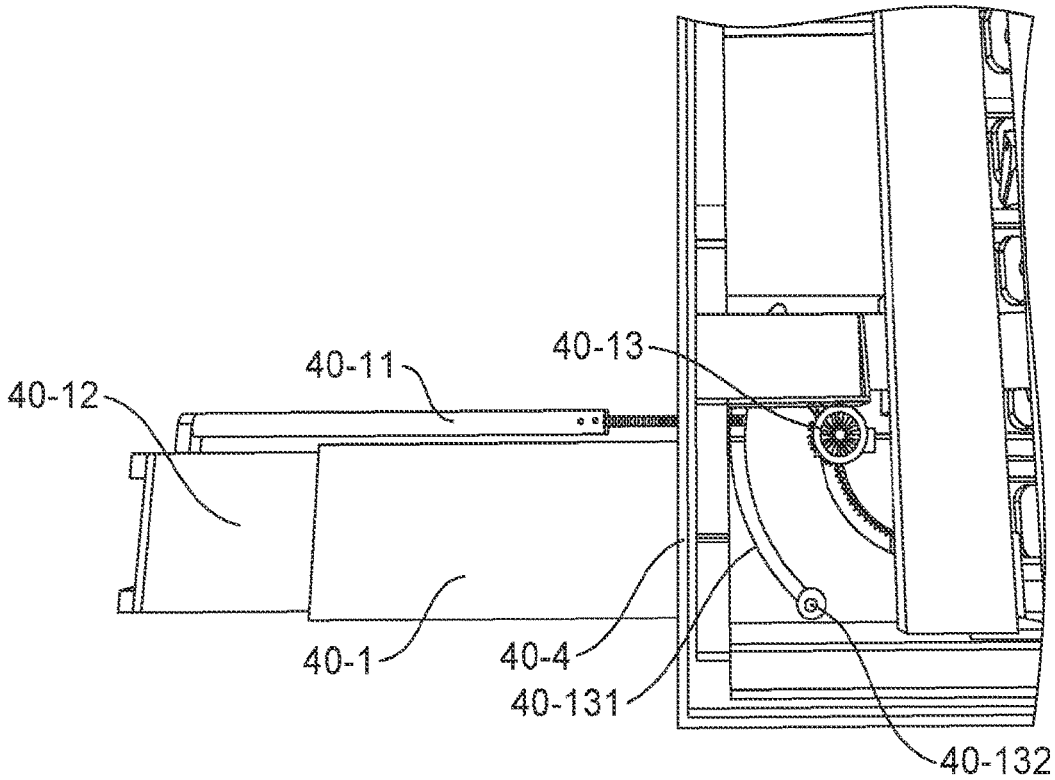
Figure 40D:
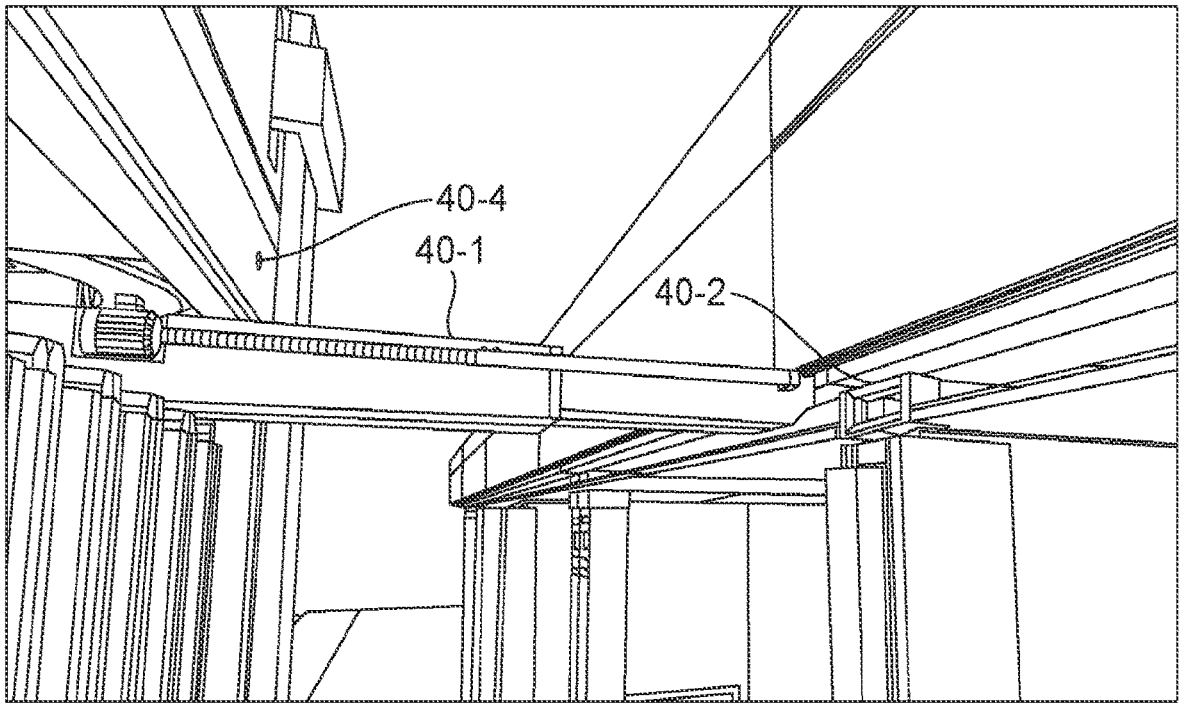
Figure 40E:
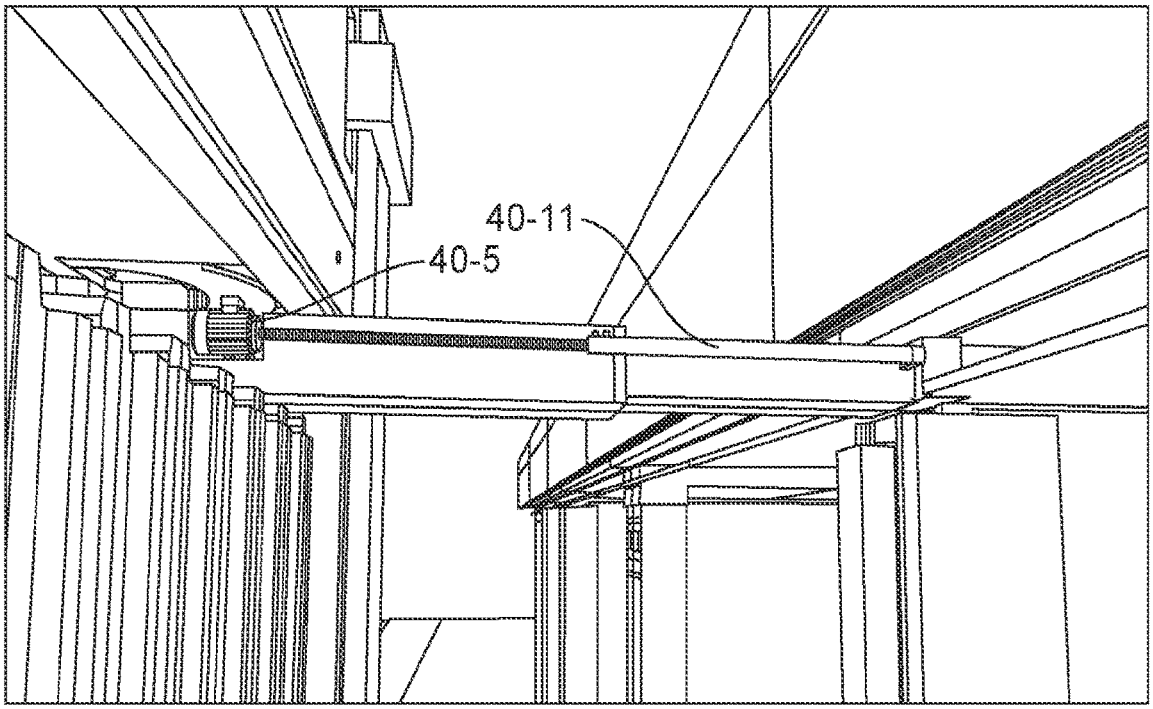
Figure 40F:
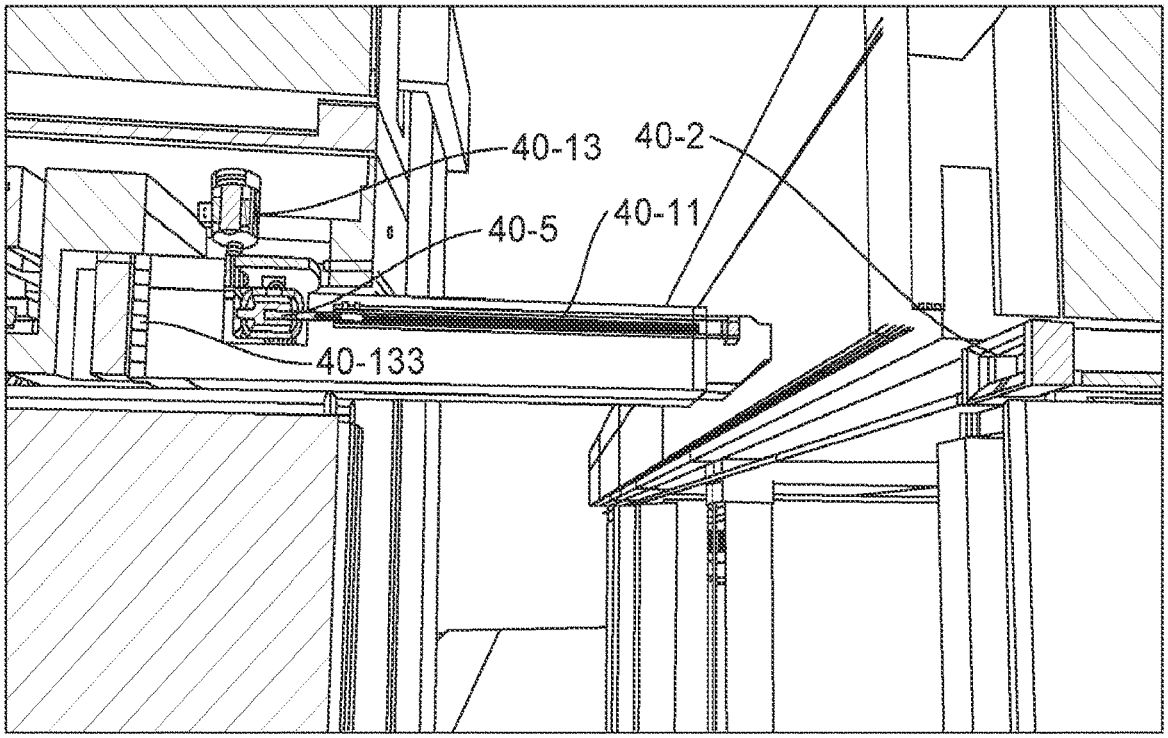
Figure 40G:
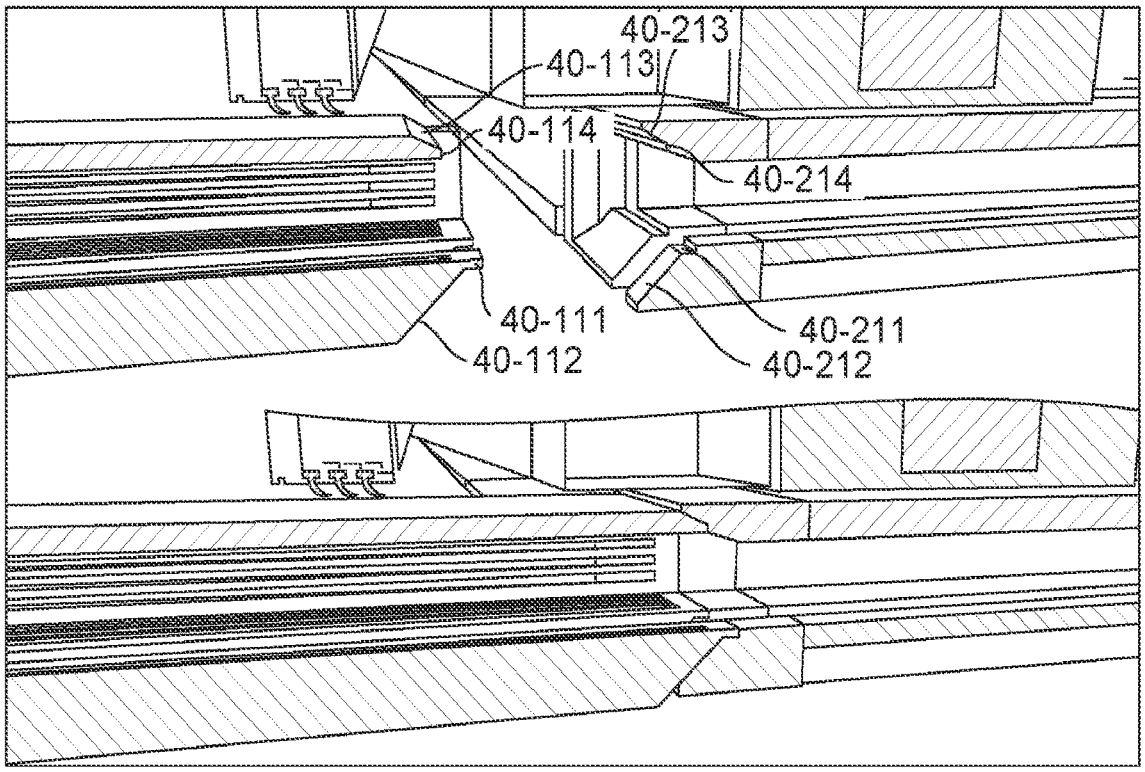
Figure 41A:
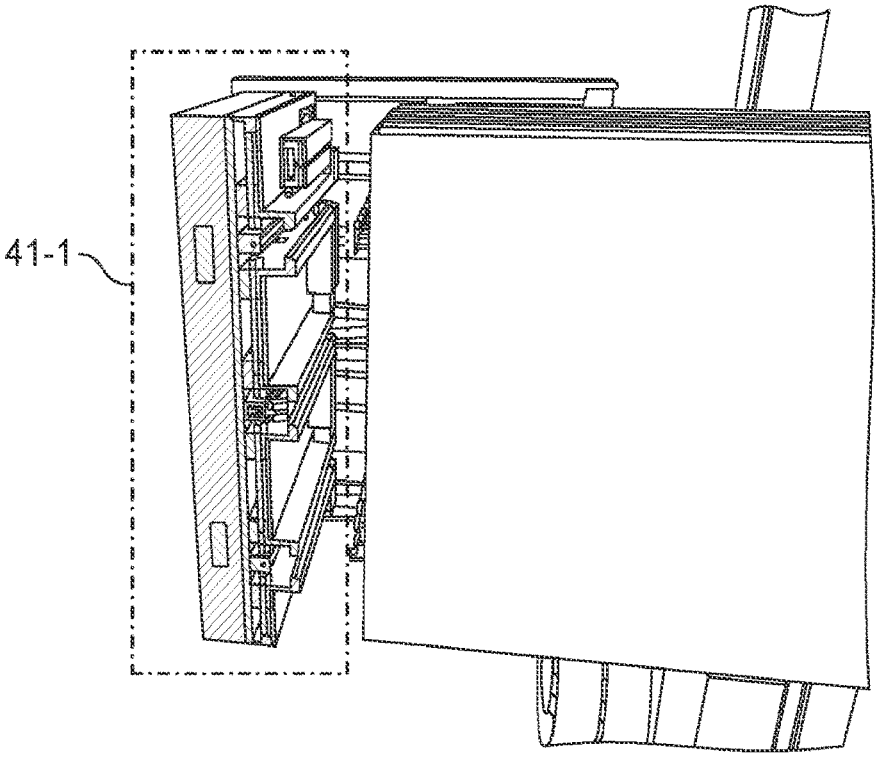
FIGS. 41A and 41B illustrate a storage area for storing interior walls.
Figure 41B:
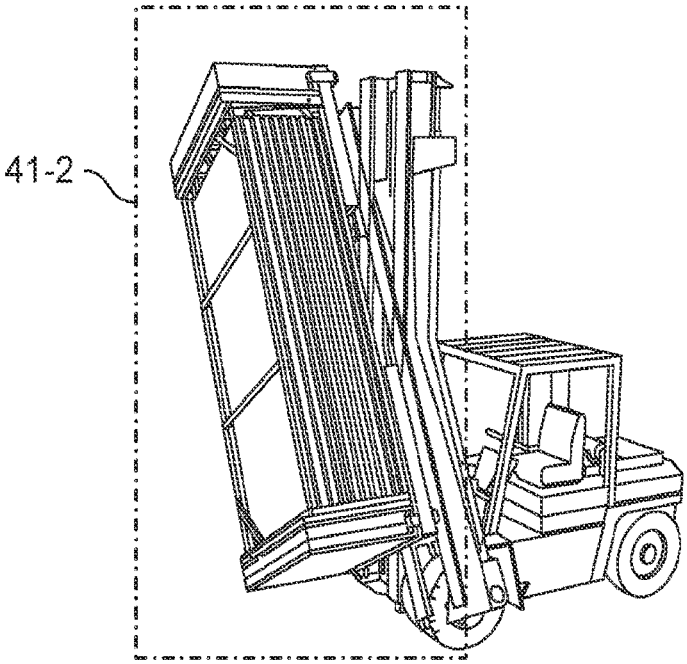
Figure 42A:
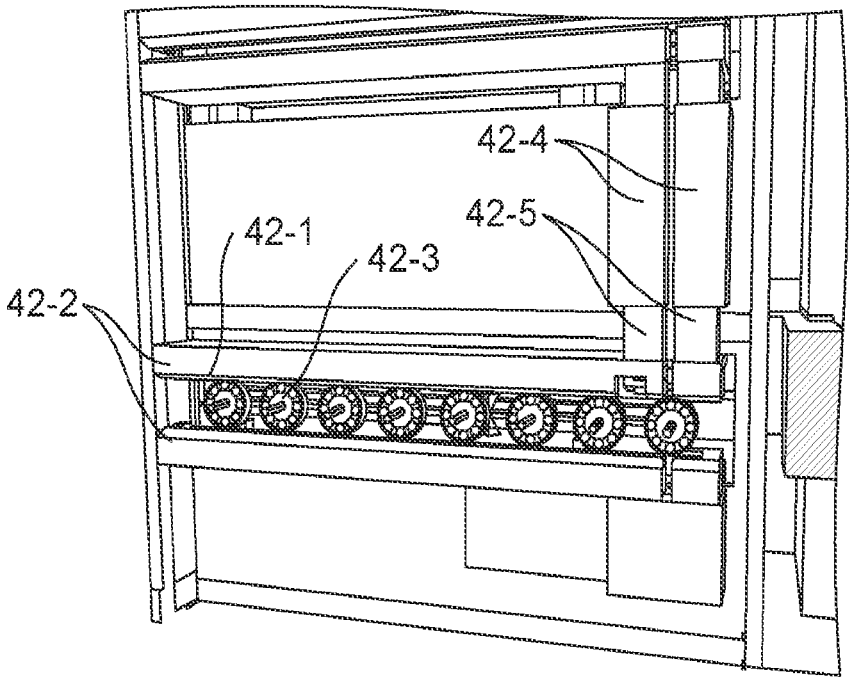
FIGS. 42A to 42H show an embodiment of a first interior wall transport mechanism, which conveys interior walls from the storage area to the docking rail.
Figure 42B:
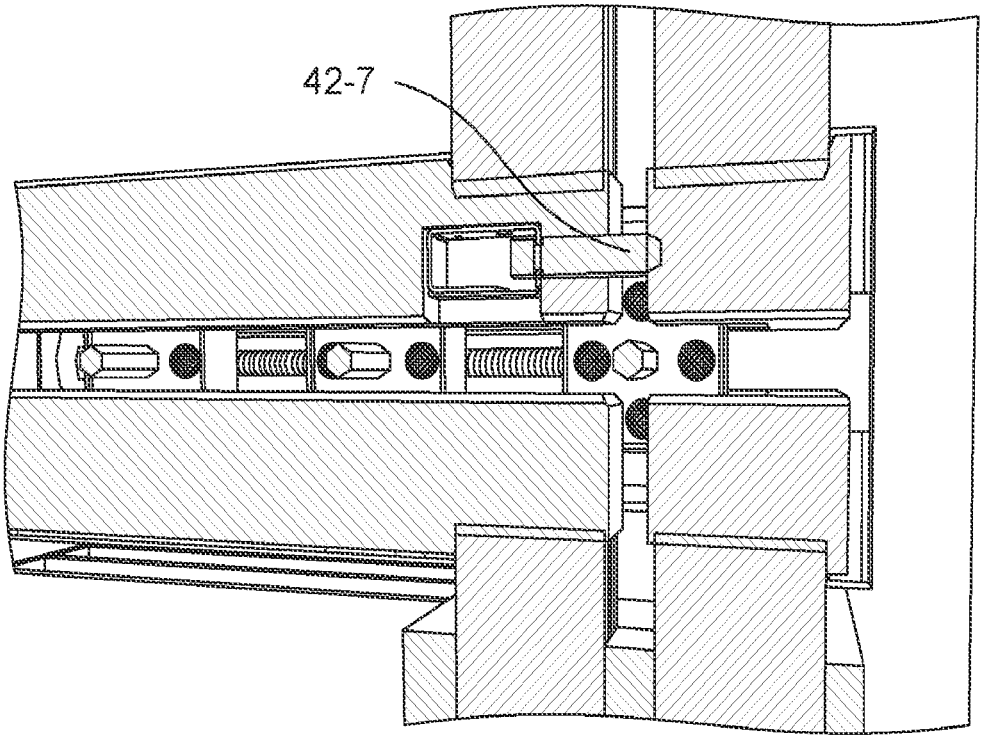
Figure 42C:
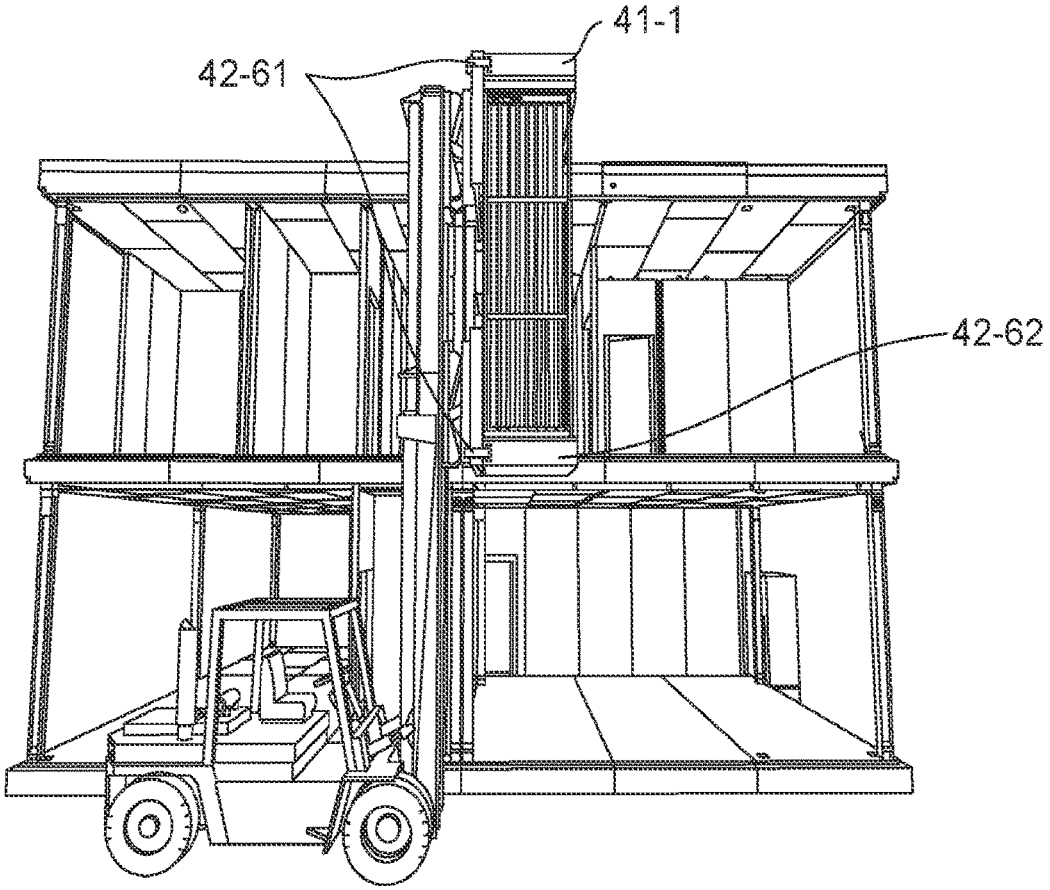
Figure 42D:
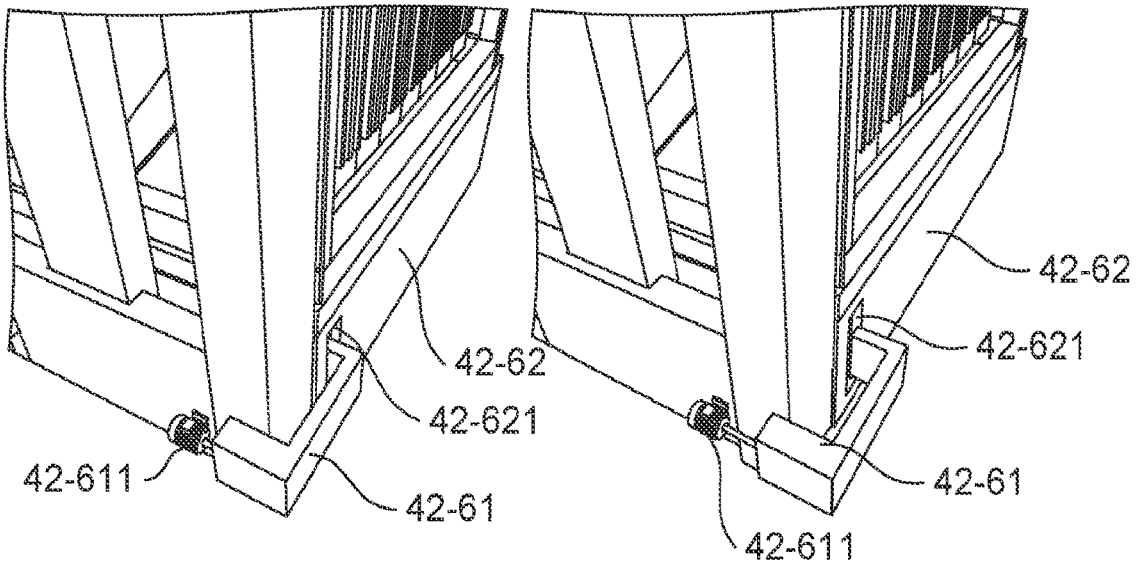
Figure 42E:
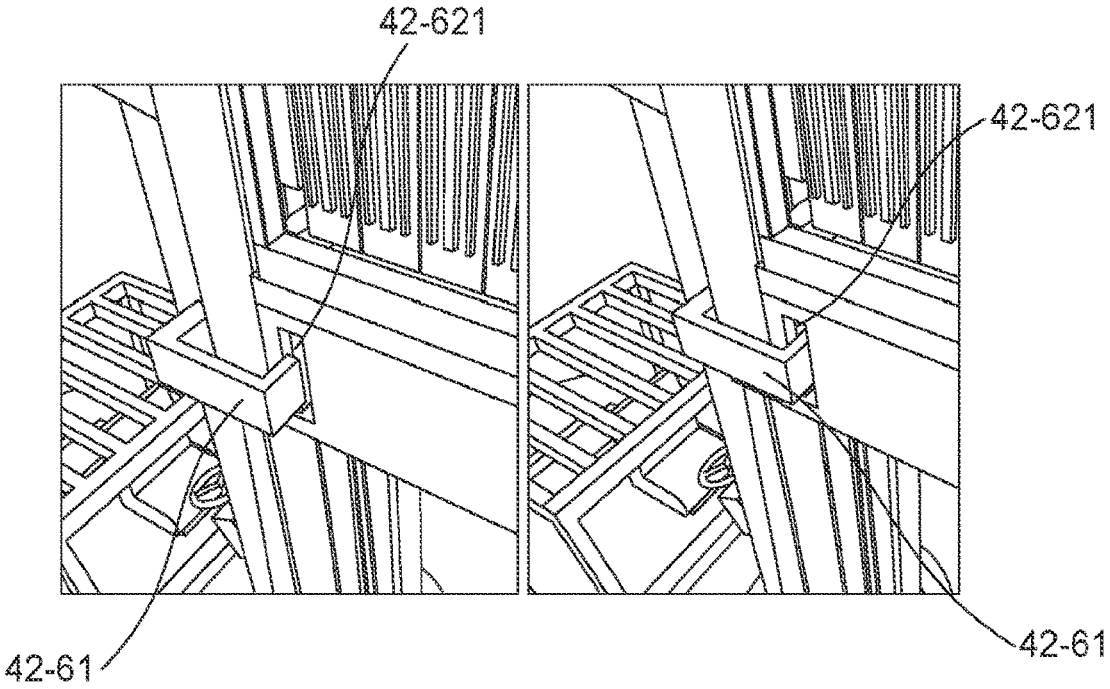
Figure 42F:
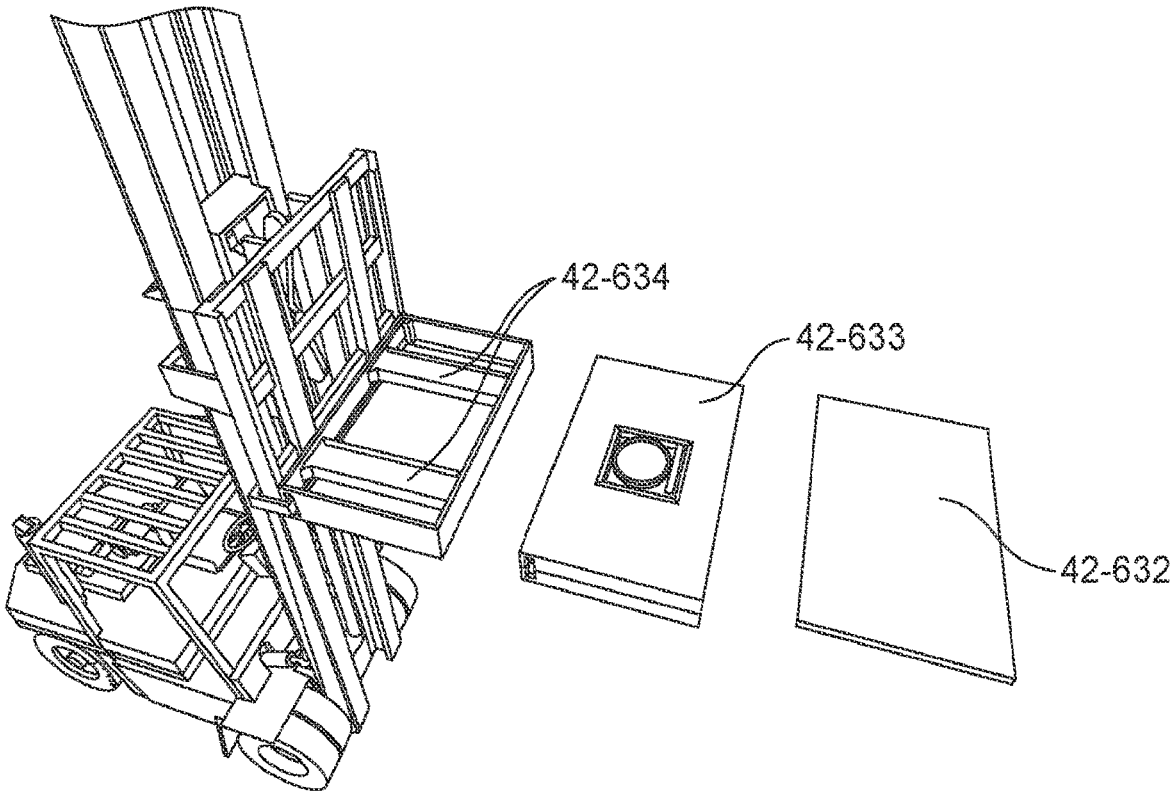
Figure 42G:
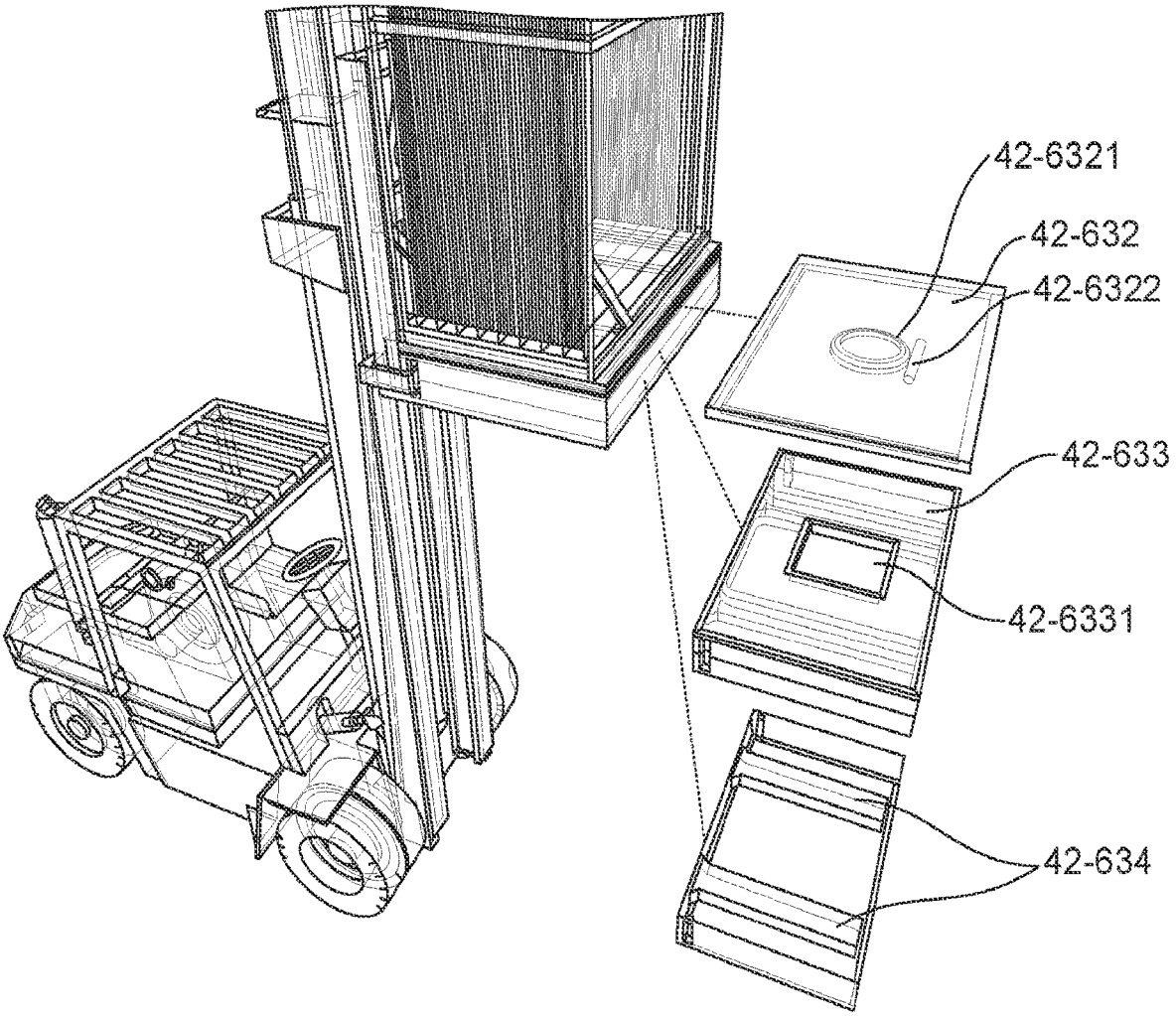
Figure 42H:
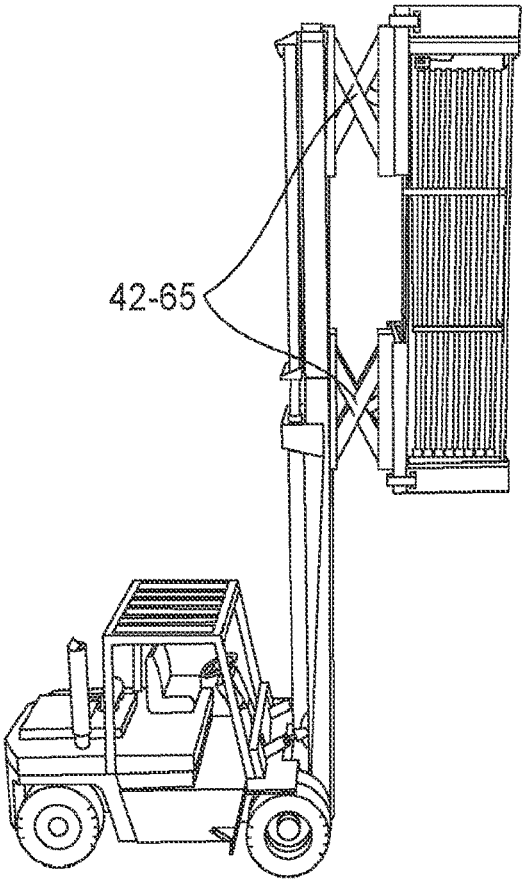
Figure 43A:
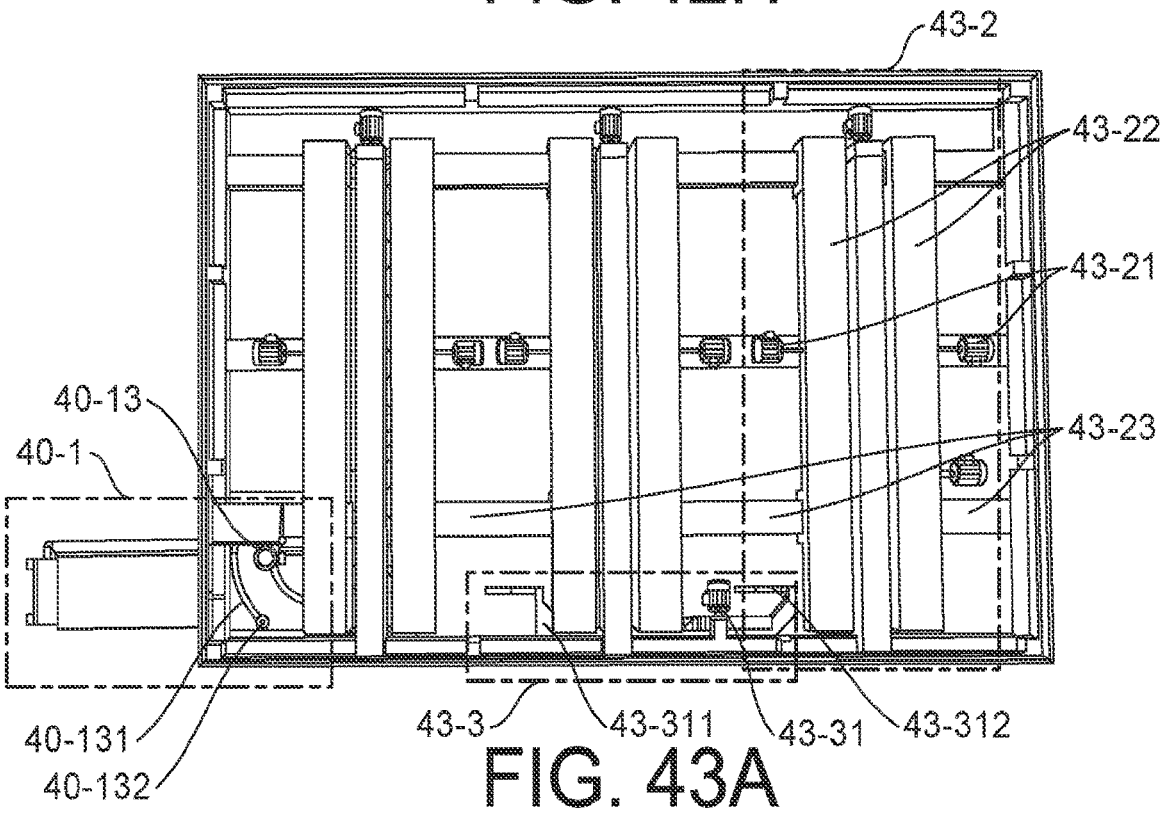
FIGS. 43A to 43D illustrate an embodiment of the operating mechanism of upper part of the interior wall assembly device.
Figure 43B:
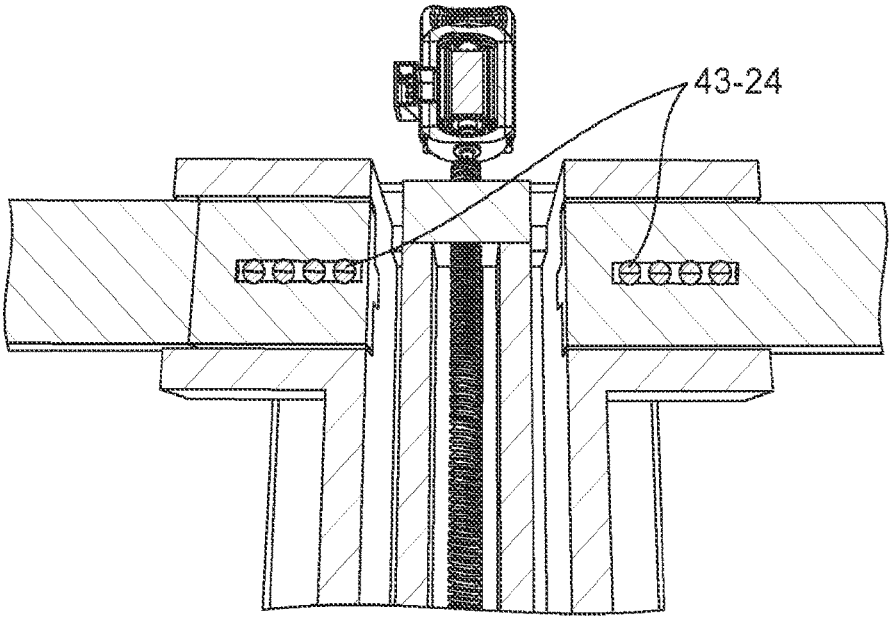
Figure 43C:
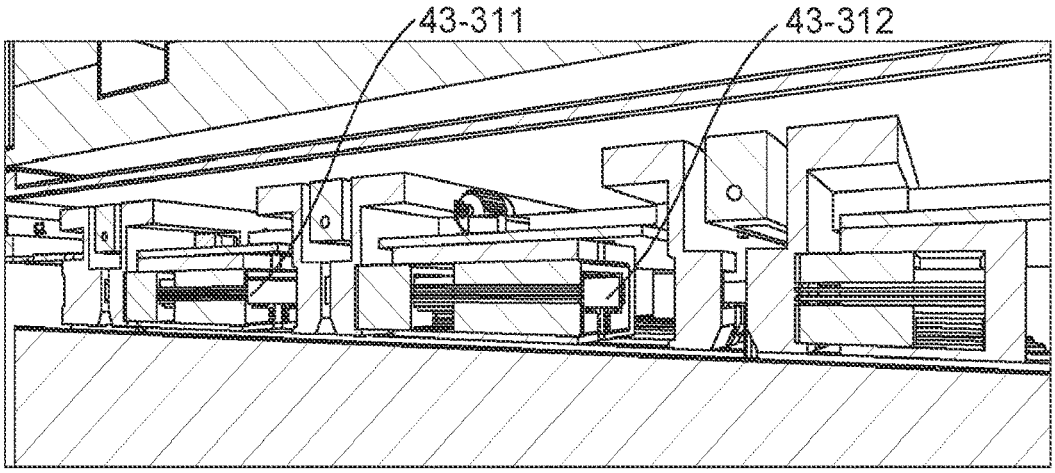
Figure 43D:
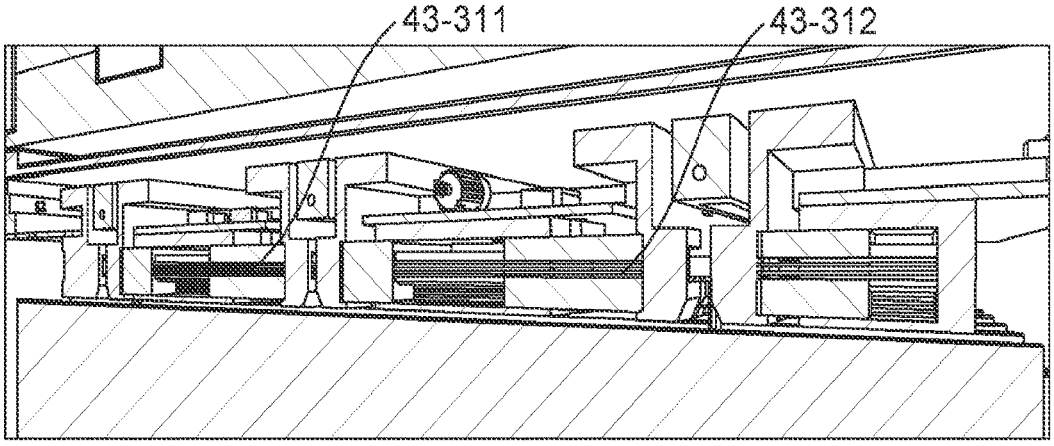
Figure 44A:
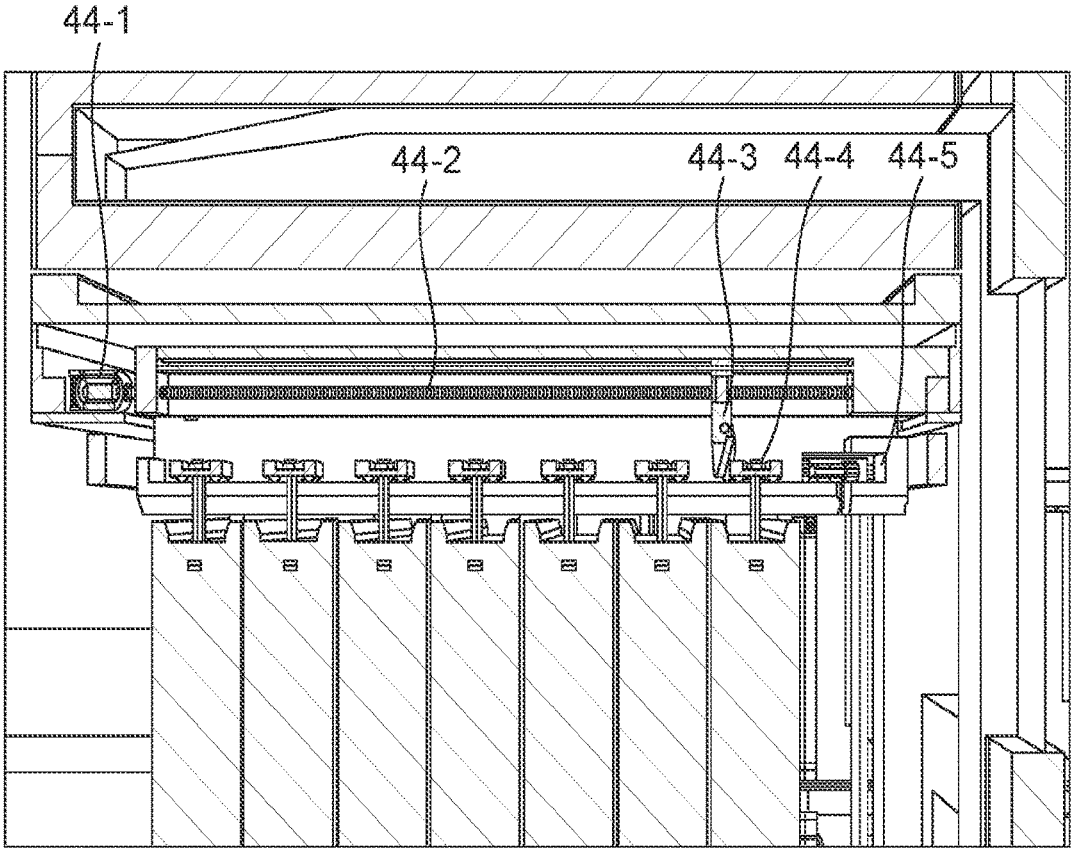
FIGS. 44A to 44E depict the process where a push head, driven by a motor-controlled push rod moving back and forth, advances the hanger piece onto the transport slide rail in sequence.
Figure 44B:
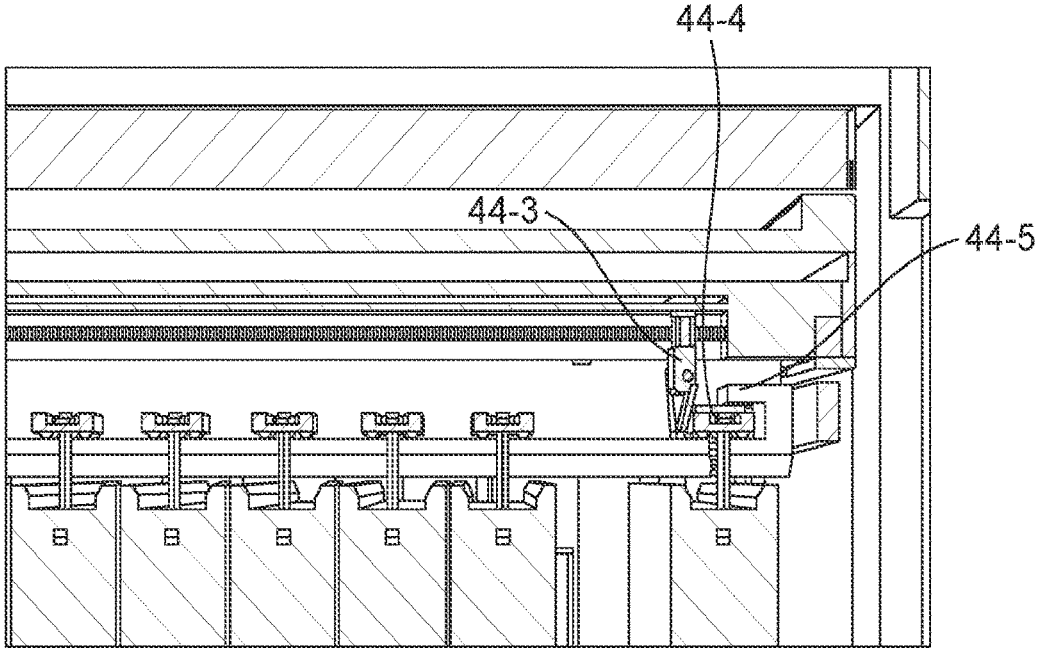
Figure 44C:
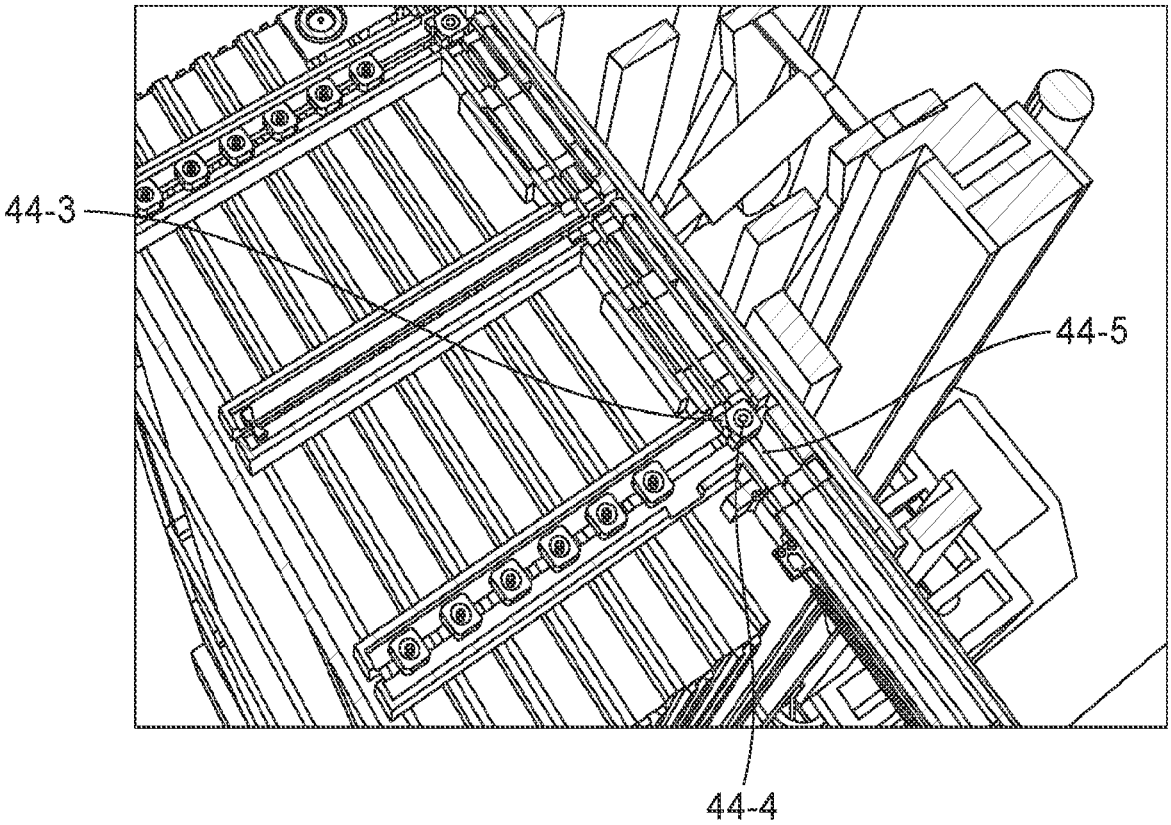
Figure 44D:
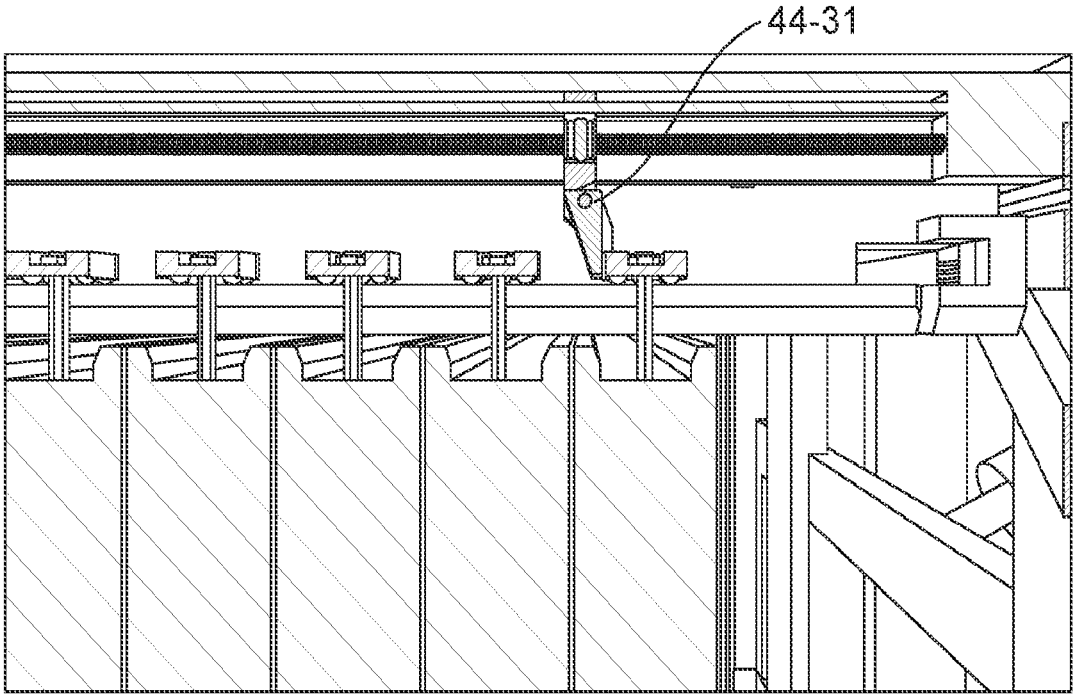
Figure 44E:
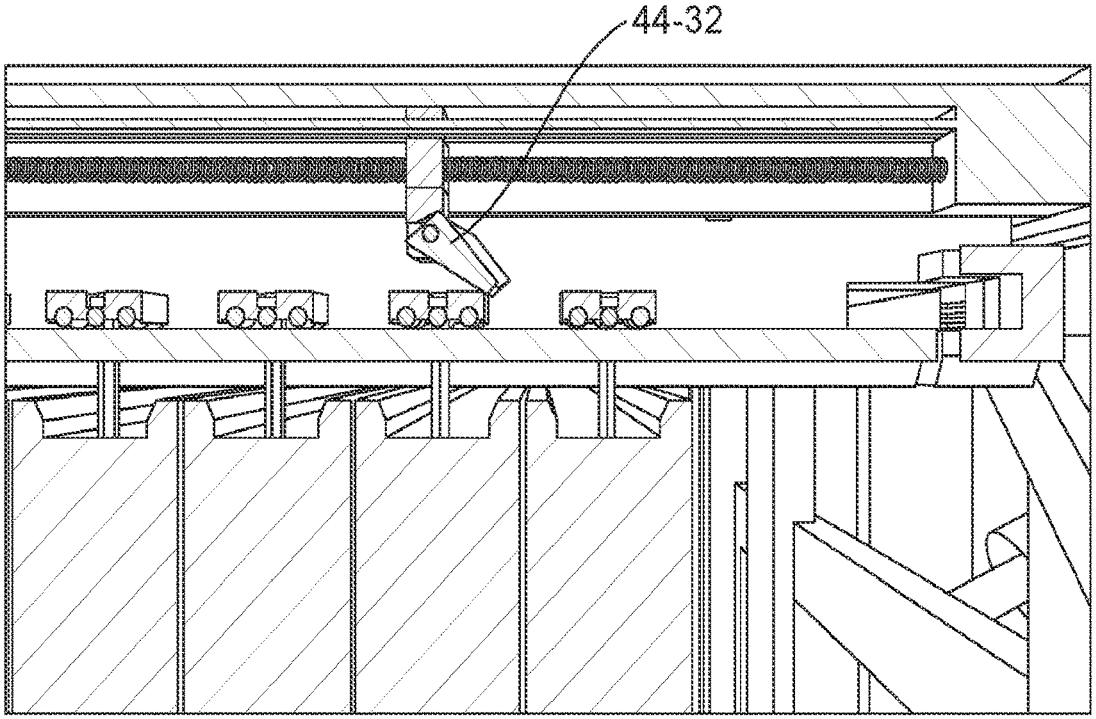
Figure 45:
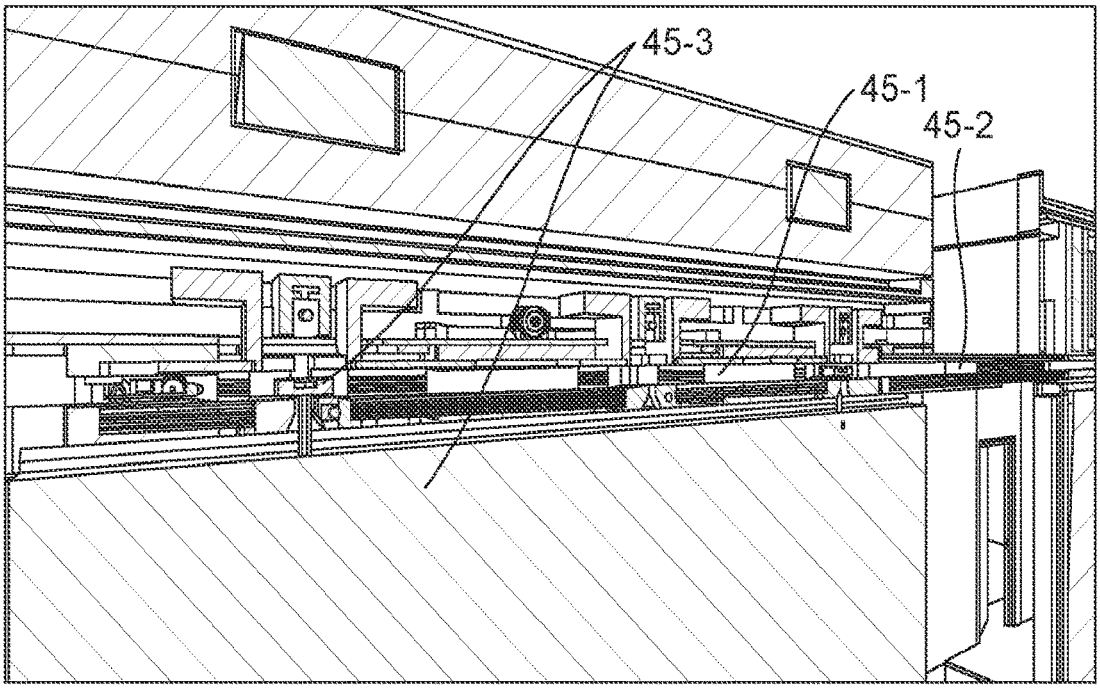
FIG. 45 illustrates an embodiment of a second interior wall transport mechanism, which transports interior walls from the slide rail to the docking rail.
Figure 46:
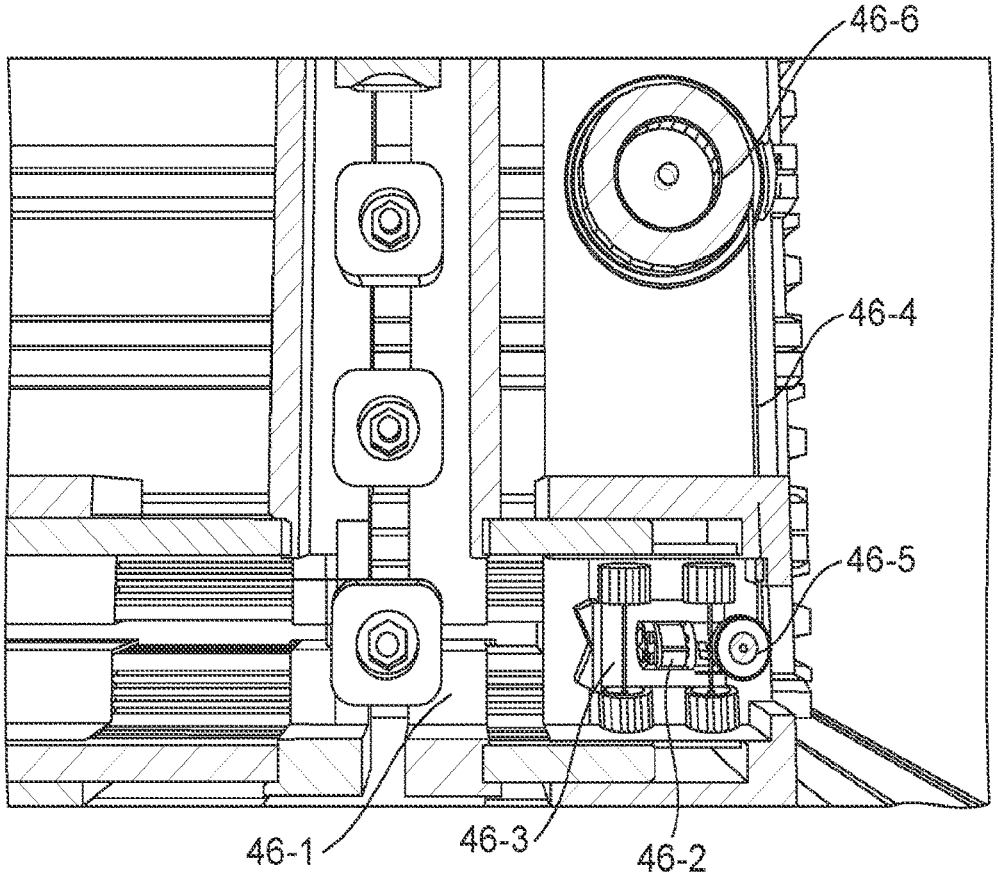
FIGS. 46 and 47 illustrate the operating mechanism of the second interior wall transport mechanism.
Figure 47:
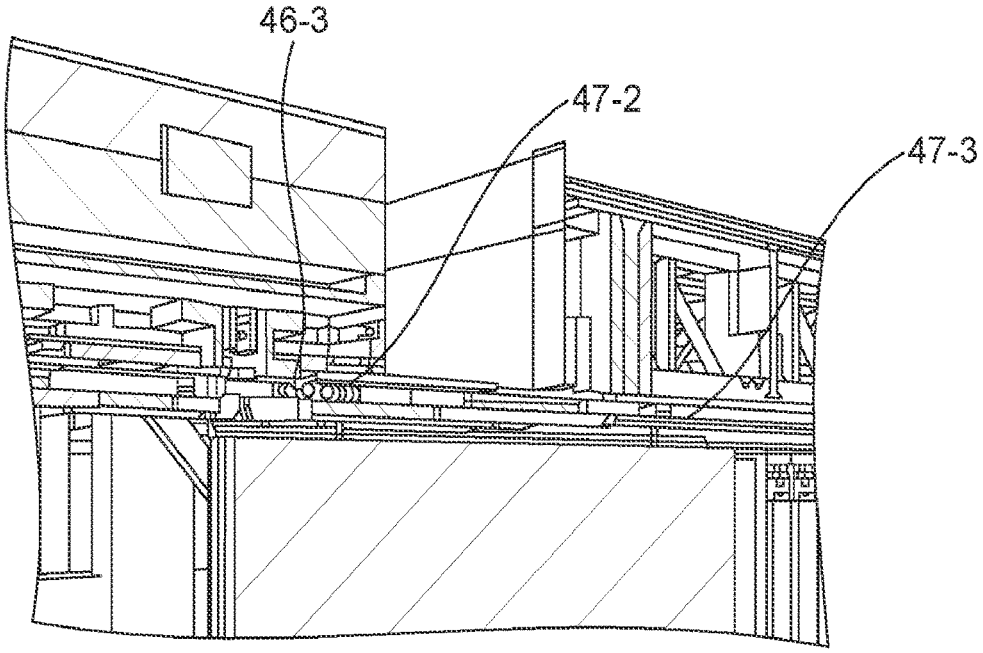
Figure 48:
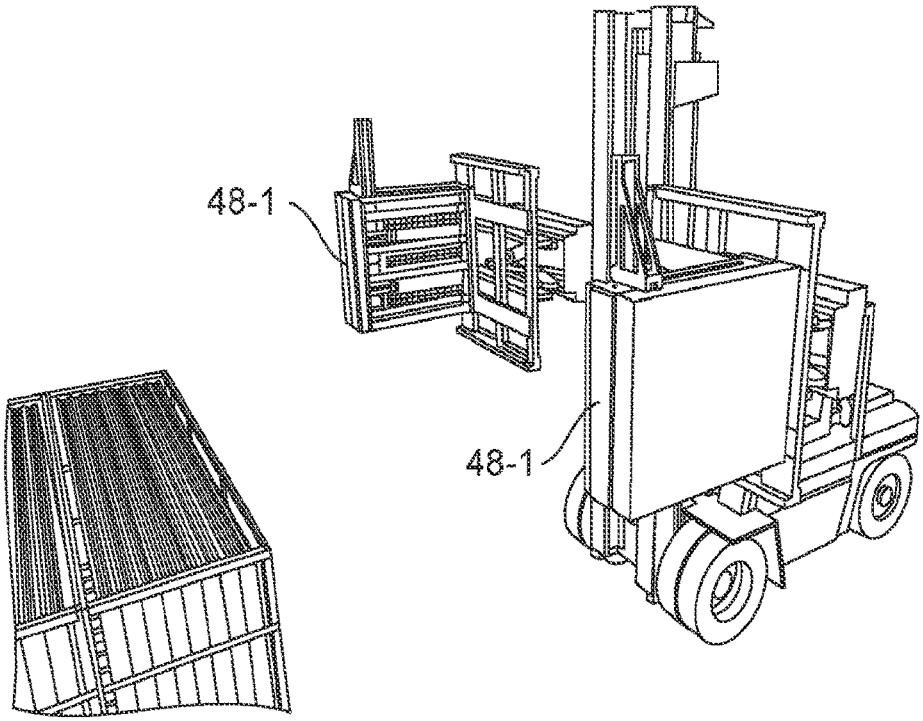
FIG. 48 illustrates the exterior wall assembly device in an embodiment of the present invention.
Figure 49:
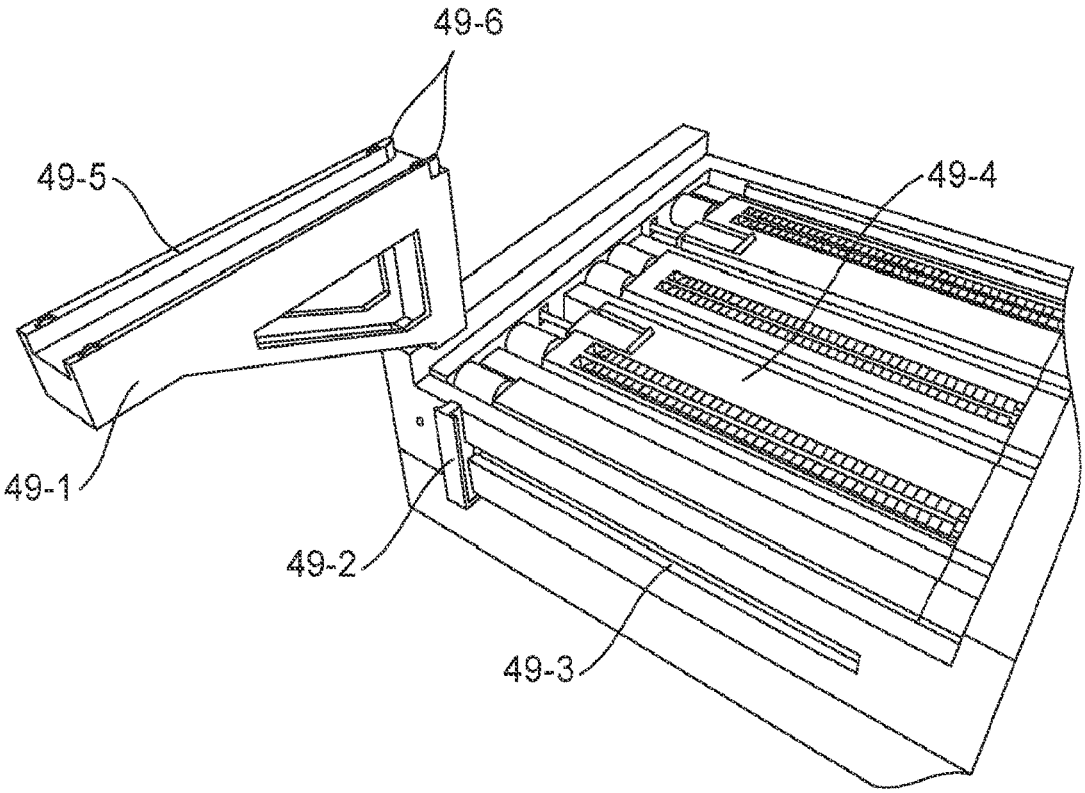
FIG. 49 further illustrates the components included in the exterior wall assembly device of the present invention.
Figure 50A:
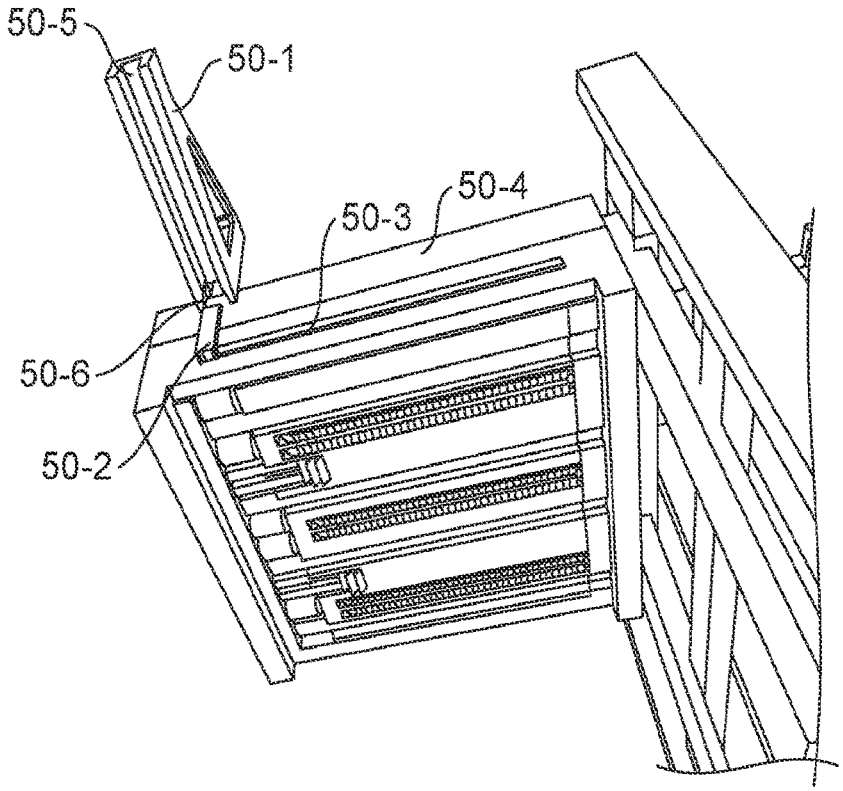
FIGS. 50A and 50B provide additional details on the rail design in the exterior wall assembly device.
Figure 50B:
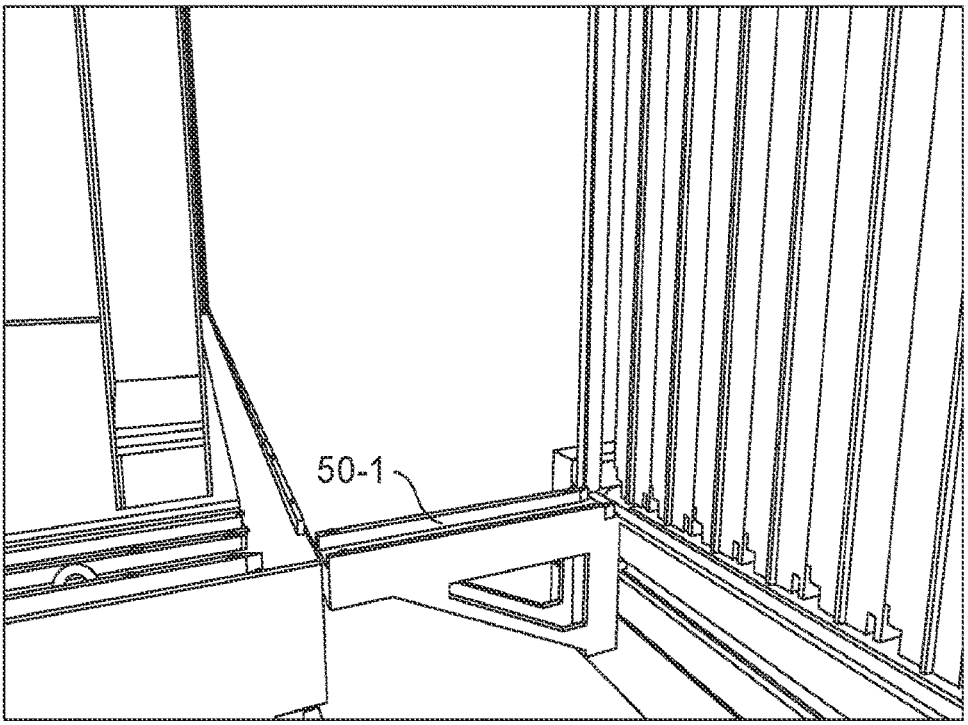
Figure 51:
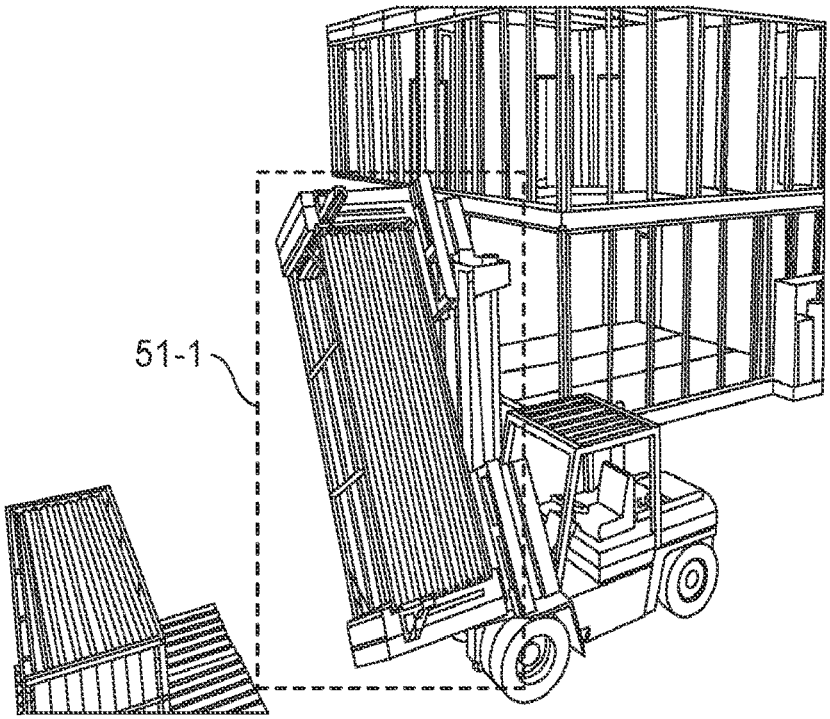
FIG. 51 shows a storage area for storing exterior walls.
Figure 52A:
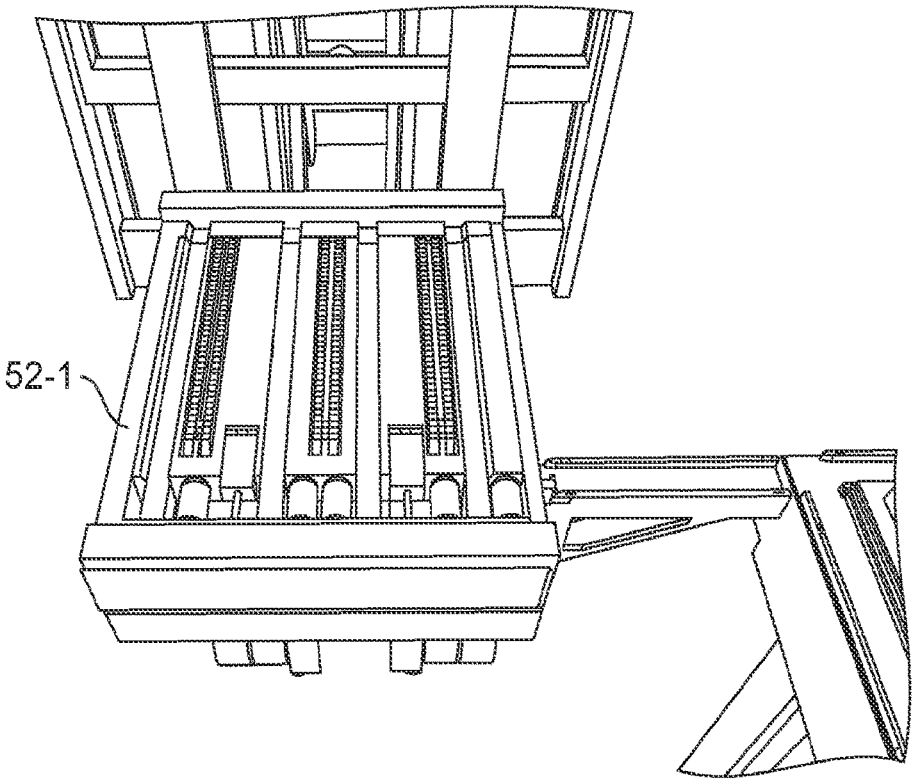
FIGS. 52A and 52B further demonstrate how the storage area clamps the exterior walls from its lower and upper sections.
Figure 52B:
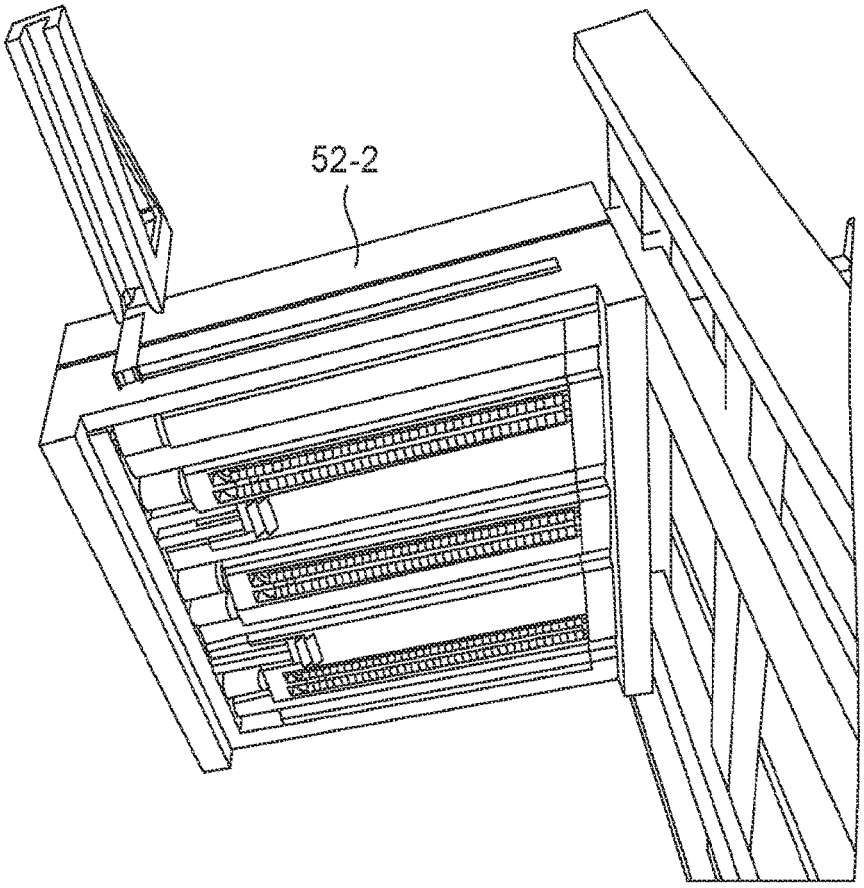
Figure 53A:
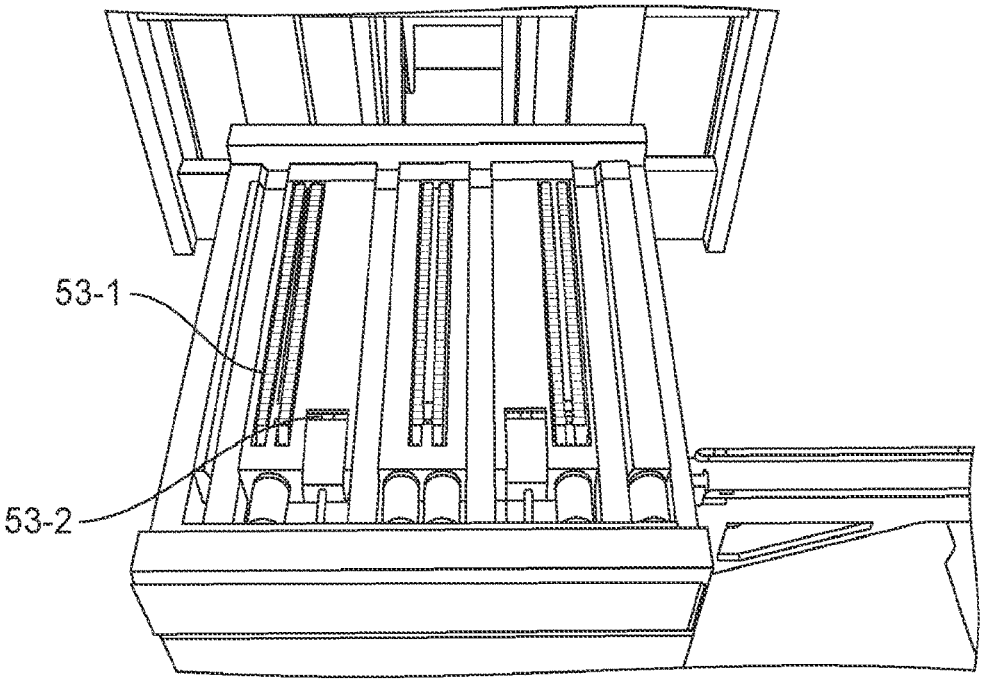
FIGS. 53A to 53C depict an embodiment of a first exterior wall transport mechanism, which transfers exterior walls from the storage area to the docking rail.
Figure 53B:
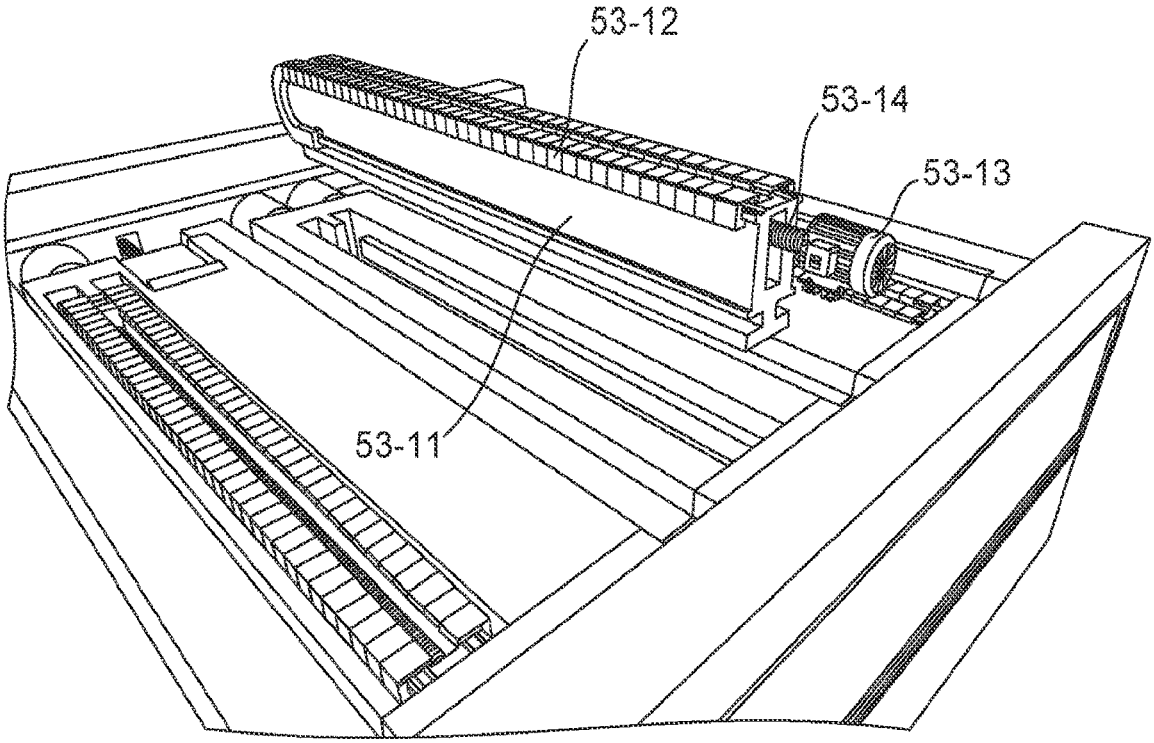
Figure 53C:
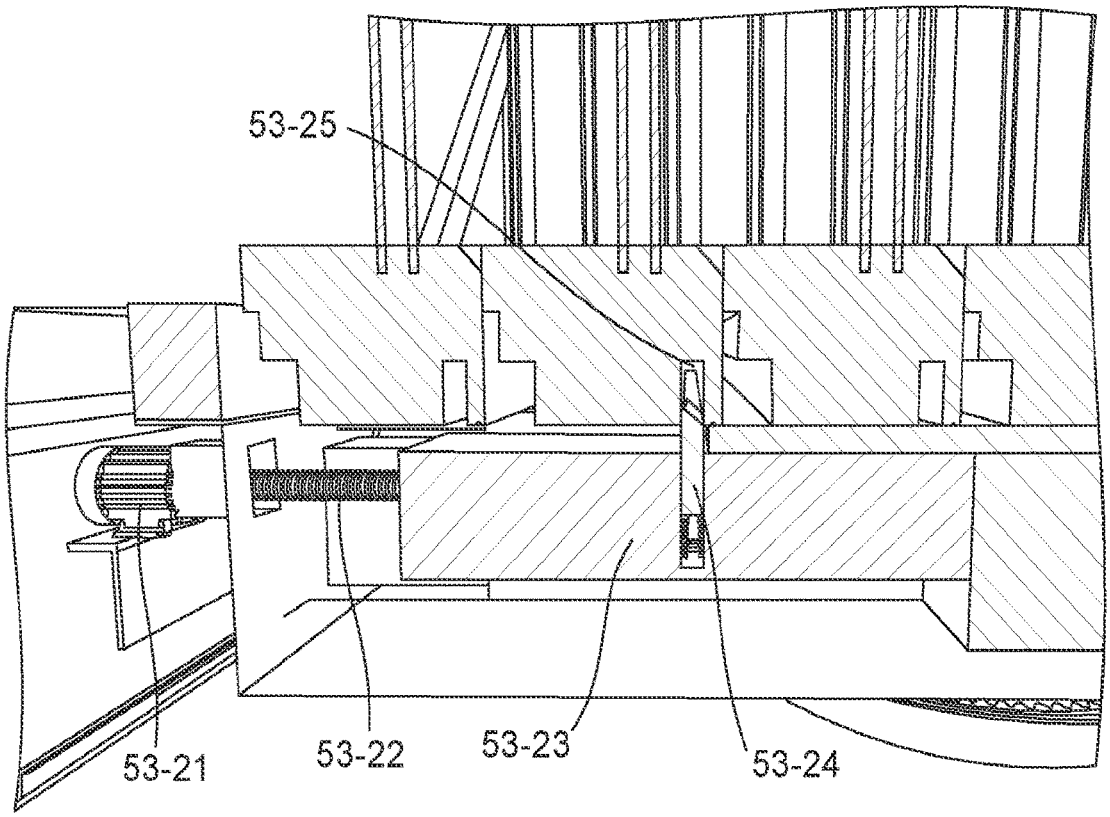
Figure 54A:
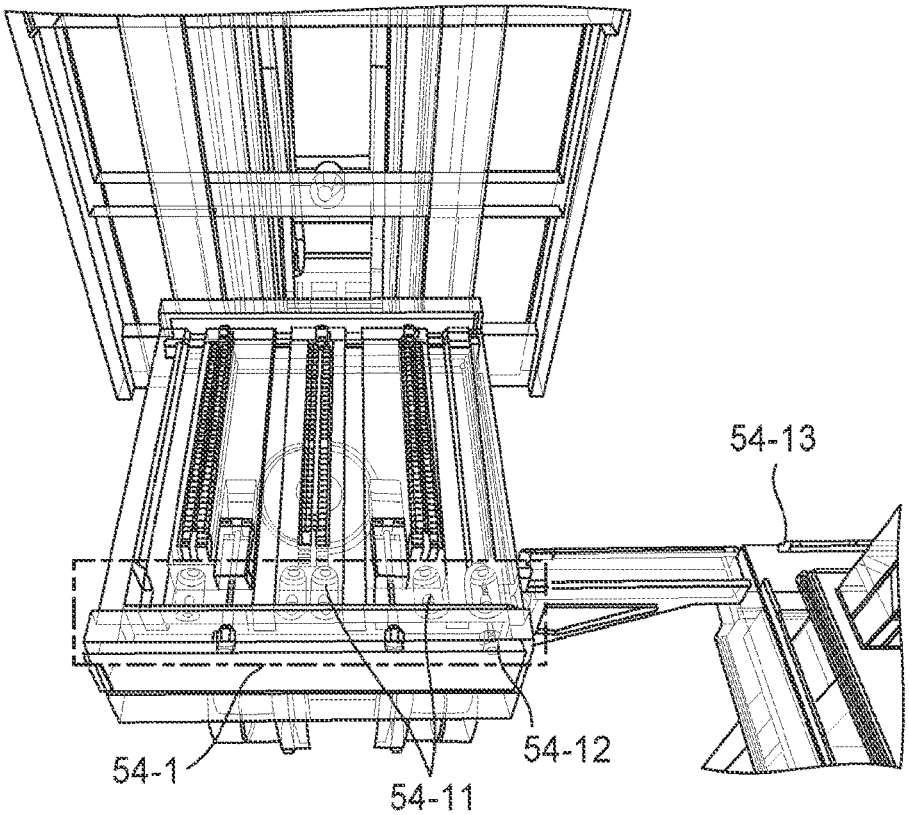
FIGS. 54A and 54B illustrate an embodiment of a second exterior wall transport mechanism, which transfers exterior walls from the docking rail to the slide rail.
Figure 54B:
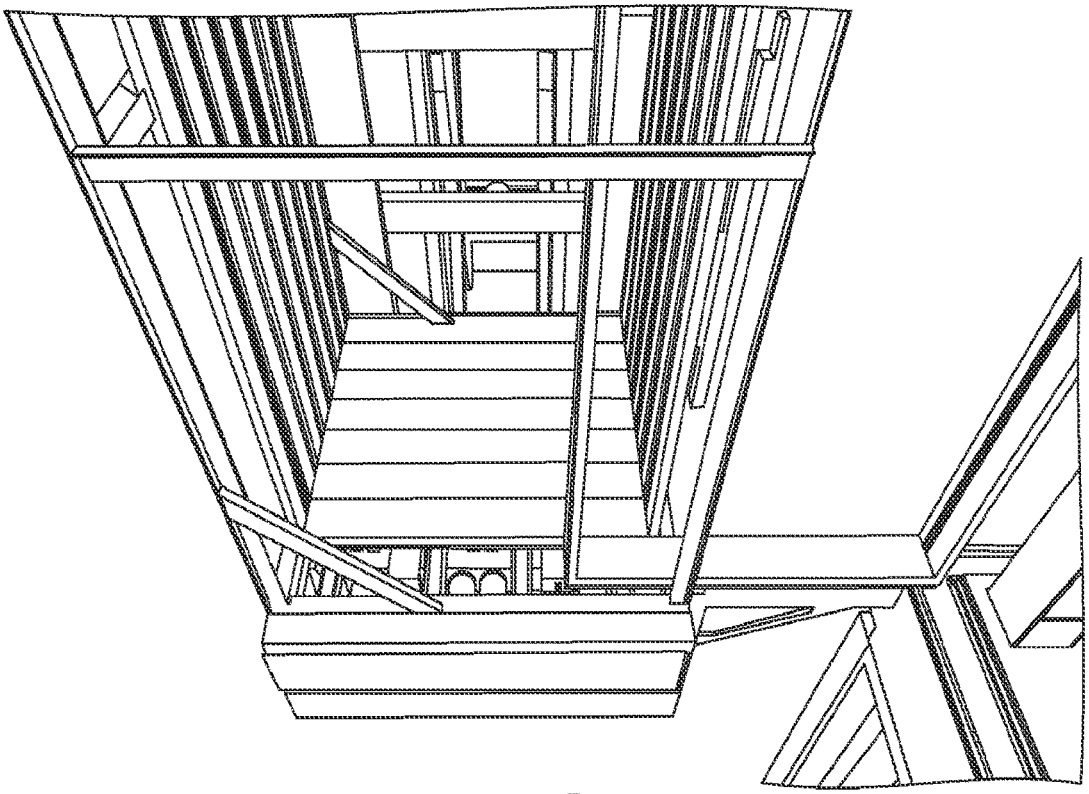

The present invention further provides auxiliary devices for building assembly. In the embodiment shown in FIGS. 39A and 39B, the auxiliary device comprises an interior wall assembly device (39-1). This device can rotate from a vertical position counterclockwise by 90 degrees to maintain a horizontal alignment with the ground, facilitating the clamping of the interior wall storage area device (39-2) placed in a designated location. Once the interior wall storage area device is clamped, the interior wall assembly device rotates clockwise by 90 degrees, returning to its original vertical position (39-3). The clamped assembly is then transported via forklift to a specific area for interior wall installation, ready to be conveyed to the corresponding built-in slide rail within the building. As shown in FIGS. 40A to 40G, said interior wall assembly device comprises: a docking rail (40-1) configured to interface with the built-in slide rail (40-2) of the upper floor slabs, wherein the docking rail can be rotated out from the device during operation (FIG. 40A); The docketing rail (40-1) is aligned with the built-in slide rail (40-2) using an integrated camera (40-4). The camera transmits images to a screen (40-41), providing operators with information to guide the alignment of the docking rail (40-1) with the forklift device in terms of distance and angle (FIGS. 40B and 40C). The docking rail (40-1) is rotated by an internal motor (40-13) within the device. The docketing rail (40-1) design comprises an arc-shaped track (40-131) with fixed pins (40-132) for suspension support, enabling positioned rotation using a vertical hinge (40-133) as the pivot point (FIGS. 40F). These components also work together to provide structural support for the docking rail. The internal structure of the docking rail is equipped with an extension module (40-12) powered by a motor (40-5), which drives a side-mounted actuator (40-11) for forward and backward adjustments to fine-tune the distance. After the docking rail (40-1) is aligned with the built-in slide rail (40-2) of the floor slab, the side-mounted actuator (40-11) pushes the extension module (40-12) forward to engage with the slide rail (FIGS. 40C to 40F). The details of the interface are as follows: the upper section of the docking rail end features a beveled surface (40-113) and a vertical surface (40-114), corresponding to the beveled surface (40-213) and vertical surface (40-214) of the built-in slide rail receiver. Similarly, the bottom section of the docking rail end comprises a beveled surface (40-112) and a vertical surface (40-111), corresponding to the beveled surface (40-212) and vertical surface (40-211) of the built-in slide rail receiver (upper part of FIG. 40G). After the docking rail end (40-1) engages with the built-in slide rail end (40-2), a seamlessly connected track is formed (lower part of FIG. 40G). FIGS. 41A and 41B show an interior wall storage area device (41-2) for storing interior walls in the alignment mechanism, wherein the interior wall storage area device supports the upper region of the interior wall assembly device (41-1) of the interior walls. FIGS. 42A to 42H illustrate the first interior wall transport mechanism, which transports the interior walls from the interior wall storage area device to the docking rail. The mechanism uses a clamp system (42-2) with a beveled opening (42-1) to grip the hanger piece (42-3) and transfer it to the transport track (42-4). A telescopic track (42-5) extends to connect with the transport track (FIG. 42A). Once the clamp grips the hanger piece, a locking mechanism (42-7) engages to prevent the hanger piece from sliding out of the device (FIG. 42B). The forklift device is equipped with an attachment that comprises hooks (42-61) at the upper part of the interior wall assembly device (41-1) and the bottom of the interior wall design (42-62), securing the lifted clamp system (FIG. 42C). This design utilizes a motor (42-611), as shown in FIG. 42D, to retract and tighten the hook (42-61) for secure clamping (FIG. 42E). The hook locks into the recessed slot (42-621) at the bottom of the interior wall assembly device. The bottom components of the interior wall assembly device are detailed in FIGS. 42F to 42H: The bottom of the interior wall assembly device comprises two forklift sleeve tubes (42-634). A rotation device (42-6321) is positioned in the middle to make slight adjustments to the alignment angle of the interior walls with respect to the track entrance. The interior wall loading surface (42-632) is connected to the rotation device. The cavities with-in is filled with structural fillers (42-633) to achieve complete rigidity. The interior wall loading surface (42-632) is coupled with a rotation device (42-6321), which allows for precise angular adjustments when aligning the interior walls with the built-in slide rail. In one embodiment, the rotation device is driven by screw thread and comprises bearings. The rotation device (42-6321) is mounted atop the structural fillers (42-633) and is secured by a metal plate (42-6331). The fork component of the forklift is equipped with a scissor-shaped retractable frame (42-65) (FIG. 42H). This component allows stable forward and backward adjustments of lifted objects, making the docking process between the docking rail (40-1) and the built-in slide rail (40-2) smoother and more efficient. The operating mechanism of the upper part of the interior wall assembly device: As shown in FIG. 43A, said device comprises three main motorized components: the docking rail (40-1), the clamp system (43-2), and the telescopic track connection system (43-3). The docking rail comprises an arc-shaped track (40-131) suspended and supported by fixed pins (40-132), which guide the swinging trajectory of the docking rail and provide precise positioning. The clamp system is driven by two motorized screw rods (43-21) on the sides, allowing it to open and close. When the clamp is opened, it can encase the interior wall hanger piece; when the clamp is closed, it secures the interior wall hanger piece in place. The clamp system incorporates three T-shaped rods (43-23) inserted at the top, middle, and bottom. These rods enhance structural strength and guide the opening and closing of the clamp system, ensuring uniform movement. Bearings (43-24) are positioned at the connection points between the T-shaped rods and the clamp system to reduce sliding friction (FIG. 43B). The function of the telescopic track connection system (43-3) is to drive the front extension rod (43-311) and the rear extension rod (43-312) using a motor coupled with gears (43-31). After the telescopic track connection system (43-3) passes through the metal frame of the interior wall storage area device (39-2) at the upper area of the interior wall assembly device (41-1), the internal components of the slide rail node are pushed out, completing the docking of the slide rail channel (FIGS. 43C to 43D). As shown in FIG. 44A, a motor (44-1) controls a rotating rod (44-2), driving the pushing pick (44-3) to move back and forth, bringing the hanger piece (44-4) onto the transport slide rail (44-5) in sequence. The pushing pick (44-3) pushes the hanger piece (44-4) into the transport slide rail (44-5), as shown in the cross-sectional diagrams in FIGS. 44B to 44E: the pushing pick (44-3) is a movable component. State (44-31) represents the pushing position during advancement (FIG. 44D), while state (44-32) represents the loose position during retraction, allowing it to move over the hanger piece (FIG. 44E). FIG. 45 illustrates the second interior wall transport mechanism, whereby interior walls (45-3) are transported from the slide rail (45-1) to the docking rail (45-2). The operating mechanism of the second interior wall transport mechanism is illustrated in FIGS. 46 and 47. At the end of the slide rail (46-1), there is a pusher (46-3) equipped with a propulsion motor (46-2) and connected to a rear-end electric cable (46-4). The electric cable passes over a small pulley (46-5) and connects to a powered large pulley (46-6). Once the slide rail is aligned with the transport guide rail and the first transport mechanism delivers the interior wall to the guide rail, the pusher (46-3) moves forward, pushing the interior wall (47-2) onto the building's interior track (47-3). The pusher then retracts to the end of the slide rail. In one embodiment as shown in FIG. 48, the auxiliary device for building assembly comprises an exterior wall assembly device (48-1). Said exterior wall assembly device comprises: a docking rail (49-1) configured to align with the built-in slide rail of the floor slabs and transport the exterior wall after aligning it with the building's exterior wall guide rail (FIG. 49). The docking rail is secured to the exterior wall storage area device (49-4) using a buckle (49-2). The buckle can slide along the slide rail (49-3). The docking rail has a design (49-5) corresponding to the building's exterior wall guide rail and features a tapered edge (49-6) at its end to facilitate the insertion of the exterior walls. The upper docking rail (50-1) is secured to the exterior wall storage area device (50-4) using a buckle (50-2), as shown in FIG. 50A. The buckle can slide along the slide rail (50-3). The docking rail has a design (50-5) corresponding to the building's exterior wall guide rail and features a beveled edge (50-6) at its end to facilitate the insertion of the exterior walls, as shown in FIG. 50B. FIGS. 51, 52A, and 52B illustrate an exterior wall storage area device (51-1) for storing exterior walls in the present invention. The exterior wall storage area device clamps the exterior walls with its lower section (52-1) and its upper section (52-2). FIGS. 53A to 53C illustrate the first step (53-1) and the second step (53-2) of the first exterior wall transport mechanism, whereby the exterior wall is transferred from the exterior wall storage area device to the docking rail. The first step comprises several independent transport tracks (53-11) on the upper and lower part of the device. The slide rails (53-12) of the transport tracks are driven by a motor (53-13) and screw rod (53-14), as shown in FIG. 53B, to transfer the exterior walls forward to the position for the second step. In the second step, a motor (53-21) and screw rod (53-22) drive a pusher block (53-23) back and forth. The pusher block comprises a spring-loaded lock (53-24) that can move up and down. When the exterior wall is advanced to this position by the first step, the lock presses down and springs up to latch onto the opening (53-25) on the exterior wall. The pusher block then drives the exterior wall into the second transport mechanism (FIG. 53C). FIGS. 54A and 54B illustrate the second exterior wall transport mechanism (54-1) of the present invention for transferring the exterior walls from the docking rail to the slide rail. The second exterior wall transport mechanism comprises several rubber rollers with bearings (54-11) driven by a motor (54-12). Once the exterior wall reaches this mechanism, the rubber rollers with bearings rotate to push the exterior walls into the building's exterior wall track (54-13).

What is claimed is:

1. A building, comprising:

a) at least two prefabricated building structures;

wherein each of said at least two prefabricated building structure comprises:

i) an upper floor slab, comprising at least one column, each of said at least one column comprises a movable connection end and a free end;

ii) a lower floor slab, comprising at least one column slot, each of said at least one column slot positioned to correspond to said movable connection end;

iii) a spacing slab, comprising a set of guide rails;

wherein said spacing slab is positioned between said lower floor slab and said upper floor slab; said at least one column is initially in a horizontal position; when said upper floor slab is raised, said at least one column to adopt an upright position when said free end is guided by said set of guide rails into a corresponding column slot among said at least one column slot;

b) partition components;

wherein said upper floor slabs and said lower floor slabs of said at least two prefabricated building structures are connected at connections to form a single floor; said partition components divide said single floor into a plurality of spaces; wherein said at least two prefabricated building structures further comprise interior wall slide rails fixed on said upper floor slabs or lower floor slabs; and said partition components comprise interior walls; wherein said interior wall slide rails are configured to guide said interior walls.

2. The building of claim 1, said connections comprise one or more connecting floor slabs which corresponds to a number of said upper floor slabs and said lower floor slabs.

3. The building of claim 1, wherein an interior wall of said interior walls comprises a hanger piece, said hanger piece comprises a support rod which is centrally located and a set of rollers at a bottom; wherein said hanger piece is located at a top of said interior wall and connected to a wall body via said support rod; said hanger piece is positioned within said interior wall slide rails.

4. The building of claim 3, wherein said hanger piece comprises a shape selected from the group consisting of circular, square, and rectangular shapes.

5. The building of claim 1, wherein each of said interior walls comprise an interior wall locking device for securing said interior walls.

6. The building of claim 5, wherein said interior wall locking device comprises an upper fixing component and/or a lower fixing component:

a) said upper fixing component comprises said interior wall slide rail and a recessed slot on said interior walls, wherein said interior wall slide rail is pressed into said recessed slot to secure an upper part of said interior walls;

b) said lower fixing component comprises a fixing element at a bottom of said interior walls and a fixed connector on said lower floor slab or said upper floor slab, wherein said fixing element and said fixed connector are connected to secure a lower part of said interior walls.

7. The building of claim 1, wherein said at least two prefabricated building structures, connecting floor slabs, and said partition components are connected at connection points for power, pipelines, or water pipes.

8. The building of claim 2, wherein said interior walls are adapted for use with an interior wall assembly device, wherein said interior wall assembly device comprises:

a) a docking rail configured to interface with a built-in slide rail in said upper floor slab or lower floor slab;

b) an interior wall storage area device for storing interior walls;

c) a first interior wall transport mechanism for transporting interior walls from said interior wall storage area device to said docking rail; and d) a second interior wall transport mechanism for transporting interior walls from said docking rail to said built-in slide rail.

9. The building of claim 1, wherein said at least two prefabricated building structures further comprises exterior wall slide rails fixed to edges of said upper floor slab or said lower floor slab; and said partition components comprise exterior walls; wherein said exterior wall slide rails are configured to guide said exterior walls.

10. The building of claim 9, wherein said exterior walls are adapted for use with an exterior wall assembly device, wherein said exterior wall assembly device comprises:

a) a docking rail configured to interface with a built-in slide rail in said upper floor slab or said lower floor slab;

b) an exterior wall storage area device for storing exterior walls;

c) a first exterior wall transport mechanism for transporting exterior walls from said exterior wall storage area device to said docking rail; and d) a second exterior wall transport mechanism for transporting exterior walls from said docking rail to said built-in slide rail.

11. The building of claim 10, wherein said upper floor slab comprises exterior wall locking devices for interlocking with exterior wall locking devices at a top part of said exterior walls.

12. The building of claim 1, wherein said upper floor slab comprises a downward pressing interlock structure, wherein said downward pressing interlock structure interacts with a receiving structure on said partition components to lock said partition components in place and prevent displacement.

13. The building of claim 1, further comprises a jack within a lifting space on said movable connection end, wherein said lifting space comprises an outer sleeve located on said upper floor slab and an inner sleeve connected to said at least one column; wherein said outer sleeve encircles said inner sleeve, such that when said jack raises said upper floor slab from within said inner sleeve, movement of said upper floor slab is constrained by a trajectory of said outer sleeve, thereby stabilizing said upper floor slab.

14. The building of claim 1, said at least two prefabricated building structures, said connecting floor slabs, or said partition components further comprise one or more automatic tightening device for tightening connections in said building.

15. The building of claim 14, wherein each of said one or more automatic tightening device comprises an electric wrench and at least one bolt.

16. The building of claim 1, wherein said at least one column comprises two or more columns, wherein said two or more columns do not overlap when placed in a horizontal position.

17. The building of claim 1, wherein said spacing slab is made of paper-based materials; or a paper cover and an inner core.

18. The building of claim 1, wherein said upper floor slab comprises: a) a roof level slab; or b) at least one intermediate floor slab and a roof level slab.

19. The building of claim 1, wherein said at least two prefabricated building structures building structure further comprises an automatic tightening device for tightening connections in said prefabricated building structure.

20. The building of claim 19, wherein said automatic tightening device secures said movable connection end to said upper floor slab or said lower floor slab when said at least one column is in an upright position.

21. The building of claim 19, wherein said automatic tightening device comprises an electric wrench and at least one bolt.

22. The building of claim 1, wherein said at least two prefabricated building structures further comprises a floor slab fixing mechanism for securing said upper floor slab, spacing slab, and lower floor slab together when said at least one column is in a horizontal position.

23. A method for assembling the building of claim 12, comprising: a raising step to lift said upper floor slabs to create a space for inserting said partition components;

and a lowering step wherein said downward pressing interlock structure of said upper floor slabs presses down on said receiving structure to lock said partition components in place and prevent displacement.

24. The method of claim 23, wherein said raising step or lowering step is performed using machines comprising one or more selected from the group consisting of screw jacks, cranes, pneumatic rods, and hydraulic jacks.

* * * * *